US005287866A

United States Patent [19]

Torimitsu et al.

[11] Patent Number: 5,287,866

[45] Date of Patent: Feb. 22, 1994

[54] DISHWASHING SYSTEM

[75] Inventors: Hiroshi Torimitsu; Chiyoshi Toya; Tomio Suyama; Sadayuki Hirate; Tomoko Yamamura, all of Toyoake, Japan

[73] Assignee: Hoshizaki Denki Kabushiki Kaisha, Tokyo, Japan

[21] Appl. No.: 861,803

[22] PCT Filed: Oct. 22, 1991

[86] PCT No.: PCT/JP91/01444

§ 371 Date: Jun. 15, 1992

§ 102(e) Date: Jun. 15, 1992

[30] Foreign Application Priority Data

Oct. 24, 1990 [JP] Japan ..... 2-286840
Oct. 24, 1990 [JP] Japan ..... 2-286841

[51] Int. Cl.[5] ..... B08B 3/02

[52] U.S. Cl. ..... 134/44; 134/57 D; 134/58 D; 134/133; 134/165

[58] Field of Search ..... 134/44, 57 D, 56 D, 134/58 D, 133, 165, 140, 146; 198/502.3

[56] References Cited

U.S. PATENT DOCUMENTS 3,910,297 10/1975 Pinkham ..... 134/133
4,299,189 11/1981 Nagberg et al. ..... 134/133
4,561,144 12/1985 Marais ..... 134/133
4,676,365 6/1987 Noren ..... 134/133
4,744,379 5/1988 Goettel ..... 134/133

FOREIGN PATENT DOCUMENTS 3320048 12/1984 Fed. Rep. of Germany ... 134/58 D
60-118502 6/1985 Japan .
62-44807 3/1987 Japan .
1-58081 12/1989 Japan .
1087213 4/1984 U.S.S.R. ..... 134/44

*Primary Examiner*—Frankie L. Stinson
*Attorney, Agent, or Firm*—Nikaido Marmelstein Murray & Oram

[57] ABSTRACT

In a dishwashing system, a dishwashing machine (10) is provided to wash a rack holding thereon tableware in a washing chamber, a wagon (W) is provided to have therein plural stages of horizontal storage shelves in an up-and-down direction, and an elevator (E) is disposed between the wagon and the dishwashing machine. On the elevator (E), a drive control device is provided to move a ramp (56) of the elevator by a driving mechanism (60) toward a position facing to one of shelves of the wagon after the rack has been placed at a reference position of the ramp (56) by way of timing belts (57*i*) (57*l*), to drive the timing belts by a timing belt mechanism (57) so as to store the rack onto the shelf, to stop the timing belt mechanism upon completing storage of the rack and to drive the driving mechanism till the ramp reaches the reference position. These operations are repeated by the drive control device.

1 Claim, 30 Drawing Sheets

DISHWASHING SYSTEM

TECHNICAL FIELD

The present invention relates to a dishwashing system suitable for washing and rinsing tableware and storing the rinsed tableware.

BACKGROUND ART

In a conventional dishwashing system, a heavy rack which retains thereon tableware is placed in a washing chamber of a dishwashing machine, and the tableware is washed and rinsed when a door of the washing chamber is closed. When the door is opened after rinse of the tableware, the rack which retains thereon the rinsed tableware is taken out of the washing chamber onto a work table. When the work table becomes full of racks during repetition of the above-mentioned works, the individual racks which retains thereon rinsed tableware are sequentially carried to a proper place.

With the above construction, it is performed wholly with hands to place each of the racks in the washing chamber, to move each of the racks from the washing chamber onto the work table and to carry away each of the racks from the work table to the proper place. If those works are done by a single worker, the worker is forced to overwork, causing undesired results and inevitably dropping the rate in operation of the dishwashing machine. The surface area of the work table is also required to be wider in accordance with the number of racks. These defects are recognized especially remarkable in case the aforementioned individual works are done together with washing and rinsing of many tableware at a time in a large-scale restaurant facility in a hotel and the like.

DISCLOSURE OF THE INVENTION

It is therefore an object of the present invention to provide a dishwashing system, capable of effecting the above-described individual works related to the individual racks automatically as much as possible.

The object of the present invention is attained by providing a dishwashing system comprising:

a dishwashing machine for washing tableware at every time when each rack holding thereon tableware is placed in a washing chamber;

a wagon provided therein with plural stages of horizontal storage shelves in an up-and-down direction;

an elevator disposed between the wagon and the dishwashing washing machine and provided therein with an elevatable base for placing thereon the each rack holding thereon tableware at every time when the each rack is removed from the washing chamber and with a conveying mechanism mounted on the base for horizontally conveying the each rack placed on the base to store the each rack onto each of the storage shelves;

reference position detecting means for detecting a reference position defined in the elevator when the base reaches the reference position;

placing detection means for detecting placing of the each rack on the base at every time when the each rack is placed on the base maintained at the reference position;

opposing position detecting means for detecting an opposing position of the base to one of the storage shelves when the base reaches the opposing position; and drive control means for moving the base upward or downward in response to detection of the placing detection means, for releasing the upward or downward movement of the base in response to detection of the opposing position detecting means to effect horizontal conveyance of the conveying mechanism, for releasing the horizontal conveyance of the conveying mechanism when the placing detection means becomes a non-detection state upon each completion of storing the each rack onto each of the storage shelves to move the base downward or upward, and for releasing the downward or upward movement of the base in response to detection of the reference position detecting means.

BRIEF DESCRIPTION OF THE DRAWINGS

Referring now to FIGS. 1 and 2 of the accompanying drawings, there is illustrated a first preferred embodiment of a dishwashing system in accordance with the present invention. As shown in FIG. 1, the dishwashing system is provided with an elevator E, which is lined up with a dish washing machine 10 by way of a work table 20. The elevator E has a rectangular solid frame 30, which is formed into a rectangular solid shape by assembling each four rectangular pole frame members 32*a* to 32*d*, 33*a* to 33*d* (only the frame members 32*a* and 33*a* are shown in FIG. 1) on four supports 31*a* to 31*d* (only the supports 31*a* and 31*b* are shown in FIG. 1) with a rectangular cross section at the top and bottom. In FIG. 1, the reference characters 40*a* and 40*b* denote left and right side plates, and the reference character 40*c* represents a top plate.

Figure 1:
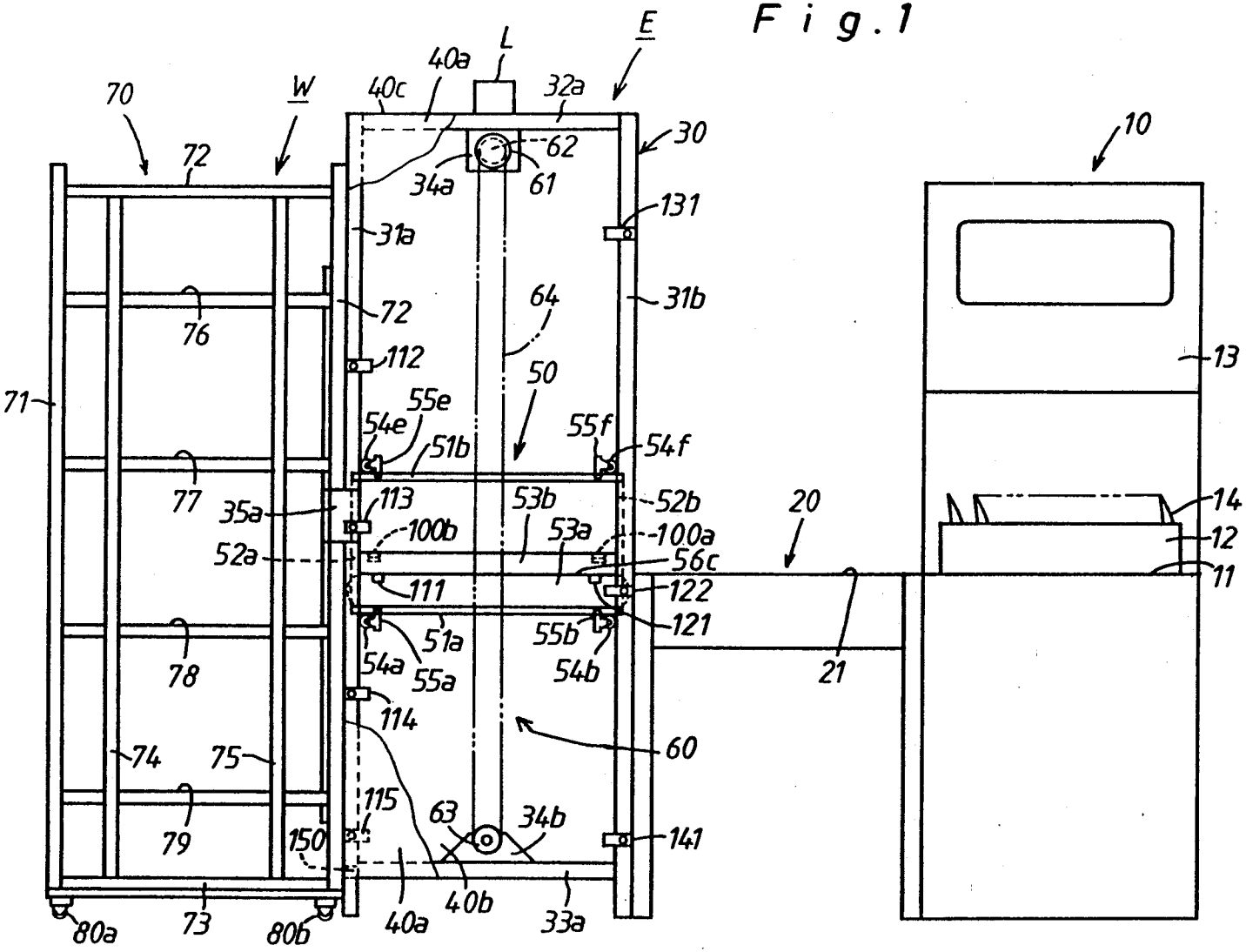
FIG. 1 is a partially broken side view illustrating a first preferred embodiment of a dishwashing system in accordance with the present invention adapted to a dishwashing machine.

An elevator assembly 50 has a rectangular solid shape, and is assembled via a drive mechanism 60 in the frame 30 horizontally and elevatably along the individual supports 31*a* to 31*d*. The drive mechanism 60 has a geared brake motor 61, which is attached to a flange 34*a* suspended from the center portion of the frame member 32*c* (located on the upper edge side of the right side plate 40*b* and in parallel to the frame member 32*a*). The output shaft of the geared brake motor 61 penetrates a flange 34*a* perpendicularly and rotatably. The geared brake motor 61 rotates at a reduced speed in accordance with release of its electromagnetic brake when supplied with electric power, and stops rotating in accordance with the mechanical braking function of the electromagnetic brake when power supply is stopped. A sprocket 62 is coaxially supported rotatable on the tip portion of the output shaft of the geared brake motor 61, and a sprocket 63 is rotatably supported in parallel to a bracket 34*b* vertically extending upward from the center of the frame member 33*c* (located on the lower edge side of the right side plate 40*b* and in parallel to the frame member 33*a*) immediately below the flange 34*a*. A chain 64 is wound around both sprockets 62 and 63.

Figure 3:
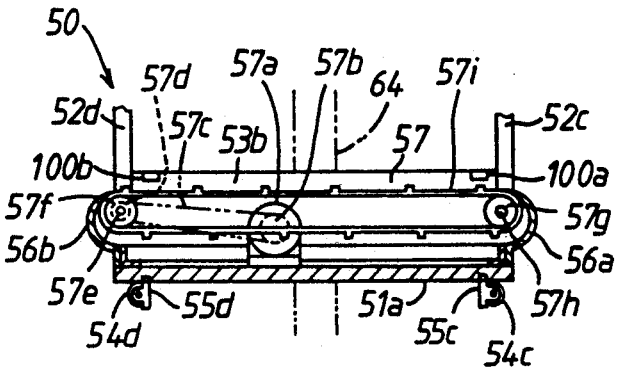
FIG. 3 is a partial cross-sectional view of an elevator assembly shown in FIG. 1.

As shown in FIGS. 1 and 3, the elevator assembly 50 has a horizontal bottom plate 51*a* above which a top plate 51*b* is supported in parallel to the bottom plate 51*a* by four rectangular supports 52*a* to 52*d* provided upright at the four corners of the bottom plate 51*a*. A left side plate 53*a* is assembled on the left edge of the bottom plate 51*a*, with its front and back end portions fixed to the lower halves of both rectangular supports 52*a* and 52*b*, as shown in FIG. 1, while a right side plate 53*b* is assembled on the right edge of the bottom plate 51*a*, with its front and back end portions fixed to the lower halves of both rectangular supports 52*c* and 52*d*, as shown in FIG. 3. The right side plate 53*b* is securely supported at the center portion of the chain 64 by means of an L-shaped rod (not shown) fixed to the center of the outer wall of the side plate 53*b*. The space between the left and right side plates 53*a* and 53*b* are set slightly wider than the width of the rack 12.

Individual guide rollers 54*a* and 54*b* are rotatably supported at the front and back end portions of the left edge of the bottom plate 51*a* by metal fittings 55*a* and 55*b*, as shown in FIG. 1; those guide rollers 54*a* and 54*b* abut on the right side of the front wall of the support 31*a* and on the right side of the rear wall of the support 31*b* in a turnable manner. Individual guide rollers 54*d* and 54*c* are rotatably supported at the front and back end portions of the right edge of the bottom plate 51*a* by metal fittings 55*d* and 55*c*, as shown in FIG. 3; those guide rollers 54*d* and 54*c* abut on the left side of the front wall of the support 31*d* and on the left side of the front wall of the support 31*c* in a turnable manner. Individual guide rollers 54*e* to 54*h* (only the guide rollers 54*e* and 54*f* are shown in FIG. 1) are rotatably supported at the front and back end portions of the left and right edges of the top plate 51*b* immediately above the guide rollers 54*a* to 54*d* by metal fittings 55*e* to 55*h* (only the metal fittings 55*e* and 55*f* are shown in FIG. 1). Those guide rollers 54*e* and 54*h* abut on the supports 31*a* to 31*d* in a turnable manner, like the guide rollers 54*a* to 54*d*.

Figure 4:
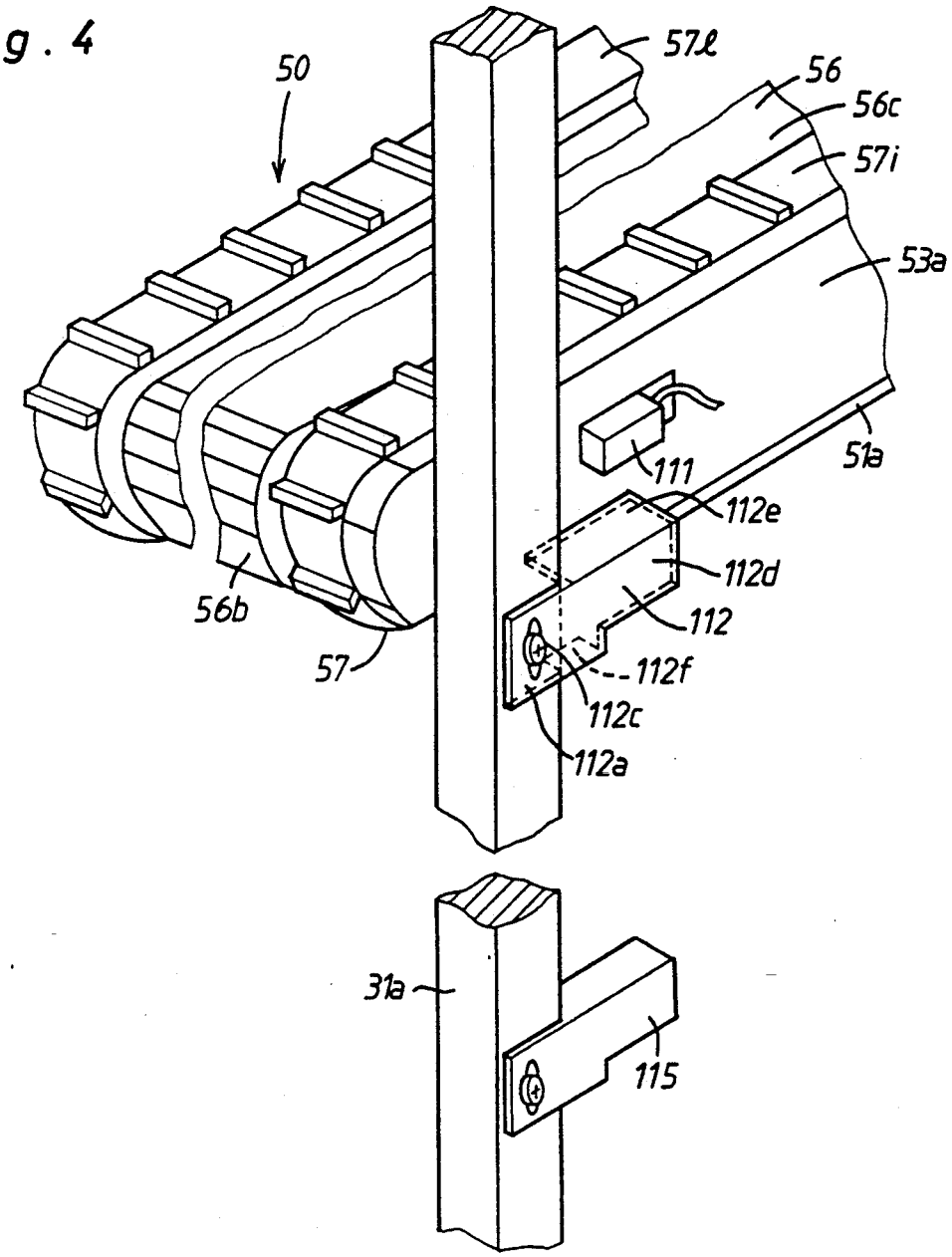
FIG. 4 is an enlarged cutaway perspective view illustrating essential portions of the elevator assembly shown in FIG. 1 and a position where a level sensor is attached.

An ramp 56 is mounted together with a timing belt mechanism 57 on the bottom plate 51*a* as shown in FIGS. 3 and 4. As should be easily understood from FIG. 4, the ramp 56 has an approximately elongated rectangular shape and is mounted on the bottom plate 51*a* with a predetermined space to the left and right side plates 53*a* and 53*b*. The ramp 56 has a front wall 56*a* and a rear wall 56*b* bent outward respectively with a semicircular cross section, as shown in FIG. 3, and has a top wall 56*c* lying on substantially the same horizontal plane as a top 21 of the work table 20 and a placing surface 11 for the rack 12 within the dishwashing machine 10, as shown in FIG. 1.

The timing belt mechanism 57 has a geared brake motor 57*a*, which is mounted on the bottom plate 51*a* through the bottom wall of the ramp 56 at the center portion thereof, as shown in FIG. 3. This geared brake motor 57*a* has the same construction as that of the geared brake motor 61 and has its output shaft horizontal and perpendicular to the left and right side plates 53*a* and 53*b*. On the output shaft of the geared brake motor 57*a*, supported is a sprocket 57*b* around which a chain 57*c* is wound.

A sprocket 57*d* is rotatably supported on the center portion of a driven shaft 57*e* which is horizontally and rotatably supported between both rectangular supports 52*a* and 52*d*. The chain 57*c* is wound around the sprocket 57*d*. Belt pulleys 57*f* and 57*g* are rotatably supported respectively on the left end portion of the driven shaft 57*e* and the left end portion of a driven shaft 57*h* (horizontally and rotatably supported between both rectangular supports 52*b* and 52*c*) between the ramp 56 and the left side plate 53*a*. A timing belt 57*i* is wound around the belt pulleys 57*f* and 57*g*. Belt pulleys 57*j* and 57*k* (not shown) are rotatably supported on the right end portions of the driven shafts 57*e* and 57*h* between the ramp 56 and the right side plate 53*b*, and a timing belt 571 is wound around the belt pulleys 57*i* and 57*k*. The tops of both timing belts 57*i* and 57*l* are slightly higher than the top wall 56*c* of the ramp 56.

As shown in FIG. 1, the dishwashing system has a wagon W which comprises a wagon body 70 and individual casters 80*a* to 80*d* (only the casters 80*a* and 80*b* are shown in FIG. 1). The wagon body 70 is constructed into a rectangular solid shape by combining individual supports 71 to 74 (only the supports 71 and 72 are shown in FIG. 1) with a plurality of frame members (only the frame members 72 to 75 are shown in FIG. 1).

In the wagon body 70, storage shelves 76 to 79 are provided with intervals as shown in FIG. 1.

When the supports 72 and 73 of the wagon body 70 abuts on both supports 31*a* and 31*d* of the elevator E as shown in FIG. 1, the intermediate portions of the supports 72 and 73 are detachably engaged with engage levers 35*a* and 35*b* ( only the engage lever 35*a* is shown in FIG. 1) attached to the intermediate portions of the supports 31*a* and 31*d* against the resilient force thereof. The engage levers 35*a* and 35*b* are bent outward at the tip portions. The casters 80*a* and 80*b* support thereon the wagon body 70 in a freely movable manner. In FIG. 1 the reference numeral 13 indicates a door of the dishwashing machine 10, and the reference numeral 14 indicates tableware.

Figure 2:
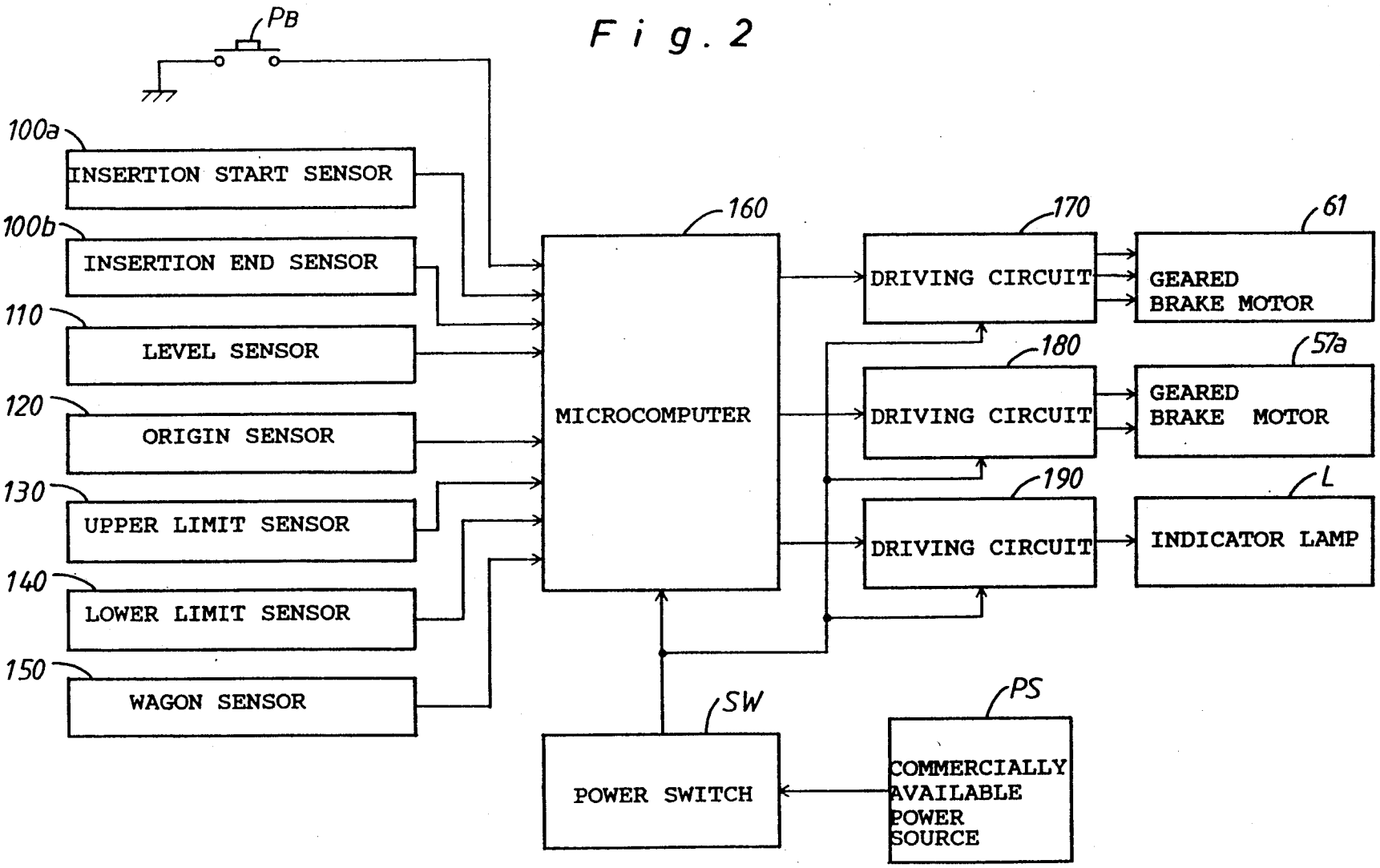
FIG. 2 is a block diagram of the dishwashing system.

The electric circuit configuration of the dishwashing system will be described with reference to FIG. 2. A power switch SW and an emergency stop switch PB are provided at their proper positions on the outer surface of the left side plate 40*a*. The power switch SW, when closed, supplies electric power to individual electric components of the dishwashing system from a commercially available electric power source PS. The emergency stop switch PB is in the form of a normally open type push button switch which generates an emergency stop signal when temporarily closed. An insertion start sensor 100*a* and an insertion end sensor 100*b* are respectively in the form of a normally open type microswitch. The insertion start sensor 100*a* is buried in the front end portion of the right side plate 53*b* of the elevator assembly 50 whereas the insertion end sensor 100*b* is buried in the rear portion of the right side plate 53*b*.

In this case, actuator rods of the insertion start sensor 100*a* and insertion end sensor 100*b* protrude from the inner surface of the right side plate 53*b* respectively. When the front end portion of the rack 12 is placed on the front end portions of the ramp 56 and both timing belts 57*i* and 57*l* to push the actuator rod of the insertion start sensor 100*a*, the insertion start sensor 100*a* is closed to generate an insertion start signal. When the front end portion of the rack 12 is placed on the rear end portions of the ramp 56 and both timing belts 57*i* and 57*l* to push the actuator rod of the insertion end sensor 100*b*, the insertion end sensor 100*b* is closed to generate an insertion end signal.

As shown in FIG. 1, a level sensor 110 comprises a normally open type proximity switch 111 and dog members 112 to 115. The proximity switch 11 is secured in a recess in the outer wall of the rear end portion of the right side plate 53*a* of the elevator assembly 50, with its vertical detection face protruding outward. The individual dog members 112, 113, 114 and 115 are attached to the support 31*a* below the storage shelves 76, 77, 78 and 79 of the wagon W by a predetermined interval. The dog member 112 is formed by bending a steel plate into a shape illustrated in FIG. 4. The dog member 112 has a base 112*a*, which is attached to the left wall of the support 31*a* by fastening a screw 112*c* through an elongated hole 112*b*. The elongated hole 112*b* has a long diameter vertically so as to adjust the vertical position of the dog member 112.

The dog member 112 has an extending portion 112*d* which extends forward from the base 112*a*. A to-be-detected portion 112*e* which bends in an L-shape rightward from the top edge of the extending portion 112*d* is to be detected by the proximity switch 111. In this case, detection by the proximity switch 111 begins and ends when the upper and lower end portions of the detection surface face the to-be-detected portion 112*e*, respectively. The remaining dog members 113, 114 and 115 have the same construction as that of the dog member 112.

When the upper end portion (or lower end portion) of the detection surface of the proximity switch 111 is maintained in the same level as the right end of the to-be-detected portion 112*e* of the dog member 112 or the right end of the to-be-detected portion of the dog member 113, 114 or 115, the proximity switch 111 is closed under a magnetic function to generate a level signal. When the proximity switch 111 comes outward off the lower end portion (or upper end portion) of the detection surface, the level signal disappears. A duration of generation of the level signal is set slightly longer than 10 (msec) in consideration of an elevation speed of the elevator assembly 50. In FIG. 4, the reference character 112*f* indicates a positioning portion of the dog member 112.

An origin sensor 120 has the same construction as that of the level sensor 110 and comprises a normally open type proximity switch 121 and a dog member 122 as shown in FIG. 1. The proximity switch 121 is secured in a recess in a outer wall of the front end portion of the left side plate 53*a* of the elevator assembly 50, with its vertical detection face protruding outwardly. The dog member 122 has the same construction as that of the dog member 112 and is attached to an intermediate portion of the left wall of the support 31*b*. A detection end of the to-be-detected end of this dog member 122 is positioned to face the detection surface of the proximity switch when the top wall 56*c* of the ramp 56 is slightly lower than the top surface 21 of the work table 20. When the detection surface of the proximity switch 121 faces the t-be-detected end of the dog member 122, the switch 121 is closed to generate an origin signal. A duration of generation of the origin signal is the same as that of the level signal from the level sensor 110.

An upper limit sensor 130 comprises the proximity switch 121 and a dog member 131 which has the same construction as that of the dog member 112 and is attached to an upper portion of the left wall of the support 31*b*. In this case, a to-be-detected end of the dog member 131 is positioned such that it may face the detection surface of the proximity switch 121 when the elevator assembly 50 rises to the upper limit position. Accordingly, the upper limit sensor 130 generates an upper limit signal in response to closing of the proximity switch 121 when the detection surface of the proximity switch 121 faces the to-be-detected end of the dog member 131. A lower limit sensor 140 comprises the proximity switch 121 and a dog member 141 which has the same construction as that of the dog member 112 and is attached to a lower portion of the left wall of the support 31*b*.

In this case, a to-be-detected end of the dog member 141 is positioned such that it may face the detection surface of the proximity switch 121 when the elevator assembly 50 moves down to the lower limit position. Accordingly, the lower limit sensor 140 generates a lower limit signal in response to closing of the proximity switch 121 when the detection surface of the proximity switch 121 faces the to-be-detected end of the dog member 141. A wagon sensor 150 comprises a normally open type microswitch and is buried in a lower end portion of the support 31*a* with its actuator rod protruding outward from a rear wall of the support 31*a*. When the supports 72 and 31*a* abut against each other as shown in FIG. 2, the wagon sensor 150 is closed to generate a wagon signal.

A microcomputer 160 executes a main control program and an interrupt control program in cooperation with the emergency stop switch PB and the individual sensors 100*a* to 150 in accordance with flow charts shown in FIGS. 5 to 9 and FIGS. 10A to 10C. During execution of the programs, the microcomputer 160 performs arithmetic operations necessary for controlling individual driving circuits 170, 180 and 190 connected to the individual geared brake motors 57*a* and 61 and an indicator lamp L. The main control program and interrupt control program are stored in advance in a ROM of the microcomputer 160. Operation of the microcomputer 160 is realized based on a constant voltage which is generated from a rectifying and constant voltage circuit within the microcomputer 160. The rectifying and constant voltage circuit generates the constant voltage when received electric power from the commercially available power source PS through the power switch SW. Interruption of the interrupt control program is started at every time when a timer incorporated within the microcomputer 160 finishes measuring a predetermined time (e.g., 10 msec).

The driving circuit 170 selectively releases the braking state of the geared brake motor 61 to rotate the motor 61 forward or reverse in accordance with electric power from the commercially available power source PS under control of the microcomputer 160. The forward rotation (or reverse rotation) of the geared brake motor 61 corresponds to the rising (or lowering) of the elevator assembly 50. The driving circuit 180 selectively releases the braking state of the geared brake motor 57*a* to rotate the motor 57*a* in accordance with electric power from the commercially available power source PS under control of the microcomputer 160. The driving circuit 190 selectively turns on the indicator lamp L in accordance with electric power from the commercially available power source PS under control of the microcomputer 160. The indicator lamp L is attached on the top wall of the frame 30.

Figure 5:
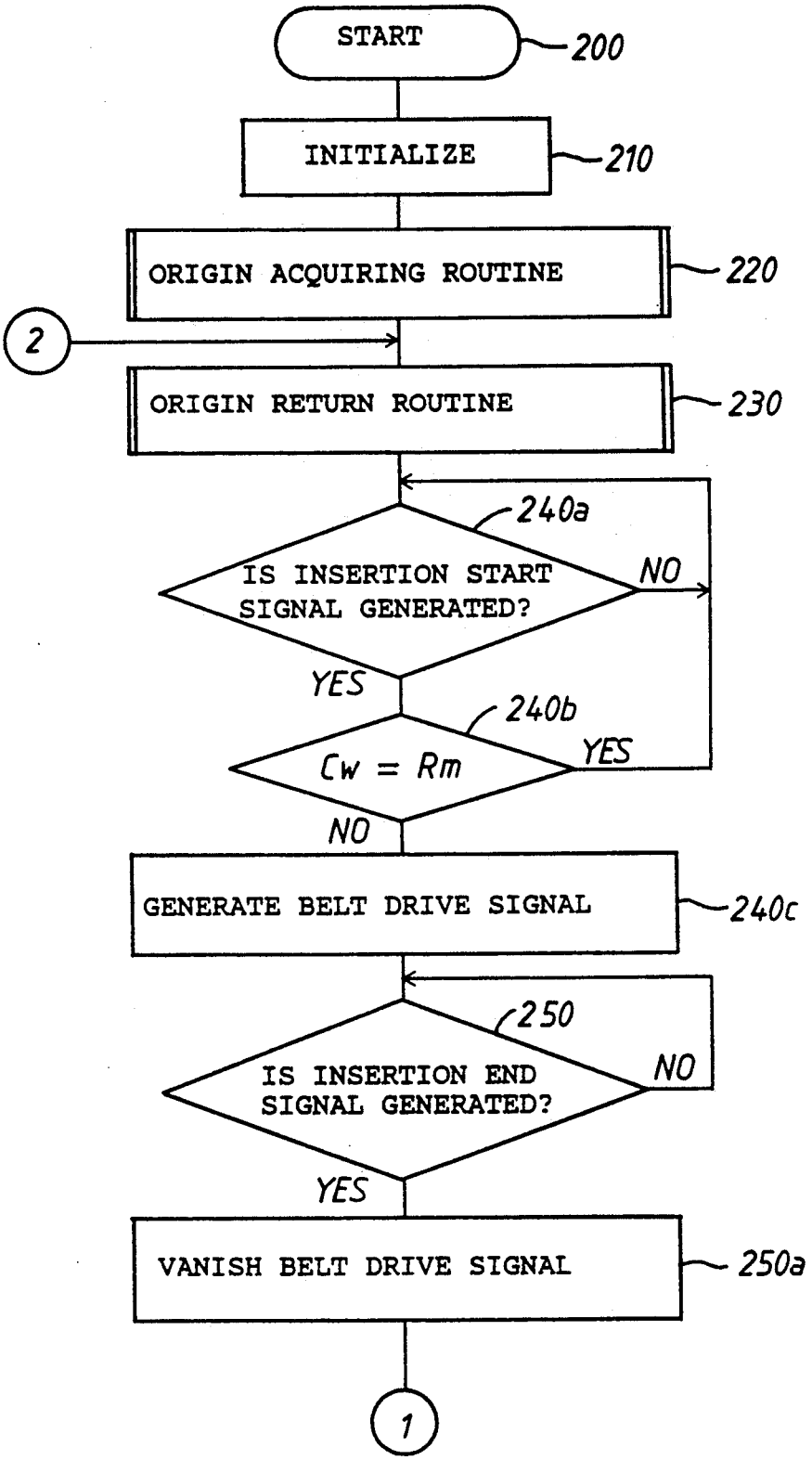
FIGS. 5 and 6 indicate a flow chart illustrating a main control program to be executed by a microcomputer in FIG. 2.

In operation, when the power switch SW is actuated, the microcomputer 160 starts execution of the main control program in step 200 in accordance with the flow chart in FIG. 5 to perform initialization in step 210. At the same time as operation of the microcomputer 160, the timer is reset to start measuring the aforementioned predetermined time. After the initialization, the microcomputer 160 starts executing an origin acquiring routine 220 (see FIGS. 5, 7A and 7B) in step 220*a*.

If the upper limit sensor 130 has not generated any upper limit signal at this stage, the microcomputer 160 determines "NO" in step 221 and disables interruption and sets an up flag Fu=0 in step 221*a*. The microcomputer 160 then generates in step 221*b* an up drive signal for raising the elevator assembly 50 in response to which the geared brake motor 61 is driven by the driving circuit 170 to rotate in a forward direction under its release of braking so as to move the elevator assembly 50 upwardly by way of the chain 64.

When the upper limit sensor 130 generates an upper limit signal later, the microcomputer 160 determines "YES" in step 221, enables interruption and resets Fd=0 and Fu=0, clears position count data to Cp=0, sets storage count data to Cw=1 and sets a down flag to FL=1 in steps 221*c* to 221*h*. Since neither an origin signal from the origin sensor 120 nor an lower limit signal from the lower limit sensor 140 is generated at this stage, the microcomputer 160 sequentially determines "NO" in steps 222 and 223. When the timer completes measuring the time under this condition, the microcomputer 160 starts executing the interrupt control program in step 300*a* in accordance with the flow chart shown in FIGS. 10A to 10C.

If at this time the wagon sensor 150 has generated a wagon signal and the emergency stop switch PB has not generated an emergency stop signal, the microcomputer 160 sequentially determines "YES" and "NO" in steps 310 and 320, determines "NO" in step 330 based on Fu=0 (see step 221*f*) and vanishes the up drive signal in step 330*a*. In response to vanishing of the up drive signal, the geared brake motor 61 stops under its braking operation to stop and maintains the elevator assembly 50 at the upper limit position by way of the chain 64. As the time measurement has been completed, the timer is reset again to start measuring the time as described above and likewise repeatedly measures the time thereafter.

Then, the microcomputer 160 determines "YES" in the step 340 based on FL=1 in step 221*h*, and generates a down drive signal for moving the elevator assembly 50 downward in step 340*a*. In response to the down drive signal, the geared brake motor 61 is driven by the driving circuit 170 to rotate in the reverse direction under its release of braking so as to lower the elevator assembly 50. At this time, when both the level sensor flag Fd and origin sensor flag Fo are reset to "0" in step 210 and a level signal is not generated from the level sensor 110, the microcomputer 160 sequentially determines "NO" in steps 350, 350*a*, 370 and 380*a* (see FIGS. 10B and 10C) and terminates execution of the interrupt control program in step 300*b*.

When the level sensor 110 generates a level signal in association with the dog member 112 and the interrupt control program proceeds to step 350*a* again as described above, the microcomputer 160 determines "YES," sets the level sensor flag Fd=1 in step 351, determines "YES" in step 360*a* based on generation of the down drive signal in step 340*a*, adds "1" to the position count data Cp to update it to Cp=1 in step 361, and determines "NO" in steps 370 and 380*a*. When the interrupt control program goes to step 350 according to vanishing of the level signal from the level sensor 110, the microcomputer 160 determines "YES" based on Fd=1 in step 351, determines "YES" in step 350*b*, resets Fd=0 in step 352 and performs addition/renewal to yield Cp=2 in step 361.

When the level sensor 110 generates a level signal in association with the dog member 113 and the interrupt control program proceeds to step 350 in the same manner as described above, the microcomputer 160 determines "NO" based on Fd=0 in step 352, determines "YES" in step 350*a* in association with the level signal, sets Fd=1 in step 351 and performs addition/renewal to yield Cp=3 in step 361. When the level signal from the level sensor 110 in association with the dog member 113 disappears and the interrupt control program goes to step 350, the microcomputer 160 determines "YES" in step 351 based on Fd=1, determines "YES" in step 350*b*, resets Fd=0 in step 352 and performs addition/renewal to yield Cp=4 in step 361.

Figure 10A:
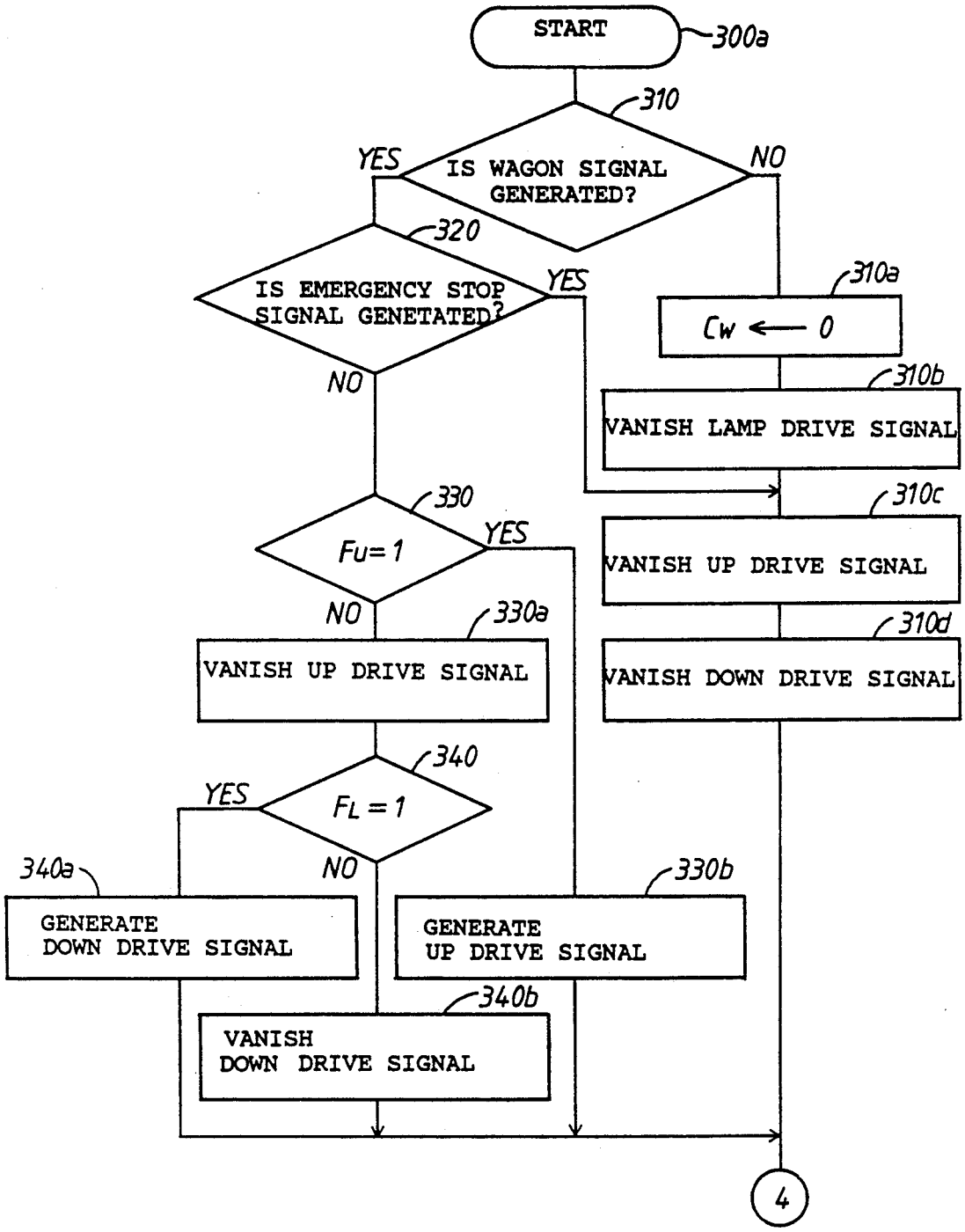
FIGS. 10A to 10C indicate a flow chart illustrating an interrupt control program to be executed by the microcomputer in FIG. 2.
Figure 10B:
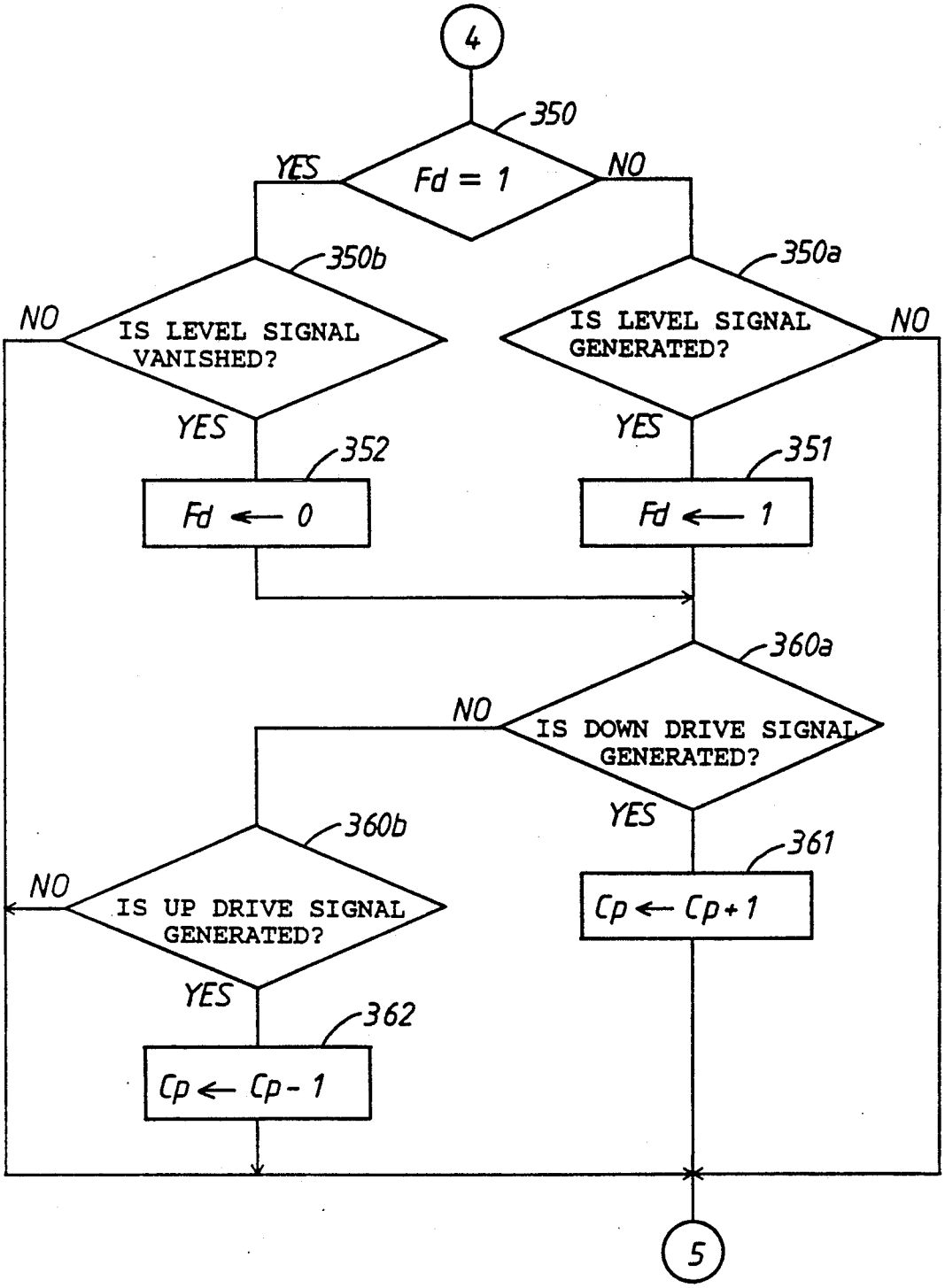
Figure 10C:
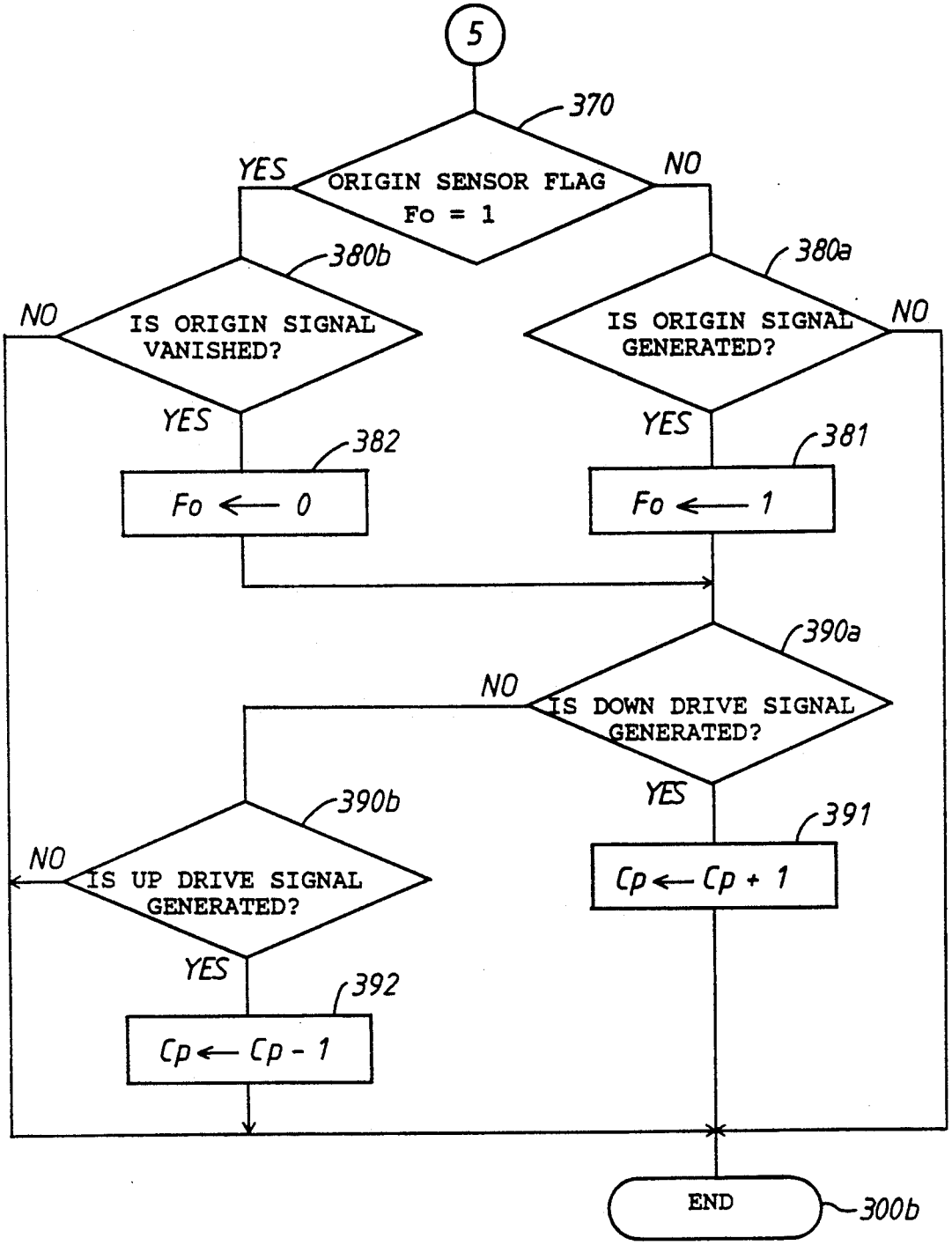

When the origin sensor 120 generates an origin signal and the interrupt control program proceeds to step 370 in FIG. 10C, the microcomputer 160 determines "NO" based on Fd=0, determines "YES" in step 380*a* based on the origin signal, sets Fo=1 in step 381 and performs addition and renewal to yield Cp=5 in step 391. Then, the microcomputer 160 determines "YES" in step 222 in FIG. 7B due to generation of the origin signal, sets origin register data Ro to Cp (=5) in step 222a and determines "NO" in step 223. When the origin signal from the origin sensor 120 vanishes and the interrupt control program proceeds to step 370 later, the microcomputer 160 determines "YES" based on Fo=1 in step 381, determines "YES" in step 380b due to disappearance of the origin signal, resets Fo=0 in step 382 and performs addition/renewal to yield Cp=6 in step 391.

While the level sensor 110 sequentially repeats generation and vanishing of a level signal in association with each of the dog members 114 and 115, the arithmetic operations in steps 350 and 361 in FIG. 10B are repeated as in the case where the level sensor 110 causes generation and vanishing of a level signal in association with the dog member 113. Accordingly, the microcomputer 160 sequentially performs addition/renewal to yield Cp=7 and Cp=8 in step 361 in association with the dog member 114 and sequentially performs addition/renewal to yield Cp=9 and Cp=10 in association with the dog member 115.

Figure 7A:
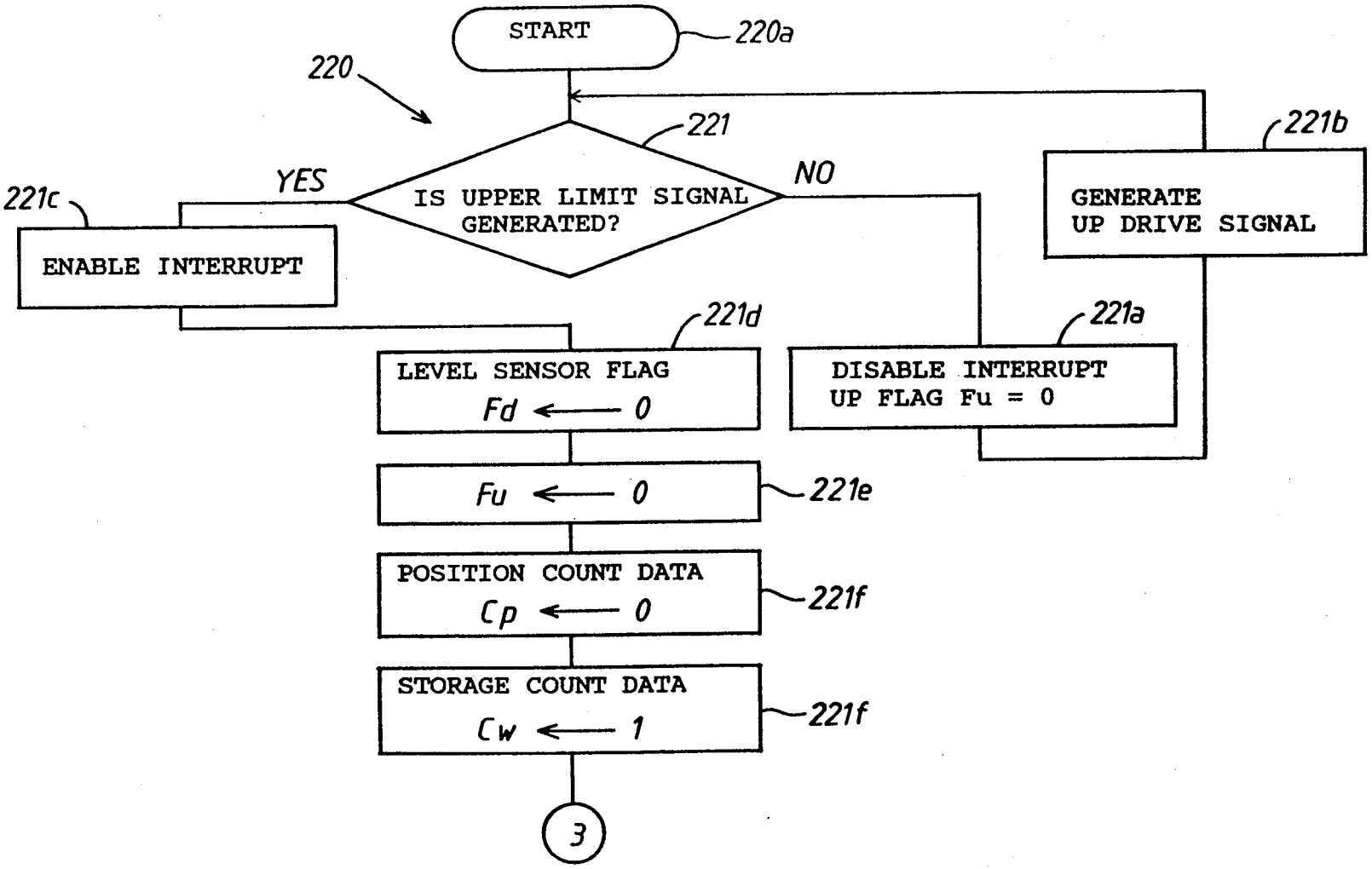
FIGS. 7A and 7B indicate a detailed flow chart of an origin acquiring routine shown in FIG. 5.
Figure 7B:
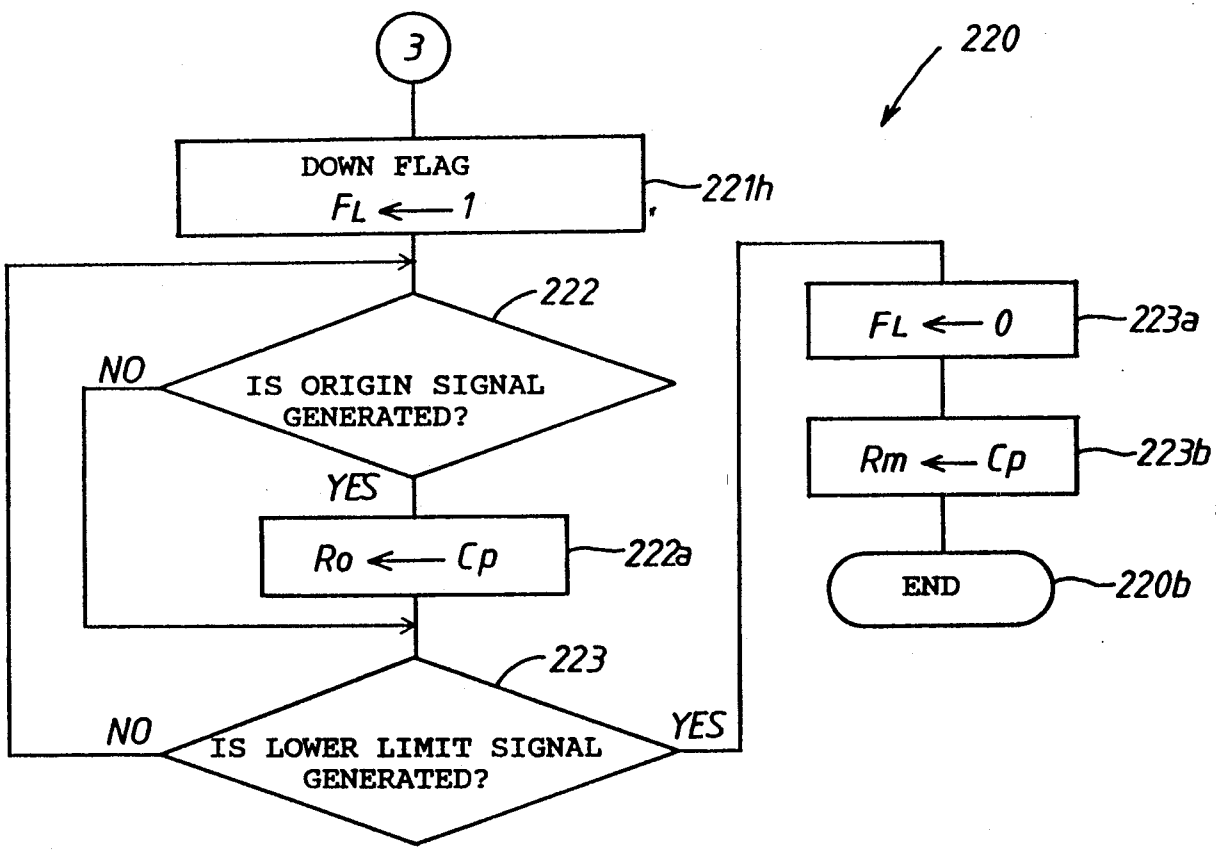

When the lower limit sensor 140 generates a lower limit signal, the microcomputer 160 determines "YES" in step 223 in FIG. 7B, and resets FL=0 and also sets maximum register data Rm to Cp=10 in steps 223a and 223b. When the interrupt control program goes to step 340 thereafter, the microcomputer 160 determines "NO" based on FL=0 in step 223a and stops the geared brake motor 61 to stop the elevator assembly 50 at the lower limit position because of disappearance of the down drive signal in step 340b.

After operation in the above origin acquiring routine 220, the microcomputer 160 starts executing an origin return routine 230 (see FIGS. 5 and 8) in step 230a, sequentially determines "NO" and "YES" in steps 231 and 232 based on Cp=10>Ro=5 to set the up flag Fu=1. When the interrupt control program proceeds to step 330 in FIG. 10A in the same manner as previously described under the above condition, the microcomputer 160 determines "YES" based on Fu=1 to generate an up drive signal in step 330b in response to which the geared brake motor 61 is driven by the driving circuit 170 under its release of braking to move the elevator assembly 50 upwardly.

When the level sensor 110 generates an level signal in association with the dog member 115 and the interrupt control program proceeds to step 350 under the above situation, the microcomputer 160 determines "NO," determines "YES" in step 350a, sets Fd=1 in step 351, sequentially determines "NO" and "YES" in steps 360a and 360b based on generation of the up drive signal in step 330b, and decrements the position count data Cp by "1" to update it to Cp=9 in step 362. When the level signal disappears and the interrupt control program goes to step 350, the microcomputer 160 determines "YES" based on Fd=1, determines "YES" in step 350b based on disappearance of the level signal, resets Fd=0 in step 352 and performs updating to yield Cp=8 in step 362.

When the level sensor 110 generates a level signal in association with the dog member 114 and the interrupt control program proceeds to step 350 under the above situation, the microcomputer 160 determines "NO," determines "YES" in step 350a, sets Fd=1 in step 351 and performs updating to yield Cp=7 in step 362. When the level signal disappears and the interrupt control program goes to step 350, the microcomputer 160 determines "YES" based on Fd=1, determines "YES" in step 350b based on disappearance of the level signal, resets Fd=0 in step 352 and performs updating to yield Cp=6 in step 362.

When the origin sensor 120 generates an origin signal and the interrupt control program proceeds to step 340, the microcomputer 160 determines "NO" based on Fd=0 in step 352, determines "NO" in steps 350a and 370 based on generation of the origin signal and Fo=0, determines "YES" in step 380a, sets Fo=1 in step 381, determines "YES" in step 390b based on the up drive signal in step 330b, and performs updating to yield Cp=5 in step 391.

Figure 8:
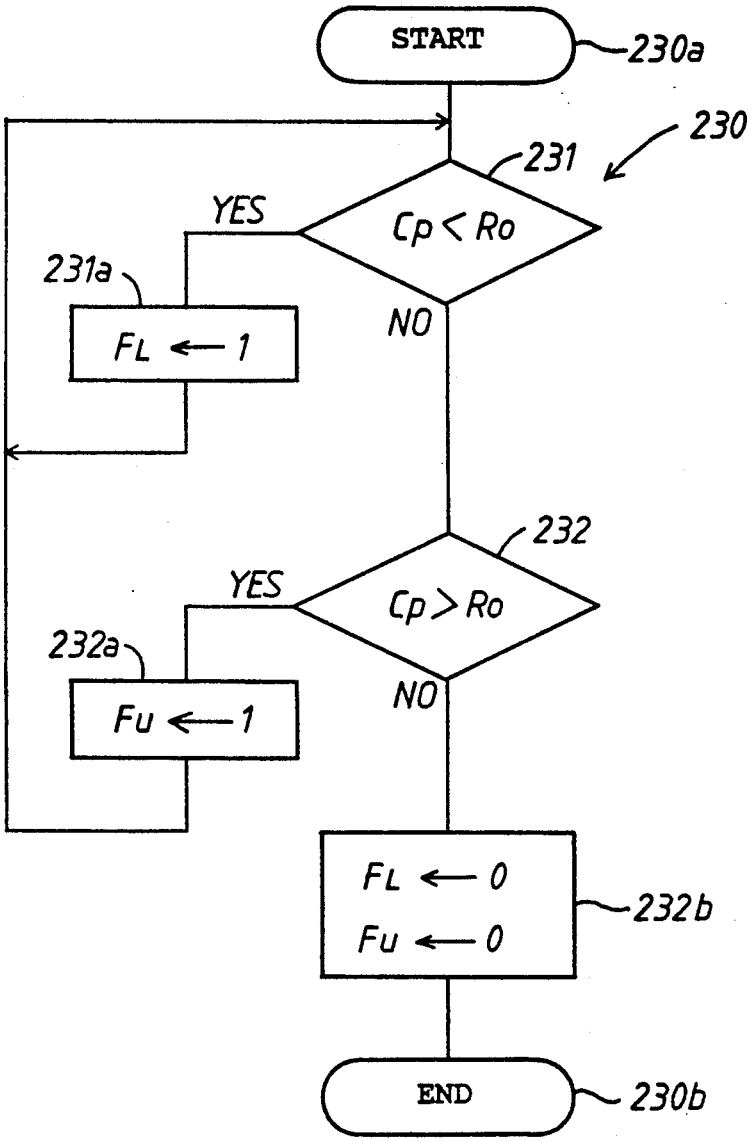
FIG. 8 shows a detailed flow chart of an origin return routine shown in FIG. 5.
Figure 9:
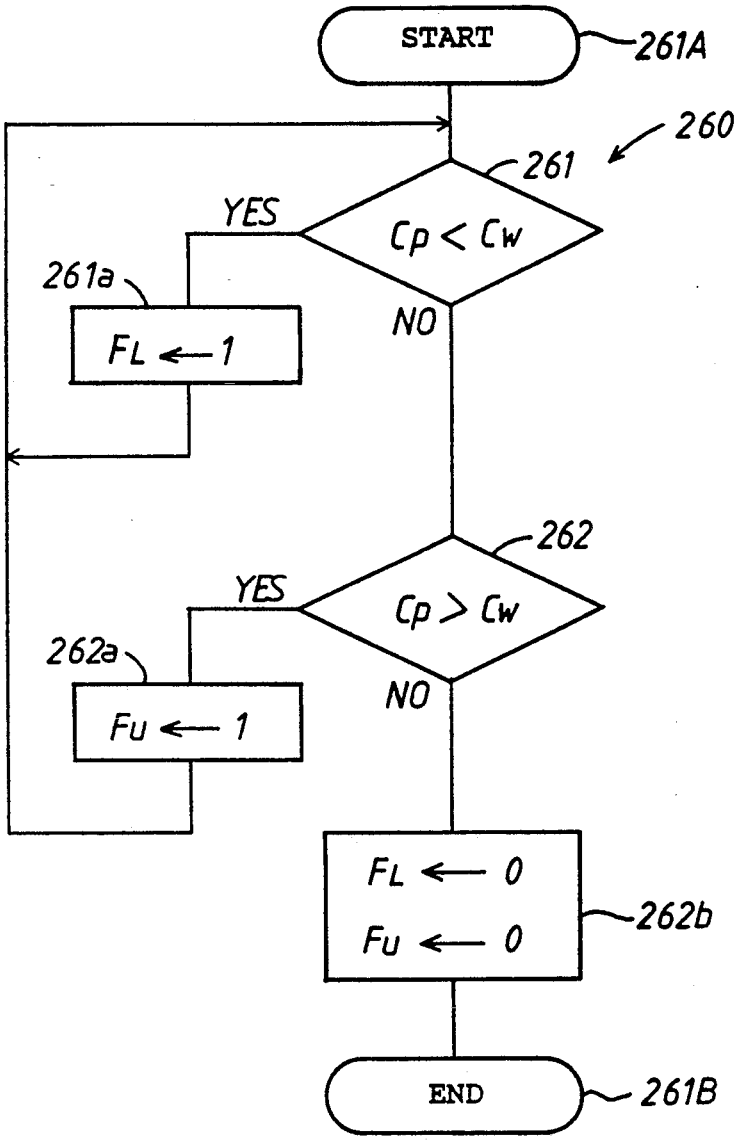
FIG. 9 depicts a detailed flow chart of a level moving routine shown in FIG. 6.

Then, the microcomputer 160 sequentially determines "NO" in steps 231 and 232 in FIG. 8 based on Cp=Ro=5, and resets FL=0 and Fu=0 in step 232b. When the interrupt control program proceeds to step 330 in FIG. 10A at this stage, the microcomputer 160 determines "NO" based on Fu=0 and vanishes the up drive signal in step 330a. As a result, the elevator assembly 50 is stopped and held at the position corresponding to the dog member 122 as the geared brake motor 61 is stopped by its braking operation.

When the decision in step 231 becomes "YES" in the origin return routine 230, the microcomputer 160 sets FL=1 in step 231a. Then, the microcomputer 160 determines "YES" in step 340 of the interrupt control program and advances the interrupt control program to and after step 340a to lower the elevator assembly 50. When the decision in step 232 of FIG. 8 becomes "NO" later, the microcomputer 160 sets FL=0 and Fu=0 in step 232b to stop and maintain the elevator assembly 50 at the position corresponding to the dog member 122 in the same manner as described above.

When completed washing and rinsing of tableware 14 in the dishwashing machine 10 at this stage, the door 13 of the dishwashing machine 10 is opened upward, and the rack 12 retaining thereon the tableware 14 is to be moved on the top 21 of the work table 20. Then, the rack 12 is inserted into the elevator assembly 50 with its front end portion placed on the top 56c of the ramp 56 and the front end portions of the timing belts 57i and 57l. At this time, the elevator assembly 50 is maintained at the position corresponding to the dog member 122 as described above. Thus, the tops of the timing belts 57i and 57l are slightly higher than the top 21 of the work table 20. Therefore, the front end portion of the rack 12 may easily be placed on the timing belts 57i and 57l.

When the insertion start sensor 100a generates an insertion start signal in response to the insertion, the microcomputer 160 determines "YES" in step 240a in FIG. 5, determines "NO" in step 240b based on the storage count data Cw=1 (see step 221g in FIG. 7A)<the maximum value Cwm. Then, the microcomputer 160 generates a belt drive signal for the timing belt mechanism 57 in step 240c. In response to the belt drive signal, the geared brake motor 57a rotates under its release of braking to rotate the timing belts 57i and 57l counterclockwise in FIG. 3 by way of the chain 57c as shown in FIG. 3. The rack 12 is therefore pulled into the elevator assembly 50 by both the timing belts 57i and 57l.

When the insertion end sensor 100b generates an insertion end signal upon completion of insertion of the rack 12 into the elevator assembly 50, the microcomputer 160 determines "YES" in step 250 to vanish the belt drive signal in step 250a. In response to vanishing of the belt drive signal, the geared brake motor 57a is stopped by its braking operation to stop the timing belts 57i and 57l.

Then, the microcomputer 160 starts executing a level moving routine 260 (see FIGS. 6 and 9) in step 260a, determines "NO" in step 261 based on Cp=5>Cw=1 and determines "YES" in step 262 on a basis of Cp>Cw to set Fu=1 in step 262a. When the interrupt control program proceeds to step 330, the microcomputer 160 determines "YES" based on Fu=1 to generate an up drive signal in step 330b in response to which the elevator assembly 50 is driven by the geared brake motor 61 and moved upward with the rack 12 placed thereon.

When the origin signal from the origin sensor 120 disappears accordingly, the microcomputer 160 determines "YES" in step 370 based on Fo=1, determines "YES" in step 380b due to disappearance of the origin signal, resets Fo=0 in step 382, sequentially determines "NO" and "YES" in steps 390a and 390b, and performs updating to yield Cp=4 in step 391. When the level sensor 110 generates a level signal in association with the dog member 113 and the interrupt control program proceeds to step 350, the microcomputer 160 determines "NO" based on Fd=0, determines "YES" in step 350a based on the level signal, sets Fd=1 in step 351, and performs updating to yield Cp=3 in step 362. When the level signal from the level sensor 110 related to the dog member 113 disappears and the interrupt control program goes to step 350, the microcomputer 160 determines "YES" based on Fd=1, determines "YES" in step 350b, resets Fd=0 in step 352, and performs updating to yield Cp=2 in step 362.

When the level sensor 110 then generates a level signal in association with the dog member 112 and the interrupt control program proceeds to step 350, the microcomputer 160 determines "NO" based on Fd=0, determines "YES" in step 350a, sets Fd=1 in step 351, and performs updating to yield Cp=1 in step 362. Consequently, the microcomputer 160 sequentially determines "NO" in steps 261 and 262 based on Cp=1 and resets FL=0 and Fu=0 in step 262b.

When the interrupt control program proceeds to step 330, the microcomputer 160 determines "NO" based on Fu=0 and stops the geared brake motor 61 by vanishing the up drive signal in step 330a. Consequently, the elevator assembly 50 stops with the back end portion of the top 56c of the ramp 56 facing the end portion of the storage shelf 76 of the wagon W. When the level signal from the level sensor 110 associated with the dog member 112 disappears before the stopping, the microcomputer 160 determines "YES" in step 350b, reset Fd=0 in step 352, and determines "YES" in step 360b owing to disappearance of the up drive signal in step 330a.

Figure 6:
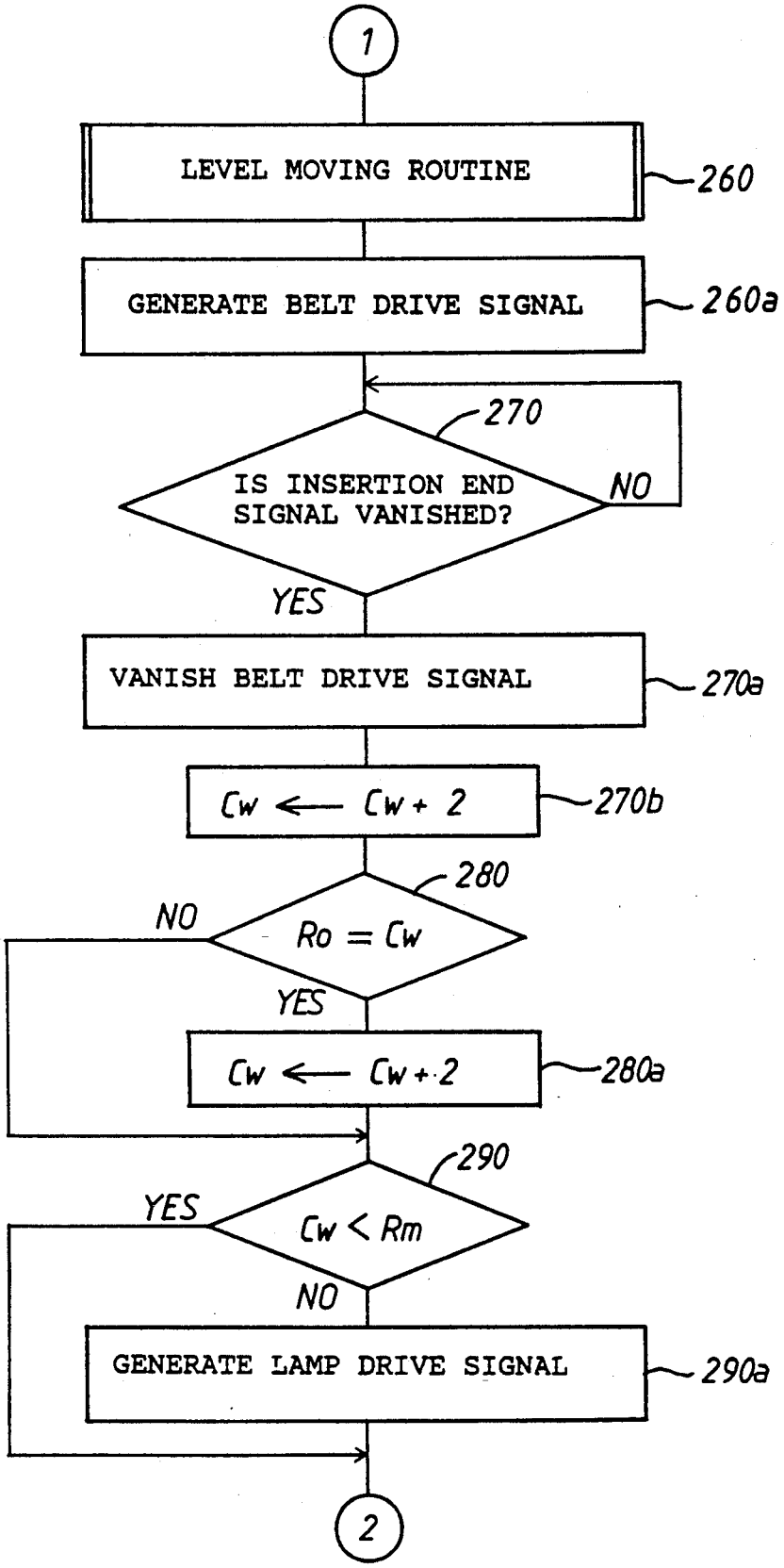

When completed the arithmetic operation in the level moving routine 260, the microcomputer 160 generates a belt drive signal in step 260a of FIG. 6. In response to the belt drive signal, the geared brake motor 57a drives both the timing belts 57i and 57l in cooperation with the driving circuit 180 to move the rack 12 onto the storage shelf 76. When the insertion end signal from the insertion end sensor 100b vanishes, the microcomputer 160 determines "YES" in step 270, vanishes the belt drive signal in step 270a to stop the geared brake motor 57a, thereby stopping the timing belts 57i and 57l.

Then, in step 270b the microcomputer 160 adds "2" to Cw=1 in step 221g, updating it to Cw=3. The microcomputer 160 determines "NO" in step 280 based on Ro=5=Cw=3 and determines "YES" in step 290 on a basis of Cw<Rm to return the main control program to the origin return routine 230. Consequently, the microcomputer 160 determines "YES" in step 231 on a basis of Cp=1<Ro=5 in set FL=1 in step 231a. Then, the microcomputer 160 determines "NO" in step 330 of FIG. 10A on a basis of Fu=0 and determines "YES" in step 340 based on FL=1 to generate a down drive signal in step 340a in response to which the geared brake motor 61 lowers the elevator assembly 50. Thereafter, the level sensor 110 repeats generation and vanishing of a level signal in association with each of the dog members 112 and 113, and execution of the flow chart in FIG. 10B is repeated in the same manner as described above to perform addition/renewal until Cp=4 in step 361.

When the origin sensor 120 produces an origin signal, the microcomputer 160 determines "YES" in step 380a of FIG. 10C, sets Fo=1 in step 381, determines "YES" in step 390a and performs addition/renewal to yield Cp=5 in step 391. Then, the microcomputer 160 determines "NO" in steps 231 and 232 of FIG. 8 on a basis of Cp=Ro=5 to reset FL=0 and Fu=0 in step 232b. Then, the microcomputer 160 determines "NO" in step 340 based on Fl=0 and vanishes the down drive signal in step 340b to stop the geared brake motor 61, returning the elevator assembly 50 to the position of the dog member 122.

When at this stage a rack which holds thereon tableware newly washed and rinsed in the dishwashing machine 10 is inserted into the elevator assembly 50 at its front end portion over both the timing belts 57i and 57l of the elevator assembly 50, as in the case of the rack 12, the microcomputer 160 performs arithmetic operations in steps 240a to 250a during which the rack is fully inserted into the elevator assembly 50 as done in the case of the rack 12, thus completing the job. When the main control program proceeds to execution of the level moving routine 260, the microcomputer 160 performs the loop processing of the individual steps 261, 262 and 262a based on Cp=5>Cw=3. Furthermore, the microcomputer 160 performs arithmetic operations in the individual steps 330 and 330b of FIG. 10A during which the elevator assembly 50 is moved in its upward direction.

When the level sensor 110 later performs generation and vanishing of a level signal in association with the dog member 113, the microcomputer 160 performs the arithmetic operation in the same manner as described above according to the flow chart of FIG. 10B to repeat subtraction and renewal until Cp=3 in step 362. Then, the microcomputer 160 determines "NO" in steps 261 and 262 of FIG. 9 based on Cp=Cw=3, resets FL=0 and Fu=0 in step 262b, determines "NO" in step 340 of FIG. 10A to perform the arithmetic operation in step 340b during which the elevator assembly 50 is stopped with the top of the ramp 56 faced to the storage shelf 77 of the wagon W.

Then, the microcomputer 160 performs the arithmetic operations in individual steps 260a to 270a of FIG. 6 during which the above-mentioned rack is stored onto the storage shelf 77 in substantially the same manner as done for the rack 12. Thereafter, the microcomputer 160 performs addition/renewal to yield Cw=5 in step 270b, determines "YES" in step 280 based on Ro=Cw, performs addition/renewal to yield Cw=7 and determines "YES" in step 290. When storage of the rack onto the storage shelf 77 is completed in this manner, the microcomputer 160 performs execution of the origin return routine 230, as previously described, thereby to return the elevator assembly 50 to the position of the dog member 122. Then, the microcomputer 160 repeats addition/renewal until Cp=5 in step 361 as described above.

When at this stage the rack holding thereon tableware washed and rinsed newly in the dishwashing machine 10 is inserted into the elevator assembly 50 in the same manner as done for the rack 12, the microcomputer 160 performs the arithmetic operations in the individual steps 240*a* to 250*a* during which insertion of the rack into the elevator assembly 50 is ended. When the main control program proceeds to the level moving routine 260, the microcomputer 160 determines "YES" in step 261 on a basis of Cp=5<Cw=7 to set FL=1 in step 261*a*. Furthermore, the elevator assembly 50 is moved downward through the arithmetic operations of the microcomputer 160 in the individual steps 340 and 340*a* of FIG. 11.

When the origin signal from the origin sensor 120 disappears, the microcomputer 160 performs addition/renewal to yield Cp=6 in step 391 in accordance with the execution of the flow chart of FIG. 10C. When the level sensor 110 generates a level signal in association with the dog member 114, the microcomputer 160 performs addition/renewal to yield Cp=7 in step 361 through the arithmetic operation according to the flow chart of FIG. 10B. Then, the microcomputer 160 determines "NO" in steps 261 and 262 of FIG. 9 based on Cp=Cw=7, resets FL=0 and Fu=0 in step 262*b*, determines "NO" in step 340 of FIG. 10A during which the elevator assembly 50 stops with the top of the ramp 56 faced to the storage shelf 78 of the wagon.

Then, the above-mentioned rack is stored onto the storage shelf 78 in substantially the same manner as done for the rack 12, through the arithmetic operations of the microcomputer 160 in individual steps 260*a* to 270*a* of FIG. 6. Thereafter, the microcomputer 160 performs addition and renewal to yield Cw=9 in step 270*b* and determines "NO" in steps 280 and 290. When storage of the rack onto the storage shelf 78 is completed in this manner, the elevator assembly 50 is returned to the position of the dog member 122 and the subtraction/renewal is repeated until Cp=5 in step 362 through execution of microcomputer 160 in the origin return routine 230 as described above.

When at this stage a rack holding thereon tableware washed and rinsed newly in the dishwashing machine 10 is inserted into the elevator assembly 50 in the same manner as done for the rack 12, insertion of the rack into the elevator assembly 50 is ended through the arithmetic operations of the microcomputer 160 in the individual steps 240*a* to 250*a* as done in the case of the rack 12. Then, the microcomputer 160 repeats the loop processing of steps 261 and 261*a* based on Cp=5<Cw=9, and the elevator assembly 50 is moved downward through the arithmetic operations in the individual steps 340 and 340*a* of FIG. 10A.

When disappearance of an origin signal from the origin sensor 120, generation and disappearance of a level signal from the level sensor 110 associated with the dog member 114 and generation of a level signal association with the dog member 115 are realized in sequence, the microcomputer 160 performs addition/renewal to yield Cp=6 in step 391 of FIG. 10C and repeats the addition/renewal until Cp=9 in step 361 of FIG. 10B. Then, the microcomputer 160 determines "NO" in steps 261 and 262 of FIG. 9 based on Cp=Cw=9, resets FL=0 and Fu=0 in step 262*b*. The elevator assembly 50 is stopped with the top of the ramp 56 faced to the storage shelf 79 of the wagon W, through the arithmetic operation of the microcomputer 160 up to step 340*b*.

Then, storing of the rack onto the storage shelf 79 is done through the arithmetic operations of the microcomputer 160 in steps 260*a* to 270*a* of FIG. 6 in the same manner as done for the rack 12. Thereafter, the microcomputer 160 performs addition/renewal to yield Cw=11 in step 270*b*, determines "NO" in steps 280 and 290 and generates a lamp drive signal in step 290*a*, and the driving circuit 190 turns on the indicator lamp L. This provides visual confirmation of storage of the whole racks into the wagon W.

When the wagon W is detached from the elevator E against the engage levers 35*a* and 35*b* at this stage, the wagon W may be carried away to the proper location with the individual racks stored onto the respective storage shelves. In this instance, the wagon sensor 150 vanishes the wagon signal. Thus, the microcomputer 160 determines "NO" in step 310 of FIG. 10A, clears Cw to Cw=0 in steps 310*a* to 310*d*, vanishes the lamp drive signal to turn off the indicator lamp L, and vanishes the up drive signal and down drive signal. When the emergency stop switch PB generates an emergency stop signal during generation of the wagon signal from the wagon sensor 150, the microcomputer 160 determines "YES" in step 320 of FIG. 10A to perform the arithmetic operations in steps 310*c* and 310*d* during which the elevator assembly 50 is stopped immediately.

As described above, during execution of the origin acquiring routine 220 and interrupt control program (see FIGS. 7A, 7B and 10A to 10C), the elevator assembly 50 is moved from the upper limit position to the lower limit position. During the lowering process of the elevator assembly 50, values of the position count data Cp corresponding to the mounting positions of the individual dog members 112, 113, 122, 114 and 115 are specified, and the storage count data Cw is specified as "1" in the initialization. During execution of the origin return routine 230 (see FIG. 8) and interrupt control program, the elevator assembly 50 is then returned to the position of the dog member 122 (i.e., the origin). Therefore, the arithmetic operation in and after step 240*a* (see FIG. 5) of the main control program is performed after initially specified the values of the individual position count data Cp and the storage count data Cw=1 and returned the elevator assembly 50 to the origin, as previously described. As a result, the preconditions for sequential storage of individual racks to the individual storage shelves of the wagon W may always be precisely established in advance.

After the rack 12 has been inserted into the elevator assembly 50 with the end portion of the rack 12 placed on the front end portions of the timing belts 57*i* and 57*l*, the individual racks are sequentially stored onto the respective storage shelves of the wagon W through execution of the remaining main control program and interrupt control program. Thus, storage of the racks into the wagon W may automatically be performed without overloading a worker. In this instance, such storage is wholly and automatically done after an insertion start signal has been generated from the insertion start sensor 100*a*. As a result, the working efficiency may be significantly improved even by a single worker. Furthermore, the level sensor 110, upper limit sensor 130 and lower limit sensor 140 are attached at their proximity switches to the elevator assembly 50 and attached at their dog members to the support 31*a* or 31*b*. Thus, the number of proximity switches required by these sensors may be minimized.

Figure 11:
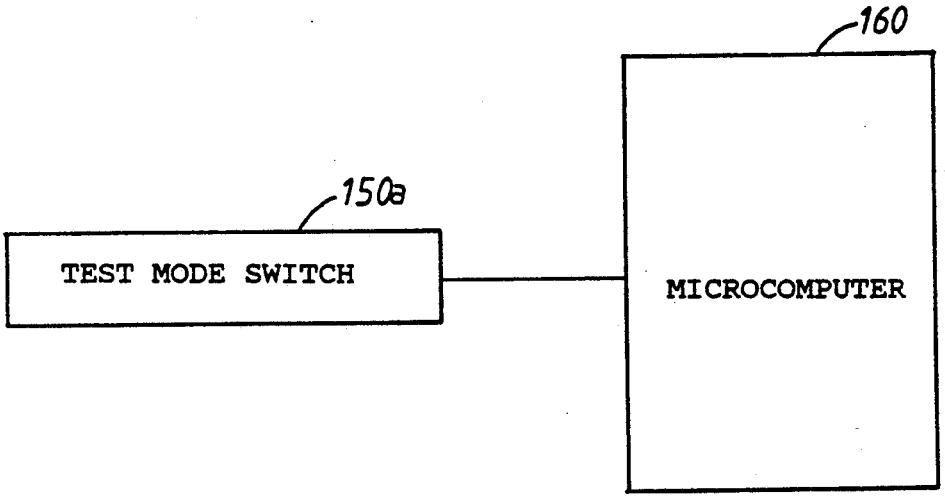
FIG. 11 is a partial block diagram illustrating a second embodiment of a dishwashing system in accordance with the present invention.

An explanation will now be given of a second embodiment of which the construction is characterized by the additional use of a test mode switch 150*a* as shown in FIG. 11 and of which the construction is also characterized by modifying the main control program described in the first preferred embodiment so as to partially alter the flow chart of FIG. 5 into a flow chart shown in FIGS. 12A and 12B. When the dishwashing system according to the present invention is tested, the test mode switch 150*a* is actuated to generate a test mode signal so as to apply it to the microcomputer 160. The other construction is the same as that of the first preferred embodiment.

Figure 12A:
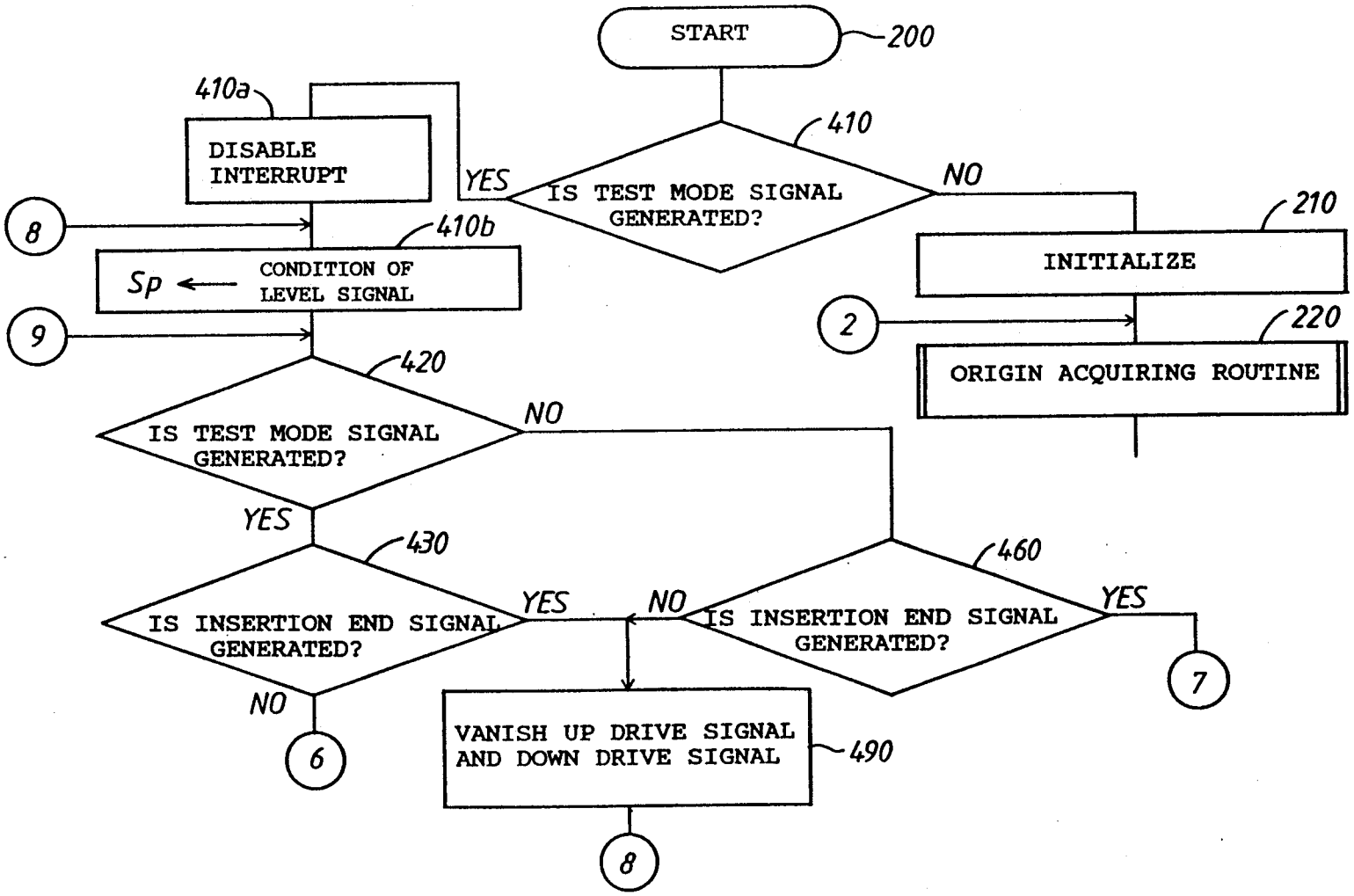
FIGS. 12A and 12B show a partial flow chart of the second embodiment.
Figure 12B:
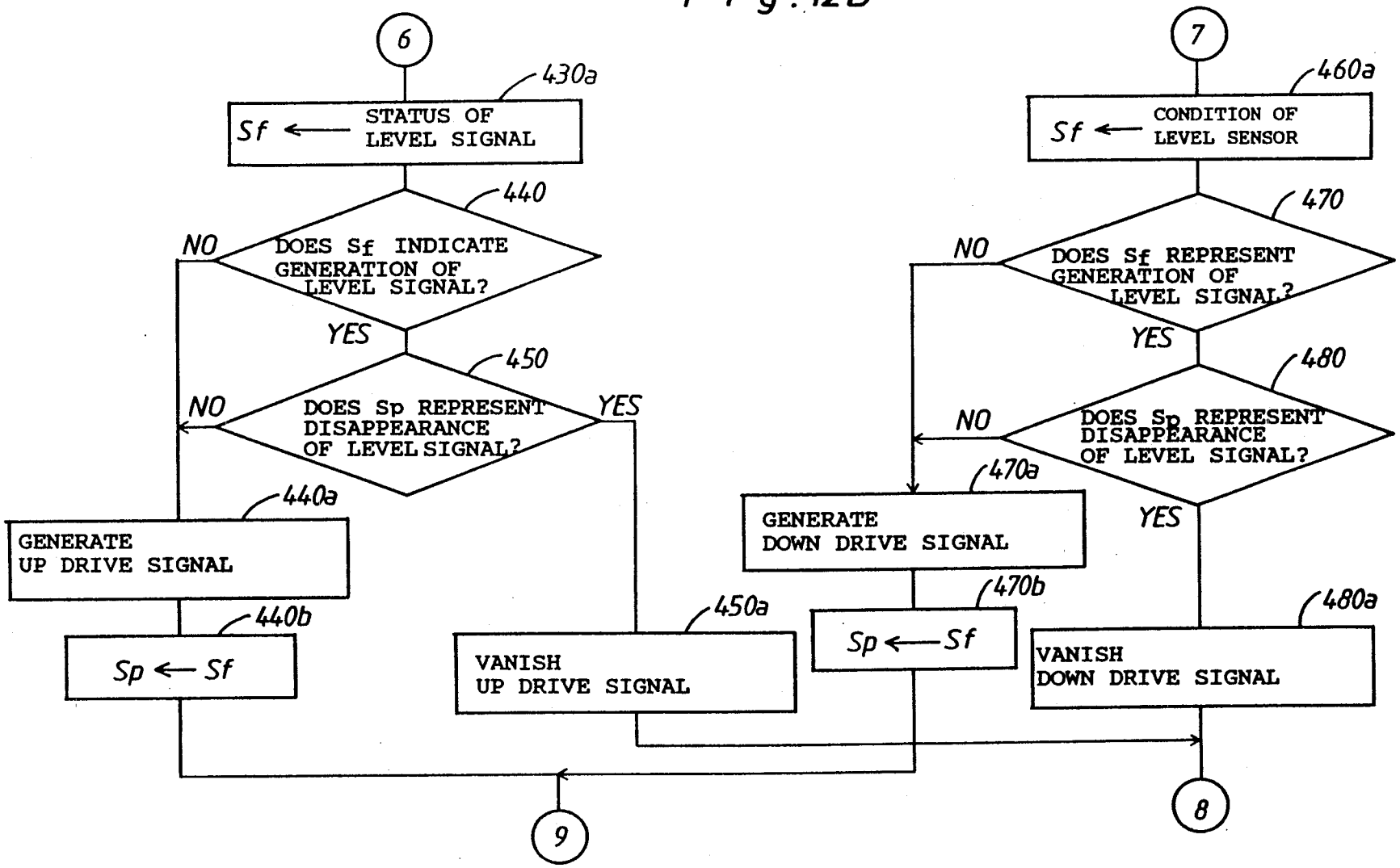

In operation, when the test mode switch 150*a* is actuated to generate a test mode signal upon actuation of the power switch SW, the microcomputer 160 starts execution of the main control program in step 200 in accordance with the flow chart of FIGS. 12A and 12B and determines "YES" in step 410 based on generation of the test mode signal. Then, the microcomputer 160 disables an interruption in step 410*a* and sets the actual condition (assumed to correspond to vanishing condition at this stage) of a level signal from the level sensor 110 into preceding data Sp in step 410*b*. If the insertion end sensor 100*b* does not generate any insertion end signal under generation of the test mode signal from the test mode switch 150*a*, the microcomputer 160 sequentially determines "YES" and "NO" in steps 420 and 430 and sets condition of the level signal from the level sensor 110 into the following data Sf.

In this instance, the following data Sf indicate the disappearing condition of the level signal, like the preceding data Sp. Thus, the microcomputer 160 determines "NO" in step 440 to generate in step 440*a* an up drive signal in response to which the elevator assembly 50 moves upward as described in the first preferred embodiment. After execution in step 440*a*, the microcomputer 160 updates the following data Sf obtained in step 430*a* into preceding data Sp. When the latest following data Sf in step 430*a* is set into data indicating generation of the level signal from the level sensor 110 in accordance with rising of the elevator assembly 50 during the loop processing of steps 430*a*, 440, 440*a* and 440*b*, the microcomputer 160 determines "YES" in step 440.

If the latest preceding data Sp obtained in step 440*b* indicates disappearance of the level signal at this stage, the microcomputer 160 determines "YES" in step 450 and the elevator assembly 50 is stopped in its rising due to disappearance of the up drive signal in step 450*a*. It is possible to visually observe whether or not the relative positions of the top surface of the ramp 56 and the corresponding shelf of the wagon W are proper in consideration of stop position of the elevator assembly 50. If the stop position of the elevator assembly 50 is improper, the position of the corresponding dog member of the level sensor 110 (e.g., position of the dog member 112 in the up-and-down direction) is subjected to fine adjustment by loosening a screw (e.g., screw 112*c*), and the screw is again tightened. Accordingly, the position of the dog member may accurately be adjusted.

If the insertion end sensor 100*b* has generated an insertion end signal in case of the decision "NO" in step 420, the microcomputer 160 determines "YES" in step 460, sets the actual condition (assumed vanishing condition) of a level signal from the level sensor 110 into the following data Sf in step 460*a* and determines "NO" in step 470 to generate a down drive signal in step 470*a*. In response to the down drive signal, the elevator assembly 50 moves downward as described in the first embodiment. The microcomputer 160 updates the following data Sf obtained in step 460*a* into preceding data Sp.

When the latest following data Sf in step 460*a* is set into data indicating generation of the level signal from the level sensor 110 in accordance with the downward movement of the elevator assembly 50 during the loop processing of steps 460*a*, 470, 470*a* and 470*b*, the microcomputer 160 determines "YES" in step 470. If the latest preceding data Sp obtained in step 470*b* indicates disappearance of the level signal at this stage, the microcomputer 160 determines "YES" in step 480, and the downward movement of the elevator assembly 50 is stopped by disappearance of the down drive signal in step 480*a*. It is therefore possible to visually observe whether or not the relative positions of the top surface of the ramp 56 and the corresponding storage shelf of the wagon W are proper in consideration of the stop position of the elevator assembly 50. If the stop position of the elevator assembly 50 is improper, the position of the corresponding dog member of the level sensor 110 (e.g., position of the dog member 112 in the up-and-down direction) is subjected to fine adjustment by loosening the screw (e.g., screw 112*c*), and the screw is again tightened. Accordingly, the position of the dog member may be accurately adjusted.

As described above, the test mode switch 150*a* and the insertion end sensor 100*b* are used to move up or down the elevator assembly 50 through the arithmetic operation according to the flow chart of FIGS. 12A and 12B thereby to immediately stop the elevator assembly 50 based on generation of the level signal of the associated dog member in the level sensor 110. Thus, it may be observed whether or not the positions of the individual dog members of the level sensor 110 are proper in accordance with the stop position of the elevator assembly 50. Accordingly, adjustment of the position of the dog members by the level sensor 110 may accurately and properly be done as previously described. If the determination is "YES" in step 430 or "NO" in step 460, the microcomputer 160 vanishes the up drive signal and the down drive signal in step 490. If the test mode switch 150*a* is not actuated at the time of actuation of the power switch SW, the microcomputer 160 determines "NO" in step 410 and performs the arithmetic operation in and after step 210 as previously in the first embodiment. The other operation and effect are the same as those in the first embodiment.

Figure 13:
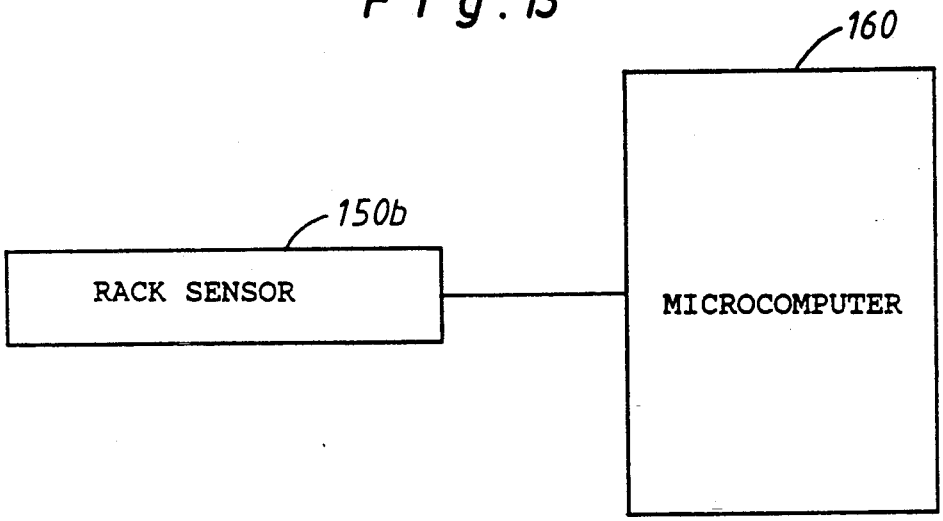
FIG. 13 is a partial block diagram illustrating a third embodiment of a dishwashing system in accordance with the present invention.
Figure 14:
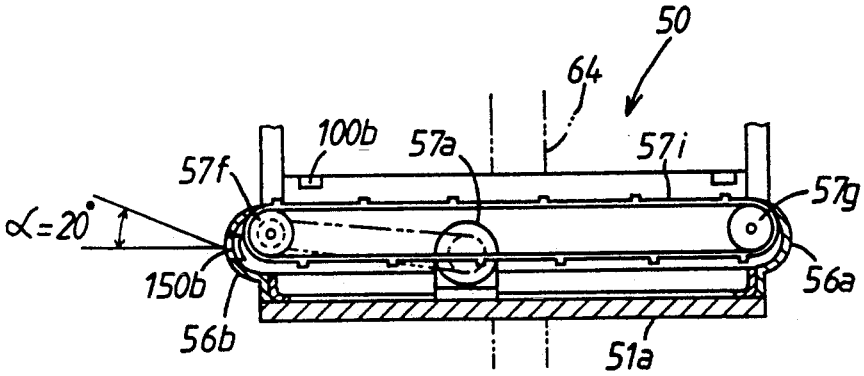
FIG. 14 is a diagram showing how a rack sensor is attached in the third embodiment.

A description will now be given of a third embodiment which is characterized in that a rack sensor 150*b* is additionally adopted as shown in FIG. 13 and in that the main control program described in the first embodiment is modified so as to alter partially the flow chart of FIG. 6 into a flow chart shown in FIG. 15. The rack sensor 150*b* is in the form of a photo reflector and is provided in the center portion of the front wall 56*a* of the ramp 56. The light axis of the rack sensor 150*b* is predetermined such that the light emitting/receiving face of the rack sensor 150*b* may face the rear end of the rack on the individual storage shelf of the wagon W at the angle of elevation $\alpha=20°$ (see FIG. 14). Thus, the rack sensor 150*b* emits light beam at the elevation angle 20° and receives light, reflected from the rear end of the rack, to generate a rack signal. The other construction is the same as that of the first embodiment.

In operation, when the execution of the level moving routine 260 is completed in the same manner as in the first embodiment, the microcomputer 160 proceeds to step 260A of the main control program. In case a rack has already been stored onto the shelf of the wagon W for storing the rack within the elevator assembly 50, the rack sensor 150*b* is generating a rack signal therefrom. Thus, the microcomputer 160 determines "YES" in step 260A. Increments the storage court data Cw by "2" and updates the incremented result into Cw in step 260*b* and determines "NO" in step 260*c* if Ro is not equal to Cw. When Ro is equal to Cw, the microcomputer 160 determines "YES" in step 260*c*, increments Cw in step 260*b* by "2" in step 260*d* to update the incremented result into Cw. If Cw<Rm, the microcomputer 160 determines "YES" in step 260*e* to execute the level moving routine 260. If Cw is equal to or larger than Rm, the microcomputer 160 determines "NO" in step 260*e* to perform an arithmetic operation in step 290*a*.

As explained above, when the decision becomes "YES" in step 260A after execution of the level moving routine 260, it is judged that a rack has been already stored on the shelf of the wagon W for storing the rack within the elevator assembly 50. Thus, the microcomputer 160 increments and updates the storage count data Cw during the arithmetic operation processing in steps 260*b* to 260*e* without any execution of the arithmetic operation processing in and after step 260*a*. Then, the microcomputer 160 executes the level moving routine 260 and the interrupt control program during which the elevator assembly 50 is raised or lowered. Thus, the microcomputer 160 performs arithmetic operations so as to match position count data Cp with the storage count data Cw in step 260*b* or 260*d* and then executes the arithmetic operation processing in and after step 260*a* based on the adjustment of "NO" in step 260A. As a result, the rack of the elevator assembly 50 may always be stored onto the empty shelf of the wagon W. It is therefore possible to prevent inconvenience that the rack within the elevator assembly 50 is pushed onto a shelf by force through another rack has occupied that shelf. The other operation and effect are the same as those in the first embodiment.

An explanation will now be given of a fourth embodiment which is characterization in that the main control program described in the first embodiment is modified so as to partly alter the flow chart of FIG. 6 into a flow chart shown in FIGS. 16 and 17. The other construction is the same as that in the first embodiment.

Figure 16:
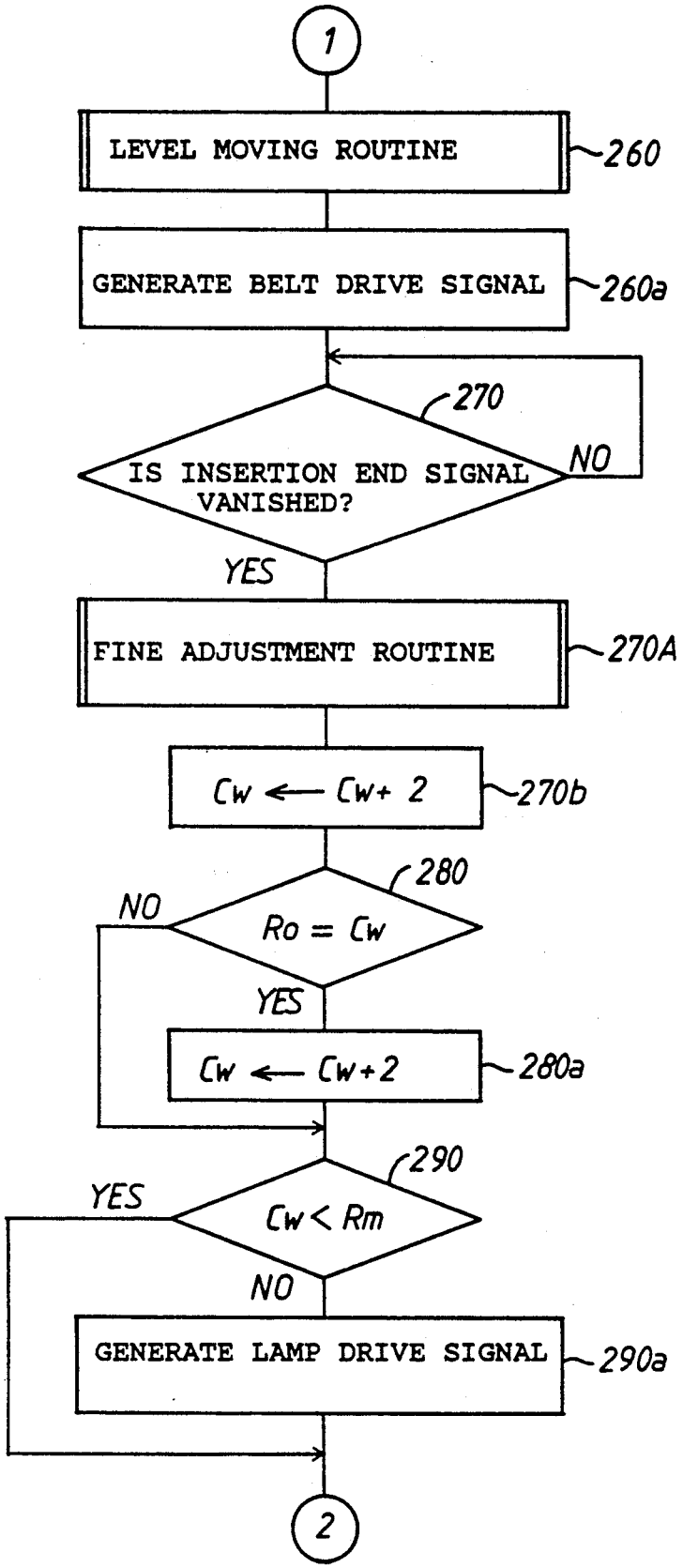
FIG. 16 is a partial flow chart illustrating a fourth embodiment of a dishwashing system in accordance with the present invention.
Figure 17:
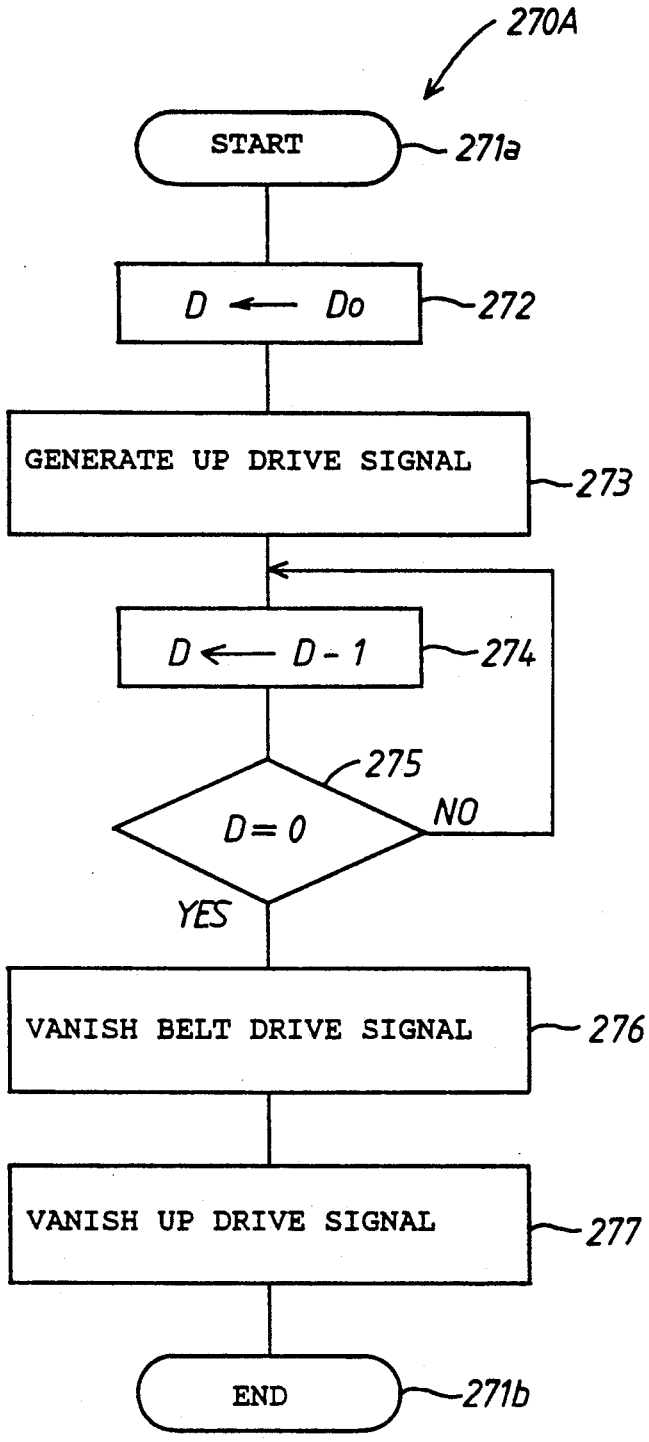
FIG. 17 is a detailed flow chart illustrating a fine control routine shown in FIG. 16.

In operation, when the rack within the elevator assembly 50 is stored onto the shelf of the wagon W through the arithmetic operation processing in steps 260*a* and 270 according to completion in execution of the level moving routine 260, as described in the first embodiment, the microcomputer 160 determines "YES" in step 270 to advance the main control program to the fine adjustment routine 270A (see FIGS. 16 and 17). Then, the microcomputer 160 sets timer data D into a predetermined time value Do (e.g., several seconds) in step 272 and generates an up drive signal in step 273 in response to which the elevator assembly 50 starts rising in the same manner as that in the first embodiment. It is noted that the predetermined time value Do corresponds to a time necessary for slightly raising the elevator assembly 50 and is previously stored in the ROM of the microcomputer 160.

The microcomputer 160 then decrements the timer data D by "1" and updates the decremented result into D in step 274 to determine "NO" in step 275. When D=0 in step 274 as the predetermined time value D elapses, the microcomputer 160 determines the "YES" in step 275 to vanish the belt drive signal in step 276 in response to which both the timing belts 57*i* and 57*l* are stopped. The microcomputer 160 vanishes the up drive signal in step 277 in response to which the elevator assembly 50 is stopped in its slightly rising operation.

As described above, in storing the rack within the elevator assembly 50 onto the shelf of the wagon W during the arithmetic operation in both steps 260*a* and 270, the elevator assembly 50 may be slightly raised under movement of both the timing belt 57*i* and 57*l* through execution of the fine adjustment routine 270A, even if the rear end of the rack projects forward from the front end of the shelf (i.e., toward the side of the elevator assembly 50). Thus, the rack may be wholly and completely stored onto the shelf. As a result, the end portions of the rack will not disturb the subsequent rising and lowering operations of the elevator assembly 50. The other operation and effect are the same as those in the first embodiment.

Figure 18A:
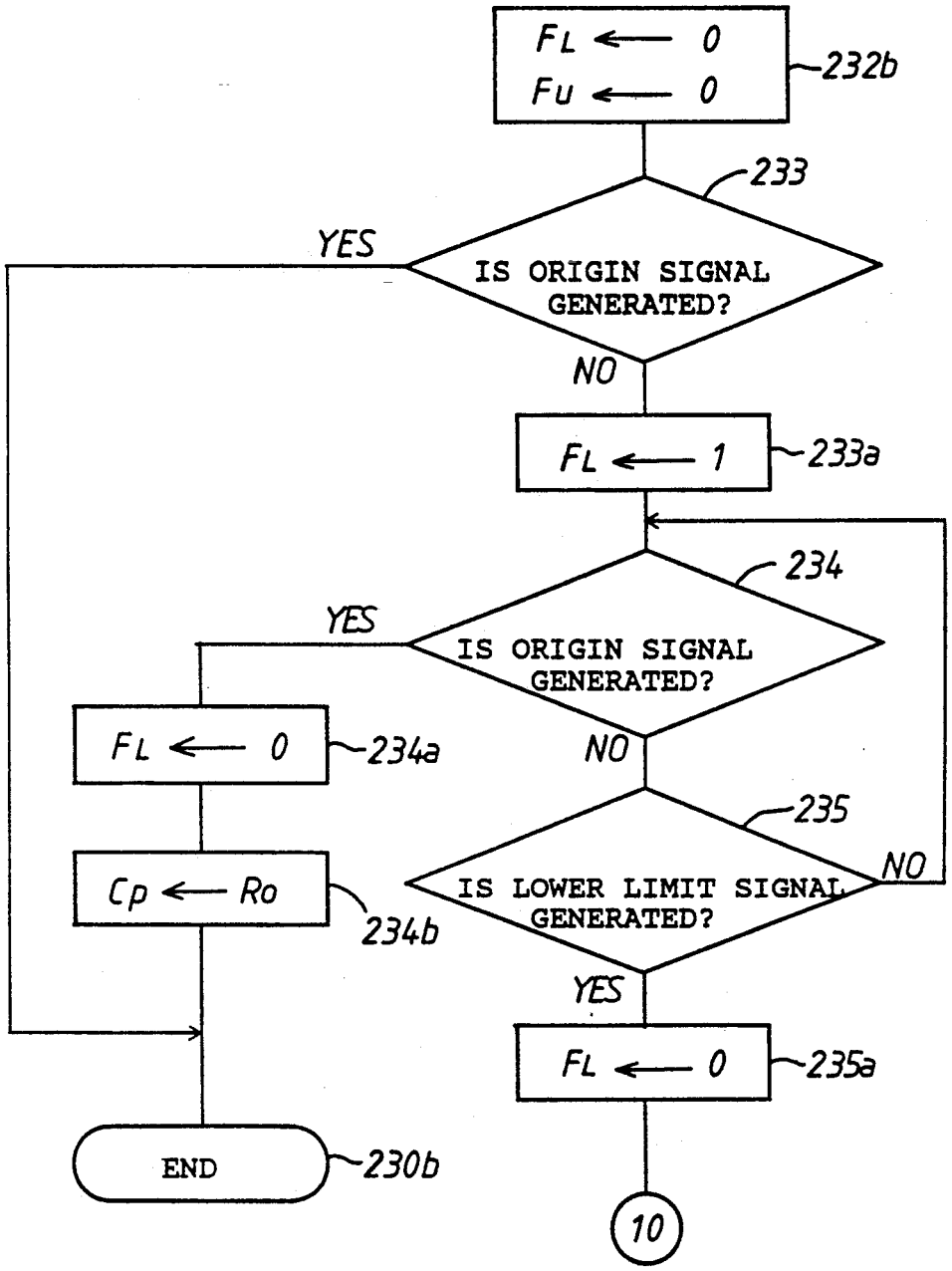
FIGS. 18A and 18B are a partial flow chart illustrating a fifth embodiment of a dishwashing system in accordance with the present invention.
Figure 18B:
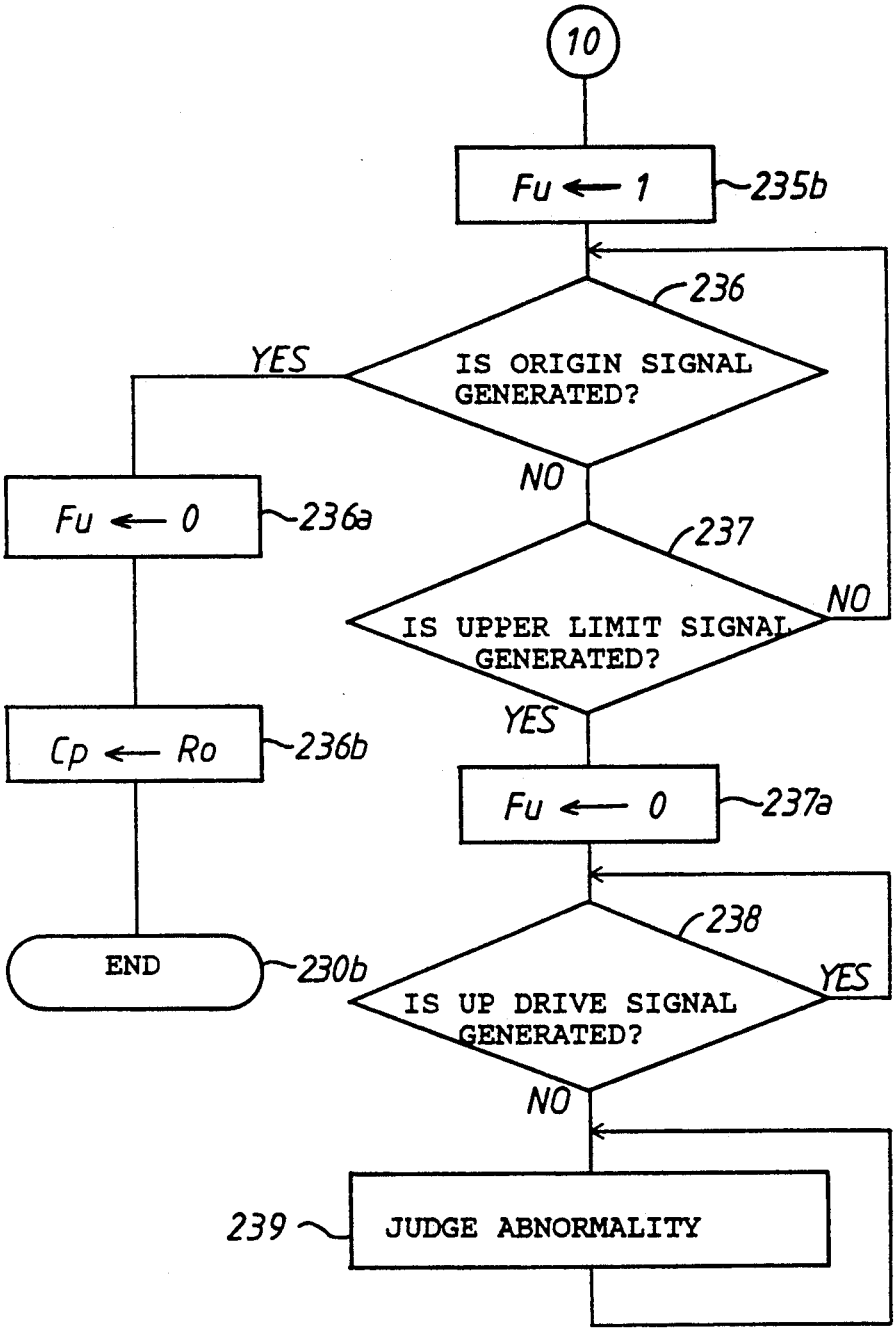

An explanation will now be given of a fifth embodiment which is characterized in the main control program described in the first embodiment is modified so as to partly alter the flow chart of FIG. 8 into a flow chart shown in FIGS. 18A and 18B. The other construction is the same as that in the first embodiment.

In operation, when Cp becomes equal to Ro under execution of the origin return routine 230, as described in the first embodiment, FL and Fu are reset into FL=0 and Fu=1 in step 232*b*. Thus, the microcomputer 160 determines the step 233 whether or not an origin signal is issued from the origin sensor. In this instance, it is normal that the ramp 56 of the elevator assembly 50 locates at its top surface in the vicinity of the dog member 122, because Cp is equal to Ro. If the origin sensor 122 has generated an origin signal, the microcomputer 180 determines "YES" in step 233 to perform the arithmetic operations in and after step 240*a* by way of execution of the step 230*b*.

If the elevator assembly 50 is not maintained at the position where the origin sensor 120 will generate an origin signal, due to some reasons such as projection of the rack stored within the wagon W toward the frame 30 of the elevator E and the like, the microcomputer 160 determines "NO" in step 233. Then, the microcomputer 160 sets FL+1 in step 233*a* repetitively determine "NO" sequentially in steps 234 and 235. At this state, the microcomputer 160 determines "YES" based on FL=1 in step 340 to execute the arithmetic operation in step 340*a* during which the elevator assembly 50 lowers.

When the origin sensor 120 generates an origin signal later, the microcomputer 160 determines "YES" in step 234 and resets the FL=0 in step 234*a* to set Cp=Ro in step 234*b*. This means that Cp=Ro is again set according to the premise that the position of the elevator assembly 50 has been corrected to the position where an origin signal will be properly generated from the origin sensor 120. The microcomputer 160 performs the arithmetic operation in step 340*b* of FIG. 10A based on FL=0 obtained in step 234*a*, and during this operation the elevator assembly 50 is stopped.

When addition/renewal in step 361 of FIG. 10B or step 391 of FIG. 10C are repeated by execution of the interrupt control program associated with lowering of the elevator assembly 50 during the loop processing of steps 234 and 235, the microcomputer 160 determines "YES" in step 235 when a lower limit signal is generated from the lower limit sensor 140. Then, the microcomputer 160 resets FL=0 in step 235*a* and sets Fu=1 in step 235*b* to repeatedly determine "NO" in steps 236 and 237. The elevator assembly 50 is stopped in its lowering during the arithmetic operation of the microcomputer 160 in step 340*b* of FIG. 10A and then rises during the arithmetic operation of the microcomputer 160 in step 330*b*.

When the decision in step 236 becomes "YES" responsive to generation of an origin signal from the origin sensor 120 during rising of the elevator assembly 50 and the repetitive subtraction/renewal of Cp in step 362 of FIG. 10B, the microcomputer 160 resets Fu=0 in step 236*a* to set Cp=Ro in step 236*b*. This means that Cp=Ro is set again on the premise that the elevator assembly 50 is located at the position where an origin signal from the origin sensor 120 is properly generated. The rising of the elevator assembly 50 is stopped during the arithmetic operation of the microcomputer 160 in step 330*a* of FIG. 10A.

When the decision in step 237 becomes "YES" based on generation of the upper limit signal without the decision "YES" in step 236, the microcomputer 160 resets Fu=0 in step 237*a* to perform execution in step 330*a* of FIG. 10A during repetitive decisions "YES" in step 238 wherein the elevator assembly 50 is stopped in its rising operation. In this instance, the microcomputer 160 repeats a decision indicative of abnormality in step 239. This decision indicative of abnormality means occurrence of detachment of the dog member 122 or the like, on a basis of the fact that the decision of "YES" could not have been acquired in step 236 although the elevator assembly 50 has risen from the lower limit position to the upper limit position.

In case the loop processing of steps 234 and 235 or steps 236 and 237 continues, the elevator assembly 50 cannot be moved upward and maintains the actual position thereof in spite of activation of the geared brake mode 61. This means occurrence of abnormality such as a rack is cut into both the wagon W and the elevator E. However, such a phenomenon may be immediately coped with visually. The other operation and effect are the same as those in the first embodiment.

A sixth embodiment of the present invention will be described below. The sixth embodiment is characterized in that a forward rotation flag Fa=1 and a reverse rotation flag Fb=1 are additionally set in steps 221*e* and 221*h* of FIG. 7A and that the main control program and interrupt control program described in the first embodiment are modified so as to change the flow charts of FIGS. 9 and 10A to 10C into flow charts shown in FIGS. 19 and 20A to 20D. The other construction is the same as that of the first embodiment.

In operation, it is assumed that the microcomputer 150 starts executing the main control program and the timer is reset to start measuring the predetermined time, as previously described. When measurement of the timer is completed under sequential decisions "NO" in steps 222 and 223 of the origin acquiring routine 220 (see FIGS. 7A and 7B), as described in the first embodiment, the microcomputer 160 starts executing the interrupt control program in step 300*a* in accordance with the flow charts of FIGS. 20A to 20D. When the decisions in steps 222 and 223 are done "NO", as previously described, Fa=1 and Fb=1 are additionally set in steps 221*e* and 221*h* respectively.

When the decisions in steps 310 and 320 become "YES" and "NO" in order as described in the first embodiment, the microcomputer 160 determines "NO" in steps 330 (see FIG. 20B) based on Fu=0 (see step 221*e*), determines "YES" in step 330A on a basis of Fa=1 obtained in step 221*e* and vanishes the up drive signal in step 331 to reset Fa=0 in step 332. The geared brake motor 61 is then stopped with its braking operation by the driving circuit 170 responsive to disappearance of the up drive signal from the microcomputer 160 and maintains the elevator assembly 50 at the upper limit position by way of the chain 64.

In this instance, the elevator assembly 50 may be stopped accurately at the upper limit position by the braking operation of the geared brake motor 61, because any racks are not placed on the elevator assembly 50. Upon completion of the time measuring, the timer is reset again to start measuring the time as described above and repeats the time measurement thereafter. The microcomputer 160 sequentially determines "NO" in steps 350, 350*a*, 370 and 380*a* on a basis of Fd=0 (see step 221*d*), disappearance of a level signal, the origin sensor flag Fo=0 (already initialized in step 210) and disappearance of an origin signal (see FIGS. 20C and 20D).

When the interrupt control program proceeds again to step 330A, as described above, the microcomputer 160 determines "NO" on a basis of Fa=0 obtained in step 332. Then, the microcomputer 160 determines "YES" in step 340 based on FL=1 (see step 221*h*), determines "YES" in step 340A on a basis of Fb=1 obtained in step 221*h* and generates a down drive signal for downward movement of the elevator assembly 50 in step 341. In response to the down drive signal, the geared brake motor 61 is driven by the driving circuit 170 to rotate in the reverse direction under its release of braking operation so as to move the elevator assembly 50 downward. If a level signal is not generated from the level sensor 110 at this stage, the microcomputer 160 sequentially determines "NO" in steps 350, 350*a*, 370 and 380*a*, as previously described.

When the level sensor 110 generates a level signal in association with the dog member 112 and the interrupt control program proceeds to step 350*a* again as described above, the microcomputer 160 determines "YES," sets the level sensor flag into Fd=1 in step 351 and determines "YES" in step 360A on a basis of the reverse rotation flag Fb=1 obtained in step 221*h*. Then, the microcomputer 160 adds "1" to the position count data Cp to update it to Cp=1 in step 361 and determines "NO" in steps 370 and 380*a*. When the interrupt control program goes to step 350 according to vanishing of the level signal from the level sensor 110, the microcomputer 160 determines "YES" on a basis of Fd=1 obtained in step 351, determines "YES" in step 350*b*, resets Fd=0 in step 352 and performs addition/renewal to yield Cp=2 in step 361.

When the level sensor 110 generates a level signal in association with the dog member 113 and the interrupt control program proceeds to step 350, as previously described, the microcomputer 160 determines "NO" on a basis of Fd=0 obtained in step 352, determines "YES" in step 350*a* in association with the level signal, sets Fd=1 in step 351 and performs addition/renewal to yield Cp=3 in step 361. When the level signal from the level sensor 110 in association with the dog member 113 disappears and the interrupt control program goes to step 350, the microcomputer 160 determines "YES" on a basis of Fd=1 obtained in step 351, determines "YES" in step 350*b*, resets Fd=0 in step 352 and performs addition/renewal to yield Cp=4 in step 361.

Figure 20A:
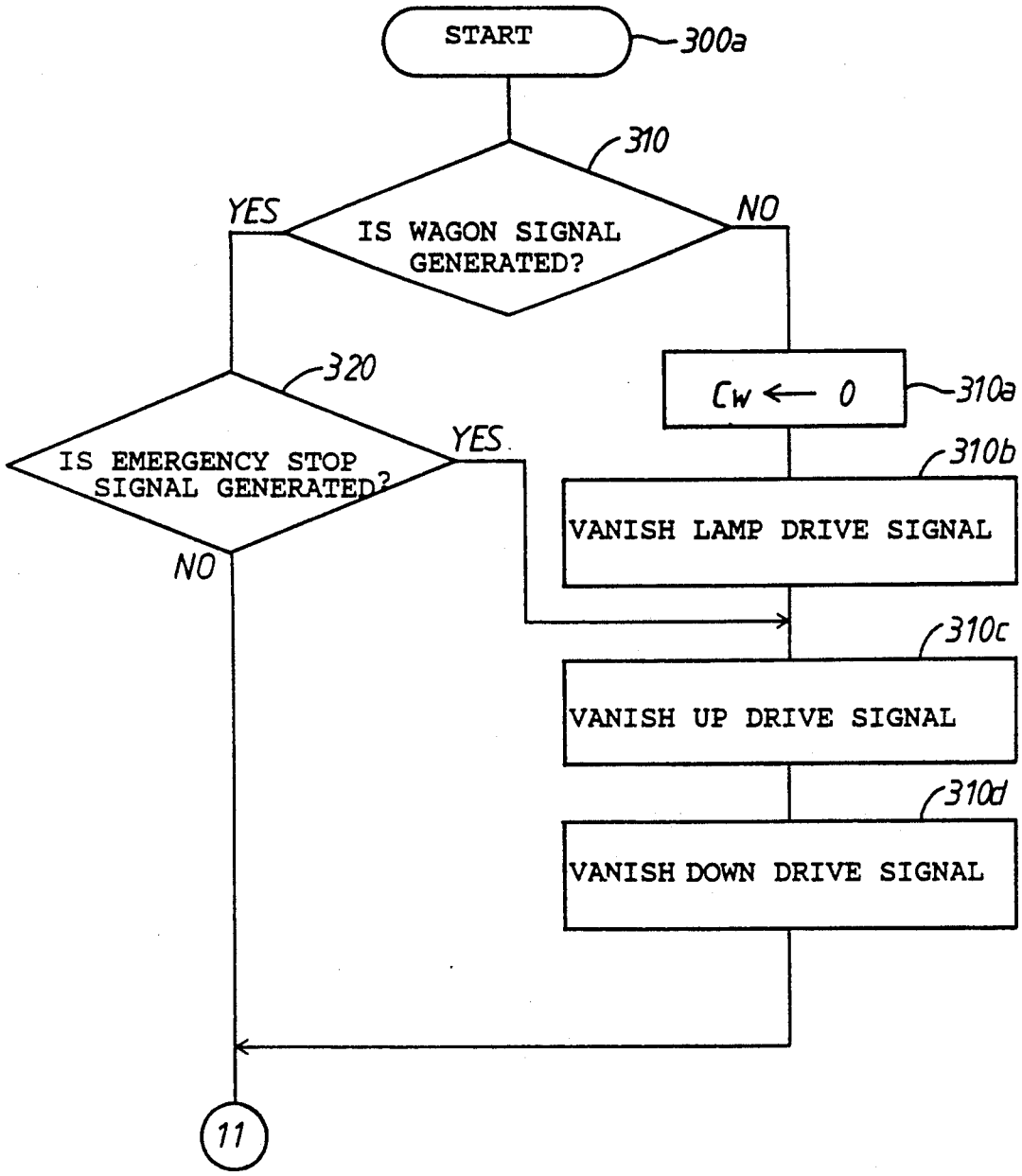
Figure 20B:
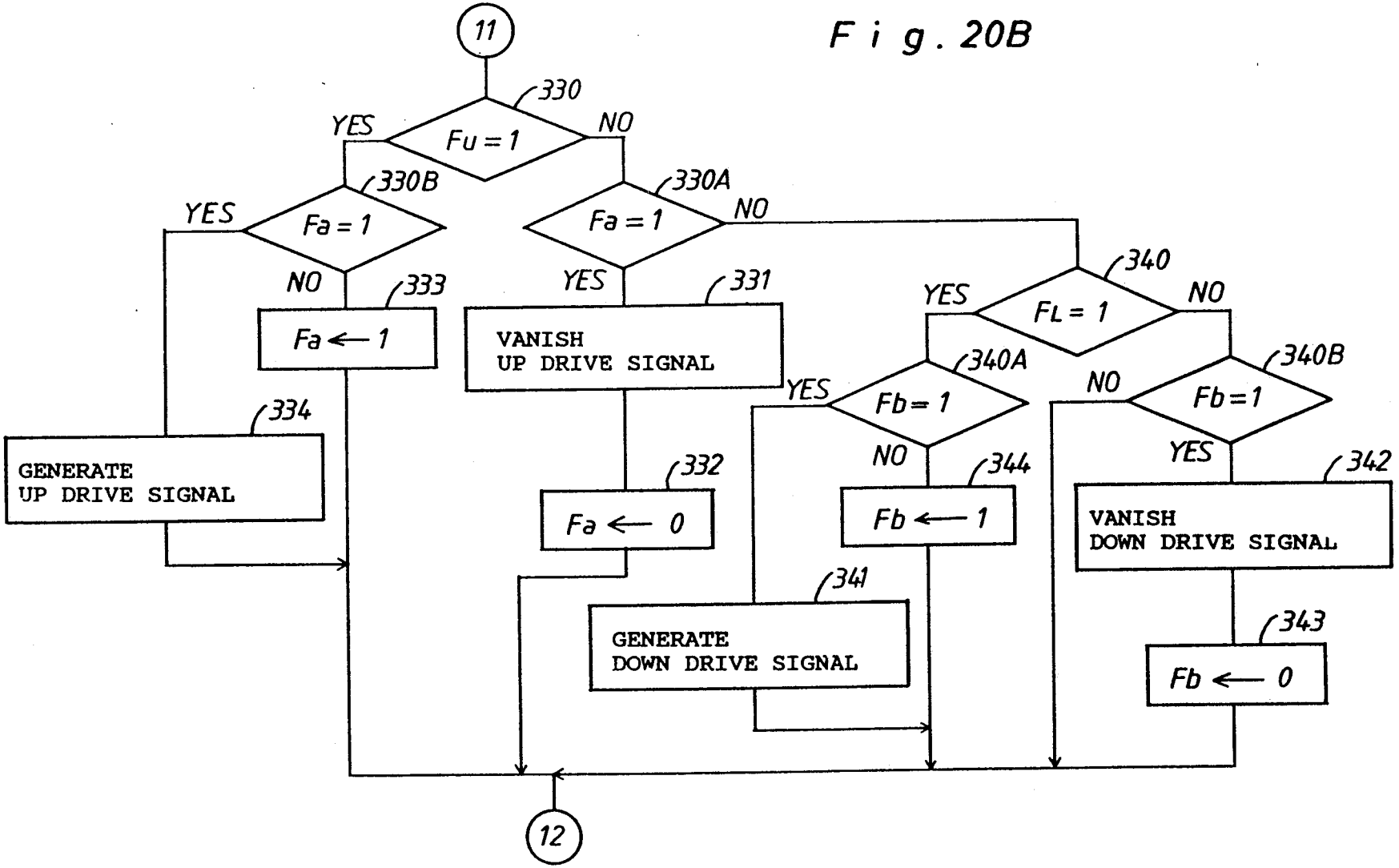
Figure 20C:
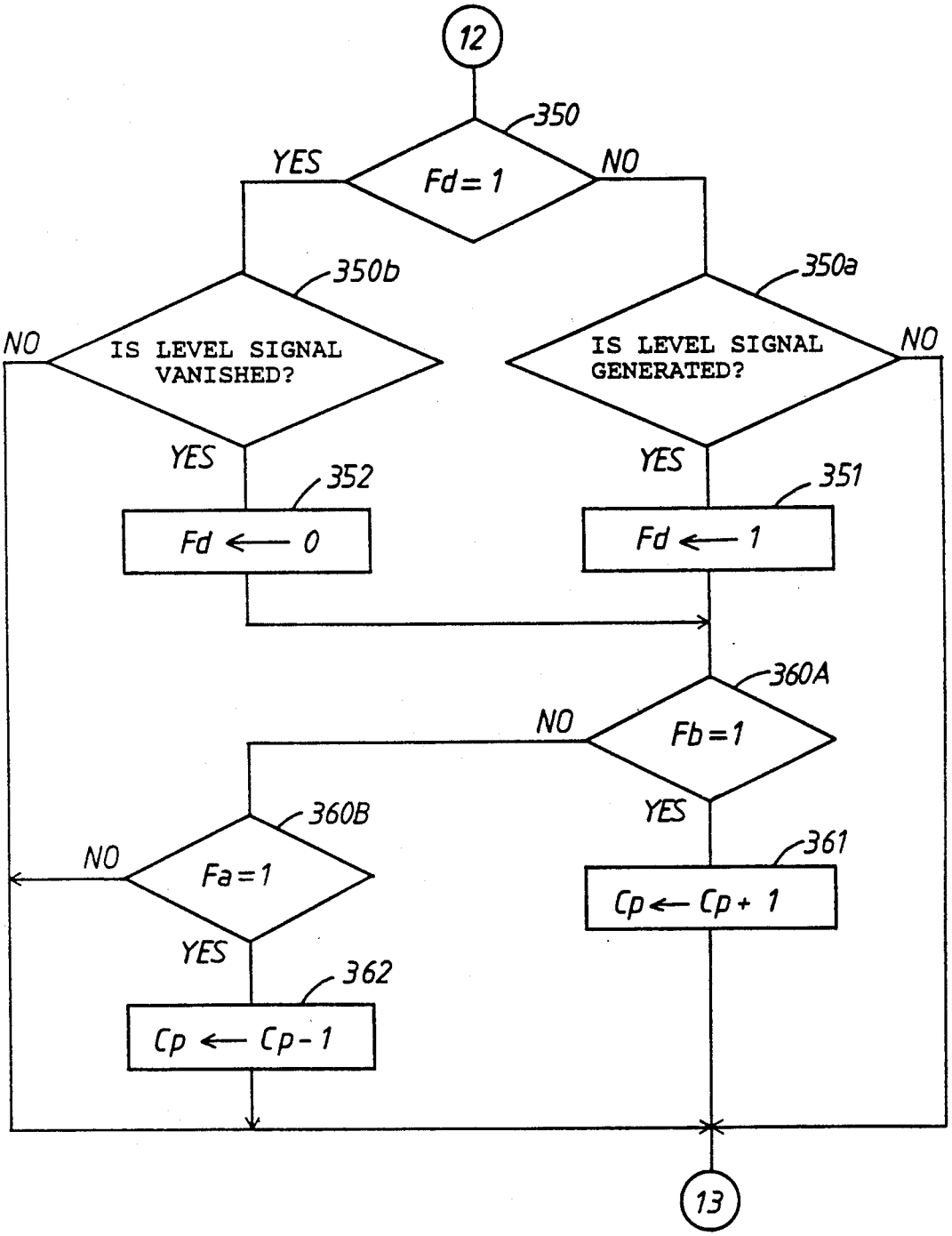
Figure 20D:
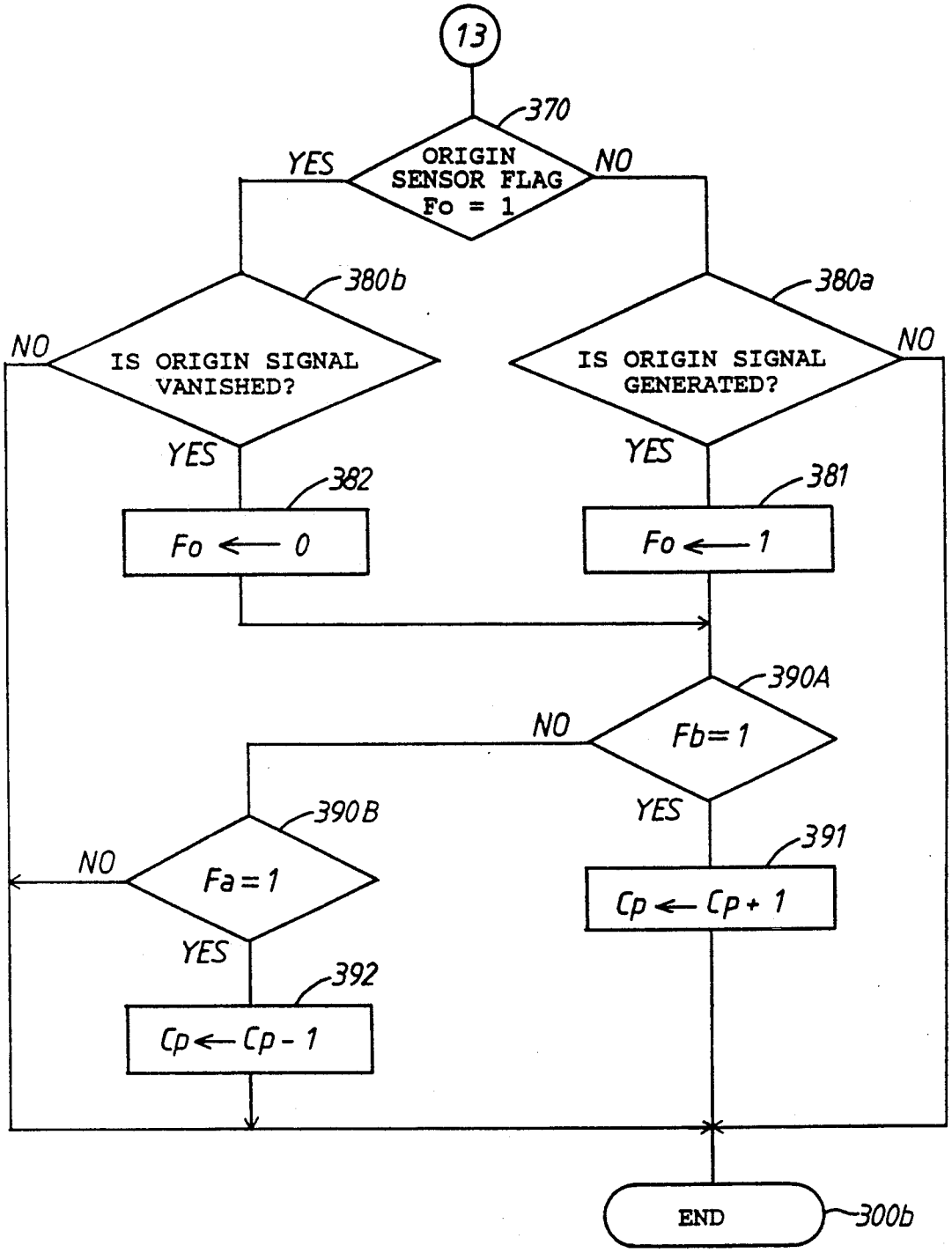

When the origin sensor 120 generates an origin signal and the interrupt control program proceeds to step 370 of FIG. 20D, the microcomputer 160 determines "NO" based on Fo=0, determines "YES" in step 380*a* based on the origin signal, sets Fo=1 in step 381 and performs addition and renewal to yield Cp=5 in step 391. Then, the microcomputer 160 determines "YES" in step 222 of FIG. 7B due to generation of the origin signal, sets the origin register data Ro to Cp (=5) in step 222*a* and determines "NO" in step 223.

When the interrupt control program proceeds to step 370 with vanishing of the origin signal from the origin sensor 120, the microcomputer 160 determines "YES" on a basis of Fo=1 obtained in step 381, determines "YES" in step 380*b* due to disappearance of the origin signal, resets Fo=0 in step 382 and performs addition/-renewal to yield Cp=6 in step 391. When the level sensor 110 repeats sequentially generation and vanishing of a level signal in association with the dog members 114 and 115 thereafter, the microcomputer 160 repeats arithmetic operations in steps 350 to 361 of FIG. 20C in the same manner as that in the case where the level sensor 110 has caused generation and vanishing of the level signal in association with the dog member 113. Accordingly, the microcomputer 160 performs sequentially addition/renewal to yield Cp=7 and Cp=8 in step 361 in association with the dog member 114 and performs sequentially addition/renewal to yield Cp=9 and Cp=10 in association with the dog member 115.

When the lower limit sensor 140 generates a lower limit signal therefrom, the microcomputer 160 determines "YES" in step 223 of FIG. 7B, resets FL=0 in step 223*a* and sets the maximum register data Rm to Cp=10 in step 223*b*. When the interrupt control program proceeds to step 340, the microcomputer 160 determines "NO" on a basis of FL=0 obtained in step 223*a* to determine "YES" in step 340B on a basis of the reverse rotation flag Fb=1 obtained in step 221*H*. Then, the microcomputer 160 vanishes the down drive signal in step 342 to reset Fb=0 in step 343. When the down drive signal from the microcomputer 160 vanishes as mentioned above, the geared brake motor 61 is stopped to stop and maintain the elevator assembly 50 at the lower limit position. In this instance, the elevator assembly 50 may be stopped accurately at the lower limit position by braking of the geared brake motor 61, because no racks are placed on the elevator assembly 50.

After completion the arithmetic operation in the above origin acquiring routine 220, as previously described, the microcomputer 160 starts executing the origin return routine 230 (see FIGS. 5 and 8) in step 230*a* and sequentially determines "NO" and "YES" in steps 231 and 232 on a basis of Cp=10>Ro=5 to set the up flag Fu=1. When the interrupt control program proceeds to step 330 of FIG. 20B as described above, the microcomputer 160 determines "YES" based on Fu=1, determines "NO" in step 330B on a basis of Fa=1 obtained in step 332, sets Fa=1 in step 333 and sequentially determines "NO" in steps 350, 350*a*, 370 and 380*a*. When the decision in step 330 of the interrupt control program becomes "YES" as described above, the microcomputer 160 determines "YES" in step 330B on a basis of Fa=1 obtained in step 333 and generates an up drive signal in step 334. Then, the geared brake motor 61 is driven by the driving circuit 170 responsive to the up drive signal from the microcomputer 160 to move the elevator assembly 50 upward with its release of braking operation.

When the level sensor 110 generates a level signal in association with the dog member 115 and the interrupt control program proceeds to step 350, the microcomputer 160 determines "NO" and determines "YES" in step 350*a* to set Fd =1 in step 351. Then, the microcomputer 160 determines sequentially "NO" and "YES" in steps 360A and 360B on a basis of Fb=0 and Fa=1 obtained respectively in steps 343 and 333 and decrements the position count data Cp by "1" in step 362 to update it to Cp=9. When the interrupt control program goes to step 350 with disappearance of the level signal, the microcomputer 160 determines "YES" based on Fd=1, determines "YES" in step 350*b* based on disappearance of the level signal, and resets Fd=0 in step 352 to update Cp=8 in step 362.

When the level sensor 110 generates a level signal in association with the dog member 114 and the interrupt control program proceeds to step 350, the microcomputer 160 determines "NO," determines "YES" in step 350*a* and sets Fd =1 in step 351 to update Cp=7 in step 362. When the interrupt control program goes to step 350 with disappearance of the level signal, the microcomputer 160 determines "YES" based on Fd=1, determines "YES" in step 350*b* based on disappearance of the level signal, resets Fd=0 in step 352 and performs updating to yield Cp=6 in step 362.

When the origin sensor 120 generates an origin signal and the interrupt control program proceeds to step 350, the microcomputer 160 determines "NO" on a basis of Fd=0 obtained in step 352 and determines "NO" in steps 350*a* and 370 based on generation of the origin signal and Fo=0. Thereafter, the microcomputer 160 determines "YES" in step 380*a*, sets Fo=1 in step 381, determines "YES" in step 390B on a basis of Fa=1 obtained in step 333 and performs updating to yield Cp=5 in step 391.

Then, the microcomputer 160 sequentially determines "NO" in steps 231 and 232 of FIG. 8 on a basis of Cp=Ro=5 to reset FL=0 and Fu=0 in step 232*b*. When the interrupt control program proceeds to step 330 of FIG. 20B at this stage, the microcomputer 160 determines "NO" based on Fu=0 and determines "YES" in step 330A on a basis of Fa=1 obtained in step 333 to vanish the up drive signal in step 331. Accordingly, the elevator assembly 50 is stopped and maintained at the position corresponding to the dog member 122 by stop in braking of the geared brake motor 61. In this instance, the elevator assembly 50 may be precisely stopped under braking of the geared brake motor 61 at the position corresponding to the dog member 122, because no rack is placed on the elevator assembly 50. In addition, the microcomputer 160 resets Fa=0 in step 332.

When the decision in step 231 of the origin return routine becomes "YES", the microcomputer 160 sets FL=1 in step 231*a*. Then, the microcomputer 160 determines "NO" in steps 330 and 330A of the interrupt control program, as previously described, to determine "YES" in step 340 on a basis of FL=1. Subsequently, the microcomputer 160 determines "NO" in step 340A on a basis of Fb=0 obtained in step 343 to set Fb=1 in step 344. When the decision in step 340 becomes "YES", the microcomputer 160 determines "YES" in step 340A and generates a down drive signal in step 341 in response to which the elevator assembly 50 is lowered, as described above. When the decision in step 232 of FIG. 8 becomes "NO" later, the microcomputer 160 sets FL =0 and Fu=0 in step 232b and the elevator assembly 50 is stopped and maintained precisely at the position corresponding to the dog member 122, as described above.

When completed washing and rinsing of tableware 14 in the dishwashing machine 10 at this stage, the rack 12 on which the tableware 14 is held is moved from the dishwashing machine 10 via the top 21 of the work table 20 into the elevator assembly 50, as done in the first embodiment. When the arithmetic operation in step 250a of the main control program is ended after inserted the rack 12 into the elevator assembly 50, as previously described, the microcomputer 160 starts executing the level moving routine of FIG. 19 in step 261A to determine "NO" in step 261 based on Cp=5>Cw=1. Then, the microcomputer 160 determines "YES" in step 262 on a basis of Cp>Cw to set Fu=1 in step 262a. When the interrupt control program proceeds to step 330 of FIG. 20B, the microcomputer 160 determines "YES" based on Fu=1 to determine "YES" in step 330B on a basis of Fa=1 obtained in step 333. Then, the microcomputer 160 generates an up drive signal in step 334 in response to which the elevator assembly 50 is driven to move upward by the geared brake motor 61 with the rack 12 placed thereon.

When the origin signal from the origin sensor 120 disappears accordingly, the microcomputer 160 determines "YES" in step 370 based on Fo=1 and determines "YES" in step 380b due to disappearance of the origin signal to reset Fo=0 in step 382. Then, the microcomputer 160 determines sequentially "NO" and "YES" in steps 390A and 390B and performs updating to yield Cp=4 in step 391. When the level sensor 110 generated a level signal in association with the dog member 113 and the interrupt control program proceeds to step 350, the microcomputer 160 determines "NO" on a basis of Fd=0 to determine "YES" in step 350a based on the level signal. Subsequently, the microcomputer 160 sets Fd=1 in step 351 and performs updating to yield Cp=3 in step 362. When the level signal from the level sensor 110 in association with the dog member 113 disappears and the interrupt control program goes to step 350, the microcomputer 160 determines "YES" based on Fd=1 to determine "YES" in step 350b. Then, the microcomputer 160 resets Fd=0 in step 352 and performs updating to yield Cp=2 in step 362.

When the level sensor 110 generates a level signal in association with the dog member 112 and the interrupt control program proceeds to step 350, the microcomputer 160 determines "NO" based on Fd=0, determines "YES" in step 350a, sets Fd=1 in step 351 and performs updating to yield Cp=1 in step 362. Consequently, the microcomputer 160 determines "NO" in steps 261 and 262 sequentially on a basis of Cp=1 to reset FL=0 and Fu=0 in step 262b. Then, the microcomputer 160 sets timer data Td into a predetermined value N in step 262c. Subsequently, the microcomputer 160 subtracts "1" from the timer data Td and updates the subtraction result (Td−1) to Td in step 262d to determine "NO" in step 262e based on Td>0. In addition, the predetermined value N is stored in advance as a value corresponding to 15 (msec) in the ROM of the microcomputer 160.

When the interrupt control program proceeds to step 330 of FIG. 20B while the subtraction/renewal of the timer data Td in step 262d is repeated under the repetitive decisions of "NO" in step 262e, the microcomputer 160 determines "NO" based on Fu=0, determines "YES" in step 330A on a basis of Fa=1 obtained in step 333, and vanishes the up drive signal in step 331 to reset Fa=0 in step 332. Then, the geared brake motor 61 is driven by the driving circuit 170 responsive to disappearance of the up drive signal from the microcomputer 160 to stop the elevator assembly 50 via the chain 64 by its braking operation. When the elevator assembly 50 is accurately stopped at Cp=1 with the back back end portion of the top 56c of the ramp 56 faced to the end portion of the shelf 76 of the wagon W, the microcomputer 160 determines "YES"in step 262e when Td=0 is satisfied in step 262d, and determines "YES" in step 262f based on Cp=Cw=1.

It is assumed that there occurs the fact that even if the up drive signal disappears in step 331 after reset into FL=0 and Fu=0 in step 262b, the level sensor 110 vanishes a level signal which has been generated in association with the dog member 112, because the elevator assembly 50 is over-raised prior to reset of Fa=0 in step 332 to raise the back end portion of the top 56c of the ramp 56 above the end portion of the storage shelf 76 in spite of braking of the geared brake motor 61 due to self-gravity inertia of the tableware holding rack 12 and placed on the elevator assembly 50.

When the interrupt control program proceeds to step 350 at this stage, the microcomputer 160 determines "YES" on a basis of Fd=1 obtained in step 351, determines "YES" in step 350b based on disappearance of the level signal and resets Fd=0 in step 352 to determine "NO" in step 360A based on Fb=0. Then, the microcomputer 160 determines "YES" in step 360B based on Fa=1 and performs subtraction/renewal to yield Cp=0 in step 362. When the decision in step 262e becomes "YES" as described above, the microcomputer 160 determines "NO" in step 262f based on Cp=0<CW=1 and returns the level moving routine of FIG. 19 to step 261 with inhibition in proceeding of the level moving routine to step 260a (see FIG. 6).

At this stage, Cp=0<CW=1 is satisfied, as mentioned above. Thus, the microcomputer 160 determines "YES" in step 261 to set FL=1 in step 261a. When the interrupt control program proceeds to step 330, as previously described, the microcomputer 160 determines "NO" on a basis of Fu=0 obtained in step 262b, determines "NO" in step 330A on a basis of Fa=0 obtained in step 332 and determines "YES" in step 340 on a basis of FL=1 obtained in step 261a. If Fb=1 is satisfied at this stage, the microcomputer 160 determines "YES" in step 340A to generate a down drive signal in step 341. Thus, the elevator assembly 50 moves downward as described above.

When the level sensor 110 generates a level signal in association with the dog member 112 and the interrupt control program proceeds to step 350, the microcomputer 160 determines "NO" on a basis of Fd=0 obtained in step 352 and determines "YES" in step 350a based on generation of the level signal to set Fd=1 in step 351. Then, the microcomputer 160 determines "YES" in step 360A based on Fb=1 and performs addition/renewal to yield Cp=1 in step 361. Accordingly, the microcomputer 160 sequentially determines "NO" in steps 261 and 262 and performs an arithmetic operation in and after step 262b as described above. When the interrupt control program proceeds to step 330, the microcomputer 160 determines "NO" on a basis of Fu=0 obtained in step 262b. Then, the microcomputer 160 determines "NO", "NO" and "YES" sequentially in steps 330A, 340 and 340B on a basis of Fa=0, FL=0 and Fb=1 obtained in step 262b and vanishes the down drive signal in step 342. In response to vanishing of the down drive signal from the microcomputer 160, the elevator assembly 50 is stopped, as described above. Additionally, the microcomputer 160 resets Fb=0 in step 343.

As explained above, even if subtraction and renewal of Cp=0 in step 362 is erroneously done because the elevator assembly 50 has over-risen at its stop position due to inertia thereof, the loop arithmetic processing of steps 261 and 261a is again performed with the decision of "NO" in step 262f following to the decision of "YES" in step 262e. Then, the elevator assembly 50 is moved downward by generation of the down drive signal in step 341 so as to ensure addition/renewal of Cp=1 in step 361 by the microcomputer 160 and is in turn stopped in response to disappearance of the down signal in step 342. In this instance, the length in down movement of the elevator assembly 50 necessary for addition/renewal of Cp=1 is very short. Thus, owing to correction of Cp=1, the elevator assembly 50 may stop with the back end portion of the top 56c of the ramp 56 accurately faced to the end portion of the storage shelf 76 of the wagon W without over-dropping thereof.

Figure 19:
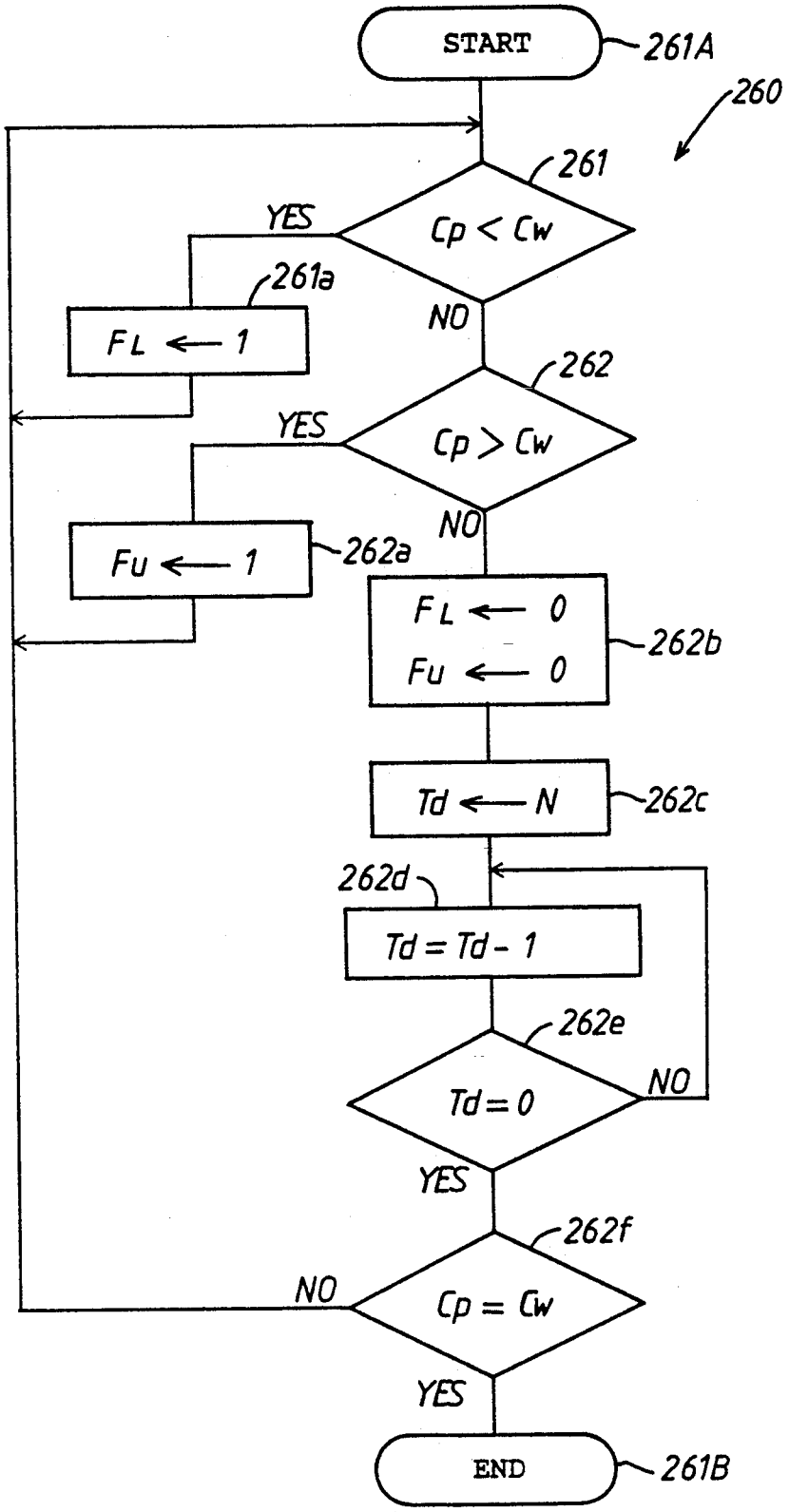
FIGS. 19 and 20A to 20D are partial flow charts illustrating a sixth embodiment of a dishwashing system in accordance with the present invention.

When completed the arithmetic operation in the level moving routine of FIG. 19 according to decision of "YES" in step 262f, as previously described, the microcomputer 160 generates a belt driven signal in step 260a of FIG. 6 in response to which the rack 12 is moved onto the storage shelf 76 as described in the first embodiment. In this instance, the movement of the rack 12 can be easily ensured owing to position of the elevator assembly 50 accurately facing to the shelf 76. When FL=1 is set in step 231a of the origin return routine as described in the first embodiment, the microcomputer 160 determines "NO" in step 330 of FIG. 20B on a basis of Fu=0 to determine "NO" in step 330A based on Fa=0. Then, the microcomputer 160 determines "YES" in step 340 based on FL=1 and determines "NO" in step 340A on a basis of Fb=0 to set Fb=0 to set Fb=1 in step 344. When the decision in step 340 becomes "YES," the microcomputer 160 determines "YES" in step 340A based on Fb=1 and generates a down drive signal in step 341 in response to which the geared brake motor 61 lowers the elevator assembly 50. Thereafter, the level sensor 110 repeats disappearance, generation and disappearance of a level signal in association with the individual dog member 112 and 113 and the execution according to the flow chart of FIG. 20C is repeatedly performed to perform addition/renewal of Cp in step 361 until Cp=3.

When the origin sensor 120 generates an origin signal, the microcomputer 160 determines "YES" in step 380a of FIG. 20D to set Fo=1 in step 381. Then, the microcomputer 160 determines "YES" in step 390A and performs addition/renewal to yield Cp=4 in step 391. When the original signal vanishes, after yielded Cp=5 as described above, the microcomputer 160 determines "NO" in steps 231 and 232 of FIG. 8 on a basis of Cp=Ro=5 to reset FL=0 and Fu=0 in step 232b. Then, the microcomputer 160 determines "NO" in step 340 of FIG. 20B on a basis of FL=0 to determine "YES" in step 340B. Thus, the geared brake motor 61 is stopped in response to disappearance of the down drive signal in step 342 to return the elevator assembly 50 to the position of the dog member 122.

It is Assumed that at this stage a rack holding thereon tableware washed and rinsed newly in the dishwashing machine 10 has been inserted into the elevator assembly 50. When the computer program proceeds to the level moving routine of FIG. 19, the microcomputer 160 performs the loop processing of steps 261, 262 and 262a based on Cp=5<Cw=3 to set Fu=1, The elevator assembly 50 is moved upward during the arithmetic operations in steps 330, 330B and 334 of FIG. 20B.

When the level sensor 110 generates a level signal associated with the dog member 113 after generation and disappearance of the origin signal from the origin sensor 120 accordingly, the microcomputer 160 performs an arithmetic operation according to the flow chart of FIG. 20C as described above to repeat subtraction and renewal of Cp in step 362 until Cp=3. Then, the microcomputer 160 determines "NO" in steps 261 and 262 of FIG. 19 on a basis of Cp=Cw=3, resets FL=0 and Fu=0 in step 262b and sets the timer data Td into the predetermined value N in step 262c. Subsequently, the microcomputer 160 subtracts "1" from the timer data Td and updates the subtraction result to Td in step 262d to determine "NO" in step 262e.

When the interrupt control program proceeds to step 330 during the repetitive decisions of "NO" in step 262e as describing above, the microcomputer 160 determines "NO" based on Fu=0, determines "YES" in step 330 on a basis of Fa=1, vanishes the up drive signal in step 331, and resets Fa=0 obtained in step 332. Then, the geared brake motor 61 is deactivated by the driving circuit 170 in response to disappearance of the up drive signal from the microcomputer 160 to stop the elevator assembly 50 through the chain 64 under braking action thereof. In this instance, if the elevator assembly 50 is accurately stopped at Cp=3 with the back end portion of the top 56c of the ramp 56 faced to the end portion of the storage shelf 77 of the wagon W, the microcomputer 160 determines "YES" in step 262e when Td=0 is satisfied in step 262d, and determines "YES" in step 262f based on Cp=Cw=1.

It is assumed that there occurs the fact even if the up drive signal disappears in step 331 after reset into FL=0 and Fu=0 in step 262b, the level sensor 110 vanishes a level signal which has been generated in association with the dog member 113, because the elevator assembly 50 is over-raised prior to reset of Fa=0 in step 332 to raise the back end portion of the top 56c of the ramp 56 above the end portion of the storage shelf 77 in spite of braking of the geared brake motor 61 due to self-gravity inertia of the tableware holding rack 12 and placed on the elevator assembly 50.

When the interrupt control program proceeds to step 350 at this stage, the microcomputer 160 determines "YES" on a basis of Fd=1 obtained in step 351 and determines "YES" in step 350b based on disappearance of the level signal to reset Fd=0 step 352. Then, the microcomputer 160 determines "NO" in step 360A based on Fb=0, determines "YES" in step 360B based on Fa=1 and performs subtraction/renewal to yield Cp=2 in step 362. When the decision in step 262e becomes "YES" as described above, the microcomputer 160 determines "NO" in step 262f based on Cp=1<CW=3 and returns the level moving routine of FIG. 19 to step 261 with inhibition in execution of step 160a (see FIG. 6).

At this stage, Cp=1<CW=3 is satisfied as mentioned above. Thus, the microcomputer 160 determines "YES" in step 261 to set FL=1 in step 261a. When the interrupt control program proceeds to step 330 as previously described, the microcomputer 160 determines "NO" on a basis of Fu=0 in step 262b to determine "NO" in step 330A on a basis of Fa=0 obtained in step 332. Then, the microcomputer 160 determines "YES" in step 340 on a basis of FL=1 obtained in step 261a. If Fb=1 is satisfied at this stage, the microcomputer 160 determines "YES" in step 340A to generate a down drive signal in step 341. Thus, the elevator assembly 50 is moved downward as described above.

When the level sensor 110 generates a level signal in association with the dog member 113 and the interrupt control program proceeds to step 350, the microcomputer 160 determines "NO" based on Fd=0 in step 352 and determines "YES" in step 350a based on generation of the level signal. Then, the microcomputer 160 sets Fd=1 in step 351, determines "YES" in step 360A based on Fb=1 and performs addition/renewal to yield Cp=3 in step 361. Accordingly, the microcomputer 160 determines "NO" sequentially in steps 261 and 262 to perform arithmetic operations in and after step 262b, as described above. When the interrupt control program proceeds to step 330, the microcomputer 160 determines "NO" based on Fu=0 in step 262b. Then, the microcomputer 160 determines "NO", "NO" and "YES" in steps 330A, 340 and 340B sequentially on a basis of Fa=0, FL=0 and Fb=1 obtained in step 262b and vanishes the down drive signal in step 342 in response to which the elevator assembly 50 is stopped, as described above. In step 343, Fb is reset into "0".

As explained above, even if subtraction and renewal of Cp=2 in step 362 is erroneously done because the elevator assembly 50 has over-risen at its stop position due to inertia thereof, the loop arithmetic processing of steps 261 and 261a is again performed with the decision of "NO" in step 262f following to the decision of "YES" in step 262e. Then, the elevator assembly 50 is moved downward by generation of the down drive signal in step 341 so as to ensure addition/renewal of Cp=3 in step 361 by the microcomputer 160 and is in turn stopped in response to disappearance of the down drive signal in step 342. In this instance, the length in down movement of the elevator assembly 50 necessary for addition/renewal of Cp=3 is very short. Thus, owing to correction of Cp=3, the elevator assembly 50 may stop with the back end portion of the top 56c of the ramp 56 accurately faced to the end portion of the storage shelf 77 of the wagon W without over-dropping thereof.

Then, the microcomputer 160 performs the arithmetic operations in steps 260a to 270a of FIG. 6 during which the rack is stored onto the storage shelf 77 substantially in the same manner as done for the rack 12. In this instance, this storage can be easily ensured owing to position of the elevator assembly 50 accurately facing to the storage shelf 77 as described above. Then, the microcomputer 160 performs addition/renewal to yield Cw=5 in step 270b and determines "YES" in step 280 based on Ro=Cw. Then, the microcomputer 160 performs addition/renewal to yield C2=7 in step 280a and determines "YES" in step 290. When completed storing of the rack onto the shelf 77 in this manner, the microcomputer 160 executes the origin return routine 230 during which the elevator assembly 50 is returned to the position of the dog member 122, as previously described. The microcomputer 160 repeats addition/renewal of Cp until Cp=5 in step 361, as described above.

When the computer program proceeds to the level moving routine of FIG. 19 after a rack holding thereon tableware washed and rinsed newly in the dishwashing machine 10 is inserted into the elevator assembly 50, as described above, the microcomputer 160 determines "YES" in step 261 based on Cp=5<Cw=7 to set FL=1 in step 261a. The elevator assembly 50 is moved downward during the arithmetic operations of the microcomputer 160 in steps 340, 340A and 341 of FIG. 20B.

When the origin signal from the origin sensor 120 vanishes, the microcomputer 160 performs an arithmetic operation according to the flow chart of FIG. 20D and perform addition/renewal to yield Cp=6 in step 391. When the level sensor 110 generates a level signal associated with the dog member 114, the microcomputer 160 performs an arithmetic operation according to the flow chart of FIG. 20C and performs addition/renewal to yield Cp=7 in step 361. Then, the microcomputer 160 determines "NO" in steps 261 and 262 of FIG. 19 based on Cp=Cw=7, and resets FL=0 and Fu=0 in step 262d to set the timer data Td into the predetermined value N in step 262c. Subsequently, the microcomputer 160 subtracts "1" from the timer data Td and updates the subtraction result (Td−1) into Td in step 262d to determine "NO" in step 262e based on Td>0.

When the interrupt control program proceeds to step 330 of FIG. 20B during repetitions of subtraction/renewal of the timer data Td in step 262d according to the repetitive decisions of "NO" in step 262e, the microcomputer 160 determines "NO" based on Fu=0 to determine "NO" in step 330A based on Fa=1 in step 333. Then, the microcomputer 160 determines "NO" and "YES" in steps 340 and 340B and vanishes the down drive signal in step 342 to reset Fb=0 in step 343. Thus, the geared brake motor 61 is deactivated by the driving circuit 170 in response to disappearance of the down drive signal from the microcomputer 160 to stop the elevator assembly 50 through the chain 64 under braking action thereof. In this instance, if the elevator assembly 50 is accurately stopped at Cp=7 with the back end portion of the top 56c of the ramp 56 faced to the end portion of the shelf 78 of the wagon W, the microcomputer 160 determines "YES" in step 262e when Td=0 is satisfied in step 262d and determines "YES" in step 262f on a basis of Cp=Cw=7.

It is assumed that there occurs the fact that even if the down drive signal disappears in step 342 after reset into FL=0 and Fu=0 in step 262b, the level sensor 110 vanishes a level signal which has been generated in association with the dog member 114, because the elevator assembly 50 is excessively lowered prior to reset of Fb=0 in step 343 to lower the back end portion of the top 56c of the ramp 56 below the end portion of the storage shelf 78 in spite of braking of the geared brake motor 61 due to self-gravity inertia of the tableware holding rack 12 and placed on the elevator assembly 50.

When the interrupt control program proceeds to step 350 at this stage, the microcomputer 160 determines "YES" based on Fd=1 in step 351 and determines "YES" in step 350*b* on a basis of disappearance of the level signal to reset Fd=0 in step 352. Then, the microcomputer 160 determines "YES" in step 360A based on Fb=1 and performs addition/renewal to yield Cp=8 in step 361. When the decision in step 262*e* becomes "YES" as described above, the microcomputer 160 determines "NO" in step 262*f* based on CW=7<Cp=8 to return the level moving routine of FIG. 19 to step 261 with inhibition in execution of step 260*a*.

At this stage, Cp=8>CW7 is satisfied, as mentioned above. Thus, the microcomputer 160 determines "YES" in step 262 to set Fu=1 in step 262*a*. When the interrupt control program proceeds to step 330 as described above, the microcomputer 160 determines "YES" based on Fu=1 in step 262*a*. If Fa=1 is satisfied at this stage, the microcomputer 160 determines "YES" in step 330B to generate an up drive signal in step 334 in response to which the elevator assembly 50 is moved upward as described above.

When the level sensor 110 generates a level signal in association with the dog member 114 and the interrupt control program proceeds to step 350, the microcomputer 160 determines "NO" based on Fd=0 in step 352 to determine "YES" in step 350*a* based on generation of the level signal. Then, the microcomputer 160 sets Fd=1 in step 351, determines "NO" in step 360A based on Fb=0 and performs subtraction/renewal to yield Cp=7 in step 362. Accordingly, the microcomputer 160 sequentially determines "NO" in steps 261 and 262 to execute arithmetic operations in and after step 262*b* as described above. When the interrupt control program proceeds to step 330, the microcomputer 160 determines "NO" based on Fu=0 in step 262*b* and determines "YES" in step 330A based on Fa=1 to vanish the up drive signal in step 331 in response to which the elevator assembly 50 is stopped as described above. In step 332, Fa is reset equal to "0".

As explained above, even if subtraction and renewal of Cp=8 in step 362 is erroneously done because the elevator assembly 50 has excessively lowered at its stop position due to inertia thereof, the loop arithmetic processing of steps 262 and 262*a* is again performed with the decision of "NO" in step 262*f* following to the decision of "YES" in step 262*e*. Then, the elevator assembly 50 is moved upward by generation of the up drive signal in step 334 so as to ensure subtraction/renewal of Cp=7 in step 362 and is in turn stopped in response to disappearance of the up drive signal in step 331. In this instance, the length in up movement of the elevator assembly 50 necessary for subtraction and renewal of Cp=7 is very short. Thus, owing to correction Cp=7, the elevator assembly 50 may stop with the back end portion of the top 56*c* of the ramp 56 accurately faced to the end portion of the storage shelf 78 of the wagon W without over-rising thereof.

Then, the rack is stored onto the storage shelf 78 under execution of the microcomputer 160, as described above. In this instance, this storage may be easily ensured owing to position of the elevator assembly 50 accurately faced to the shelf 78 as described above. Subsequently, the microcomputer 160 performs addition/renewal to yield Cw=9 in step 270*b* and determines "NO" and "YES" in steps 280 and 290. When storage of the rack onto the shelf 78 is completed in this manner, the microcomputer 160 executes the origin return routine 230, as previously described, during which the elevator assembly 50 is returned to the position of the dog member 122. The microcomputer 160 repeats subtraction and renewal of Cp in step 362 until Cp=5 in step 362.

It is assumed that at this stage a rack holding thereon tableware washed and rinsed newly in the dishwashing machine 10 is inserted into the elevator assembly 50, as described above. Then, the microcomputer 160 repeats the loop processing of steps 261 and 261*a* of FIG. 19 based on Cp=5<Cw=9 and the elevator assembly 50 is lowered during the arithmetic operations of the microcomputer 160 in steps 340, 340A and 341 of FIG. 20B. When sequentially realized disappearance of the origin signal from the origin sensor 120, generation and disappearance of a level signal from the level sensor 110 associated with the dog member 114 and generation of a level signal associated with the dog member 115, the microcomputer 160 performs addition and renewal to yield Cp=6 in step 391 of FIG. 20D and repeats addition/renewal of Cp in step 361 of FIG. 20C until Cp=9. Then, the microcomputer 160 determines "NO" in steps 261 and 262 of FIG 19 based on Cp=Cw=9 to reset FL=0 and Fu=0 in step 262*b*. The microcomputer 160 sets the timer data Td into the predetermined value N in step 262*c* and subtracts in step 262*d* "1" from the timer data Td to update the subtraction result (Td−1) to Td. Thereafter, the microcomputer 160 determines "NO" in step 262*e* based on Td>0.

When the interrupt control program proceeds to step 330 of FIG. 20B during repetition of subtraction/renewal of the timer data Td related to repetitive decisions "NO" in step 262*e*, the microcomputer 160 determines "NO" based on Fu=0 and determines "NO" in step 330A based on Fa=1 in step 333. Then, the microcomputer 160 determines "NO" and "YES" in steps 340 and 340B and vanishes the down drive signal in step 342 to reset Fb=0 in step 343. Subsequently, the geared brake motor 61 is deactivated by the driving circuit 170 in response to disappearance of the down drive signal from the microcomputer 160 to stop the elevator assembly 50 through the chain 64 under its braking action. In this instance, if the elevator assembly 50 is accurately stopped at Cp=9 with the back end portion of the top 56*c* of the ramp 56 faced to the end portion of the shelf 79 of the wagon W, the microcomputer 160 determines "YES" in step 262*e* when Td=0 is satisfied in step 262*d*, and determines "YES" in step 262*f* based on Cp=C2=9.

It is assumed that there occurs the fact that even if the down drive signal disappears in step 342 after reset into FL=0 and Fu=0 in step 262*b*, the level sensor 110 vanishes a level signal which has been generated in association with the dog member 115, because the elevator assembly 50 is excessively lowered prior to reset of Fb=0 in step 343 to lower the back end portion of the top 56*c* of the ramp 56 below the end portion of the storage shelf 79 in spite of braking of the geared brake motor 61 due to self-gravity inertia of tableware holding rack 12 and placed on the elevator assembly 50.

When the interrupt control program proceeds to step 350 at this stage, the microcomputer 160 determines "YES" based on Fd=1 in step 351 and determines "YES" in step 350*b* on a basis of disappearance of the level signal to reset Fd=0 in step 352. Then, the microcomputer 160 determines "YES" in step 360A based on Fb=1 and performs addition/renewal to yield Cp=10 in step 361. When the decision in step 262*e* becomes "YES" as described above, the microcomputer 160 determines "NO" in step 262*f* based on Cp=10<CW=9 and returns the level moving routine of FIG. 19 to step 261 with inhibition of step 260a in the level moving routine.

At this stage, Cp=10>CW=9 is satisfied, as mentioned above. Thus, the microcomputer 160 determines "YES" in step 262 to set Fu=1 in step 262a. When the interrupt control program proceeds to step 330 as described above, the microcomputer 160 determines "YES" based on Fu=1 in step 262a. If Fa=1 is satisfied at this stage, the microcomputer 160 determines "YES" in step 330B to generate an up drive signal in step 334. Thus, the elevator assembly 50 is moved upward as described above.

When the level sensor 110 generates a level signal in association with the dog member 115 and the interrupt control program proceeds to step 350, the microcomputer 160 determines "NO" based on Fd=0 in step 352 and determines "YES" in step 350a on a basis of generation of the level signal to set Fd=1 in step 351. Then, the microcomputer 160 determines "NO" in step 360A based on Fd=0 and performs subtraction/renewal to yield Cp=9 in step 362. Accordingly, the microcomputer 160 determines "NO" in steps 261 and 262 sequentially to perform arithmetic operations in and after step 262b as described above. When the interrupt control program proceeds to step 330, the microcomputer 160 determines "NO" based on Fu=0 in step 262b and determines "YES" in step 330A based on Fa=1 to vanish the up drive signal in step 331 in response to which the elevator assembly 50 is stopped as described above. In step 332, Fa is reset as "0".

As explained above, even if subtraction and renewal of Cp=10 in step 361 is erroneously done because the elevator assembly 50 has excessively lowered at its stop position due to inertia thereof, the loop arithmetic processing of steps 262 and 262a is again performed with the decision of "NO" in step 262f following to the decision of "YES" in step 262e. Then, the elevator assembly 50 is moved upward by generation of the up drive signal in step 334 so as to ensure subtraction/renewal of Cp=9 in step 362 and is in turn stopped in response to disappearance of the up drive signal in step 331. In this instance, the length in up movement of the elevator assembly 50 necessary for subtraction and renewal of Cp=9 is very short. Thus, owing to correction of Cp=9, the elevator assembly 50 may stop with the back end portion of the top 56c of the ramp 56 accurately faced to the end portion of the storage shelf 79 of the wagon W without over-rising thereof.

Then, the microcomputer 160 stores the rack onto the storage shelf 79 as described above. In this instance, this storage may be easily ensured owing to position of the elevator assembly 50 accurately faced to the shelf 79 as described above. Subsequently, the microcomputer 160 performs addition/renewal to yield Cw=11 in step 270b. And the microcomputer 160 determines "NO" in steps 280 and 290 and generates a lamp drive signal in step 290a to permit the driving circuit 190 to turn on the indicator lamp L. It is therefore possible to visually observe the storage of the whole racks into the wagon W.

As described above, according to execution of the level moving routine of FIG. 19 and the interrupt control program of FIGS. 20A to 20D in the sixth embodiment, storage of each rack holding thereon tableware onto each storage shelf is done under stop of the elevator assembly 50 facing to each storage shelf, when values of the position count data Cp and storage count data CW determined at each storage accord with each other. For such stopping, even when the elevator assembly 50 rises above or falls below the stop position to change the value of the position count data Cp due to self-gravity inertia of the elevator assembly 50 holding thereon a tableware-placed rack, the elevator assembly 50 is moved down or up in such a manner to correct the value of the position count data Cp under executing again the level moving routine 260 of FIG. 19 for storing a rack onto the next storage shelf. Thus, storage of each rack onto each storage shelf of the wagon W can always be smoothly ensured. The other operation and effect are the same as those of the first embodiment.

A seventh embodiment of the present invention will be described with reference to FIGS. 21 and 22, which illustrate another dishwashing system according to the present invention. The dishwashing system comprises a dishwashing machine 10A which includes a parallelepiped washing machine assembly 10a and a door 10b which is assembled openably and closably on a top surface 11A of the washing machine assembly a to define a washing chamber R. The door 10b is supported at its back wall(see FIG. 24) on a support plate 11a to be movable up and down (i.e., openable and closable) along the support plate 11a. The support plate 11a extends vertically upward from the back wall of the washing machine assembly 10a.

Thus, the dishwashing machine 10A locks automatically the door 10b when closed and starts automatically a washing operation at the same time. Then, the dishwashing machine 10A performs a rinsing operation and automatically releases the lock of the door 10b when completed the rinsing operation. It is to be noted that the door 10b is closed against resilient force of a spring mechanism, not shown, (provided at a proper position in the dishwashing machine 10A) and that the door 10b is opened by the resilient force of the spring mechanism.

Figure 21:
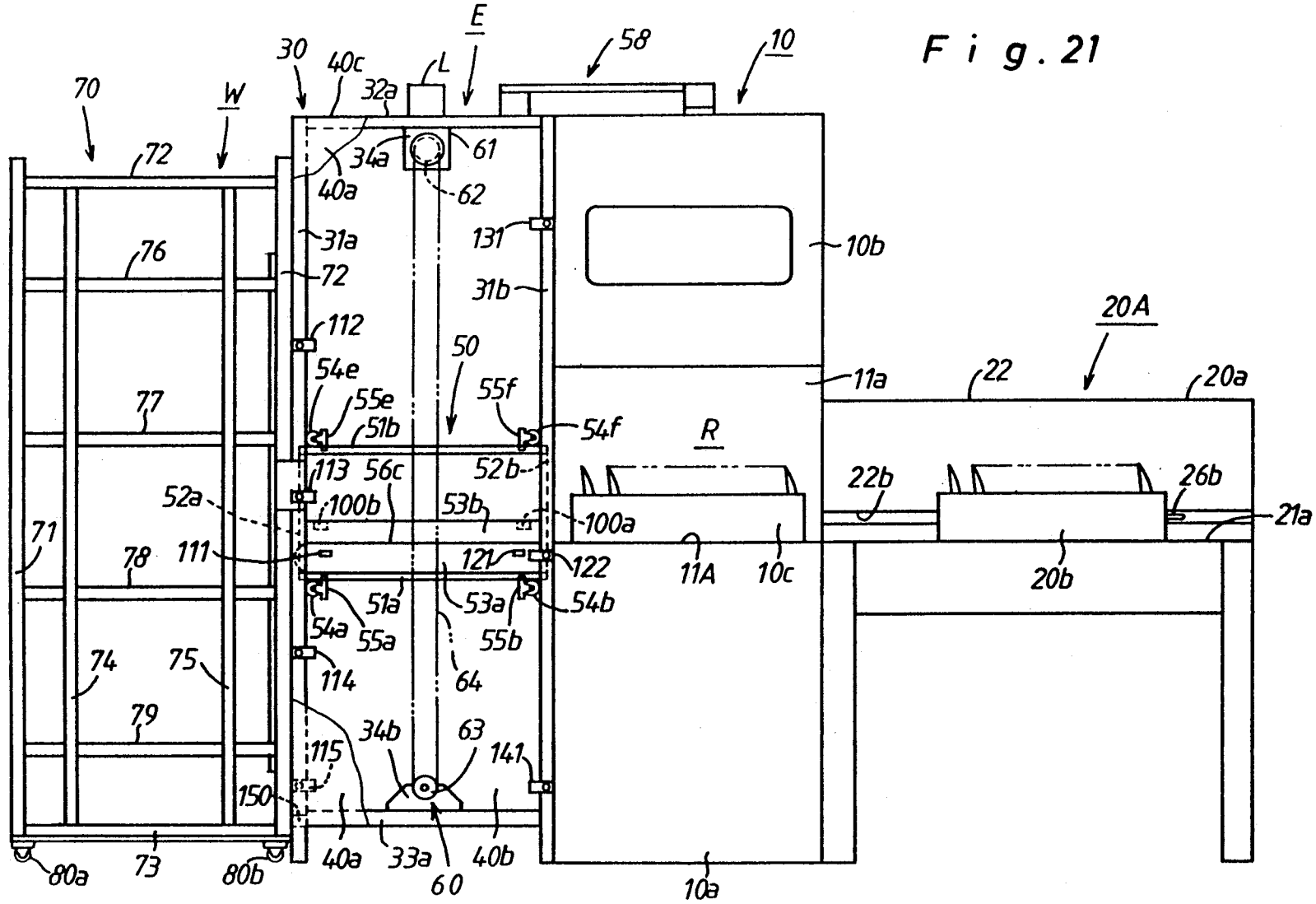
FIG. 21 is a partially cutaway side view illustrating a seventh embodiment of a dishwashing system in accordance with the present invention adapted to another dishwashing machine.
Figure 22:
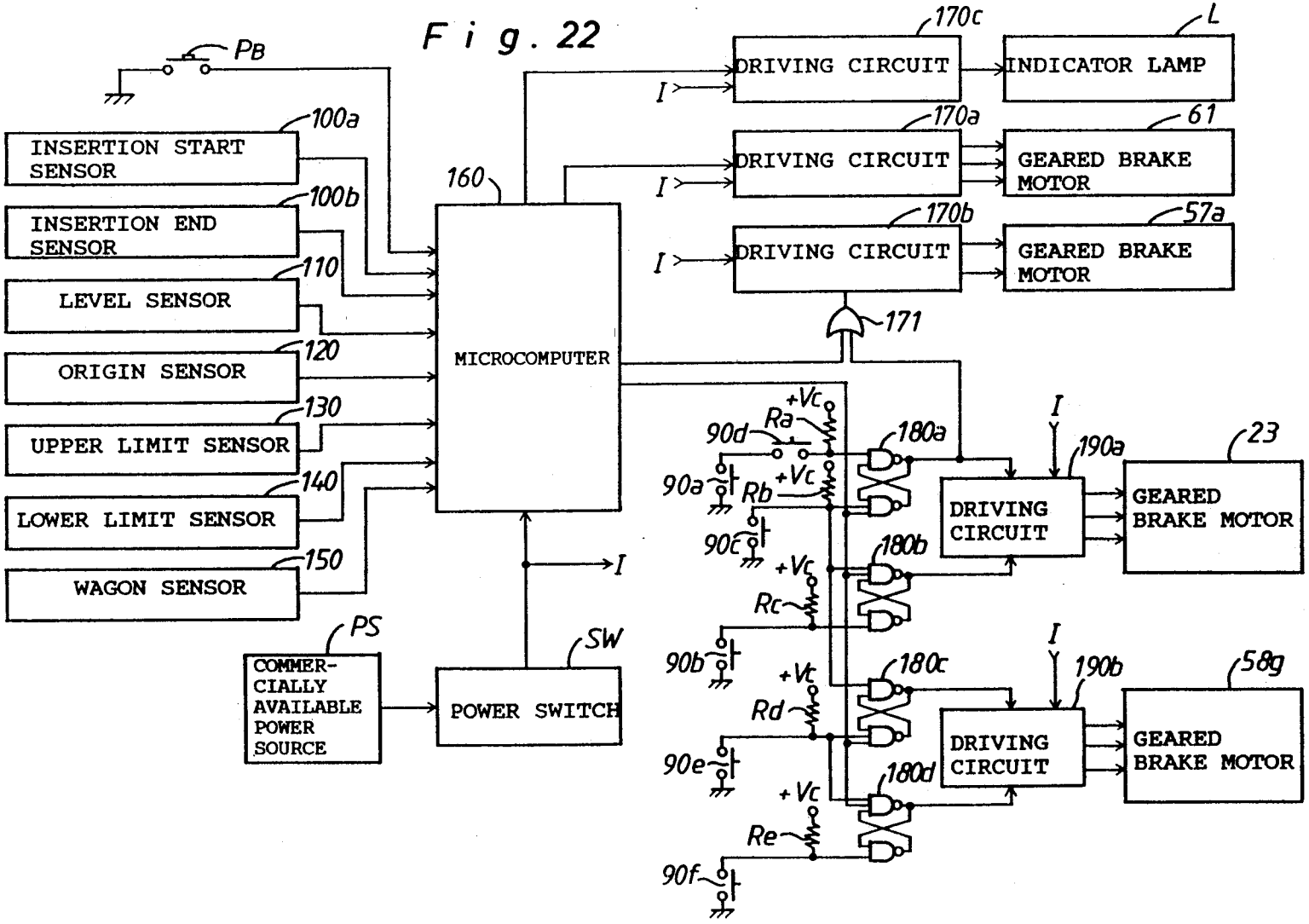
FIG. 22 is a block diagram of the dishwashing system shown in FIG. 21.
Figure 23:
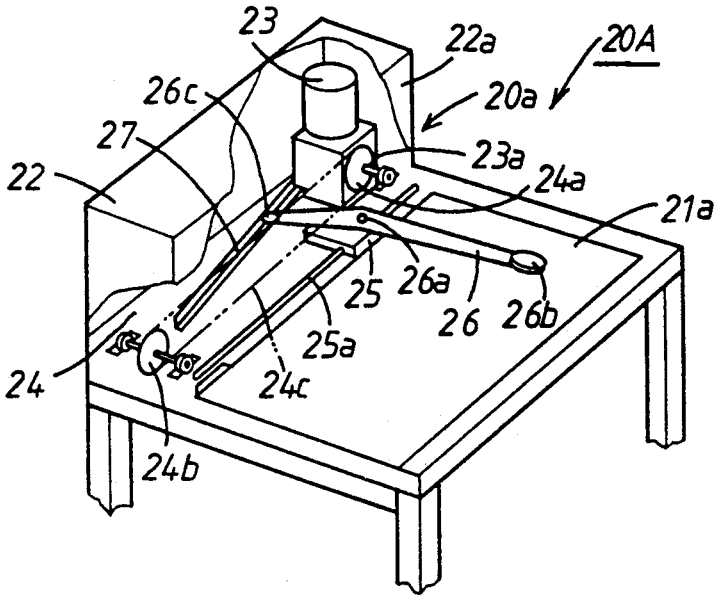
FIG. 23 is a partially cutaway perspective view of a pusher mechanism shown in FIG. 21.

As shown in FIG. 21, a work table 20A is also placed side by side with the washing machine assembly 10a on the right side of the dishwashing machine 1A. A top surface 21a of the work table 20a is maintained in the same horizontal plane as the top surface 11A of the washing machine assembly 10a. On a back edge portion of the work table 20A, a pusher mechanism 20a is assembled as shown in FIGS. 21 and 23. The pusher mechanism 20a has a casing 22 which is mounted on the back edge portion of the work table 20A. A geared brake motor 23 is arranged at the right-hand side within the casing 22, as shown in FIG. 23.

When supplied with electric power, the geared brake motor 23 releases a mechanical braking function of an electromagnetic brake to rotate at a reduction speed. The geared brake motor 23 is stopped under the mechanical braking function of the electromagnetic brake when disconnected from the power supply. A speed reducing portion of the geared brake motor 23 is constructed essentially by a pair of bevel gears. Thus, an output shaft 23a of the geared brake motor 23 extends horizontally from the motor shaft toward a front wall 22a of the casing 22 as shown in FIG. 23.

As shown in FIG. 23, a chain mechanism 24 comprises a sprocket 24a supported on the output shaft 23a of the geared brake motor 23. The chain mechanism 24 also comprises a sprocket 24b supported rotatably above the top surface 21a of the work table 20A at the left side of the sprocket 24a in FIG. 23, and a chain 24c wound around both the sprockets 24a and 24b. A movable member 25 is coupled to and movable along a guide rail 25a in the right and left directions in FIG. 23 and securely linked to a portion of the chain 24c. The guide rail 25a is arranged in parallel with the chain 24c above the back end portion of the top surface 21a of the work table 20A.

A boomerang-shaped arm 26 is supported on the top surface of the movable member 25 at its center shaft 26a in a horizontally rotatable manner. A roller 26b, which is supported axially and rotatably on an outer end portion of the arm 26, extends toward a front edge portion of the top surface 21a of the work table 20A through an elongated opening portion 22b which is bored horizontally on a lower portion of the front wall 22a of the casing 22. A roller 26c, which is supported axially and rotatably on an inner end portion of the arm 26, is received by a guide rail 27 with an L-shaped cross section. The guide rail 27 is horizontally supported by a proper means as it approaches closer to the chain 24c in accordance with approach to the sprocket 24b. Thus, the arm 26 is pushed at its roller 26c by the guide rail 27 rightwardly in FIG. 23 to rotate horizontally and clockwisely, when the movable member 25 moves toward the sprocket 24b along the guide rail 25a.

Figure 24:
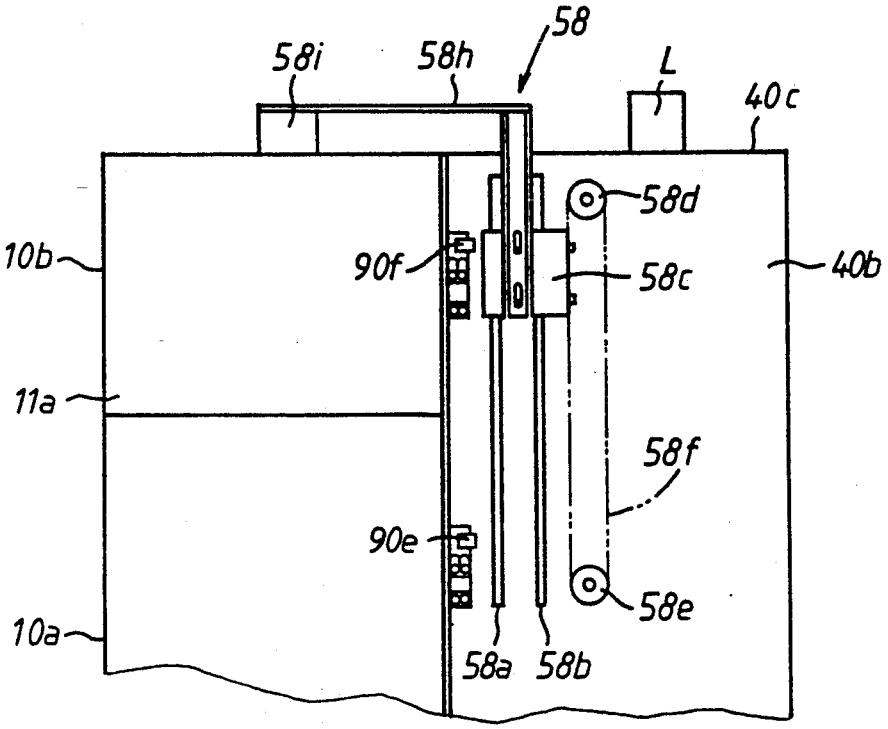
FIG. 24 is an elevational view of an opening/closing mechanism shown in FIG. 21.

As shown in FIG. 21, an elevator E is constructed in the same as that of the first embodiment. An opening/-closing mechanism 58 is assembled on an outer surface of a right side plate 40b of the elevator E as shown in FIG. 24. The opening/closing mechanism 58 has a pair of guide rails 58a and 58b which are vertically mounted in parallel at an interval on an upper left side portion of the outer surface of the right side plate 40b shown in FIG. 24. A movable member 58c, which is made of a magnet, is linked to the guide rails 58a and 58b movably in upward and downward directions. The movable member 58c is fixedly coupled at its left end portion to a portion of a chain 58f which are wound around sprockets 58d and 58e supported rotatably at upper and lower portions of the outer surface of the right side plate 40b. The sprocket 58d is coaxially coupled through the right side plate 40b to an output shaft of a geared brake motor 58g (see FIG. 22) mounted on an inner surface of the right side plate 40b. In addition, the geared brake motor 58g has the same construction as that of the geared brake motor 61 described in the first embodiment.

An L-shaped arm 58h has a vertical portion fixed to the movable member 58c and a horizontal portion extended toward the door 10b. The horizontal portion of the arm 58h has an L-shaped engaging portion 58i(see FIGS. 24 and 25) which is fixed to a tip of the horizontal portion of the arm 58h to abut on a top surface of the door 10b. In this case, a lower limit position(or an upper limit position) of the arm 58h corresponds to a closed position (or an opened position) of the door 10b. The wagon W is the same as that described in the first embodiment, as shown in FIG. 21 and is lined up with the elevator E so as to face the dishwashing machine 10A by way of the elevator E.

An explanation will be given of an electric circuit construction for the dishwashing system with reference to FIG. 22. A start switch 90a is provided on a proper portion of the work table 20A together with the power switch SW and emergency stop switch PB described in the first embodiment. The start switch 90a is of a normally open and self-return type and is temporarily opened when the dish-washing system is started. A pusher origin sensor 90b and a pusher end sensor 90c are in the form of a normally open type switch respectively. When the arm 26 of the pusher mechanism 20a is maintained at a position shown in FIG. 23 or an origin position, the pusher origin sensor 90b detects the origin position of the arm 26 to close itself. When the arm 26 is maintained at a leftward rotating position shown in FIGS. 23 or an end position, the pusher end sensor 90c detects the end position of the arm 26 to close itself.

Figure 25:
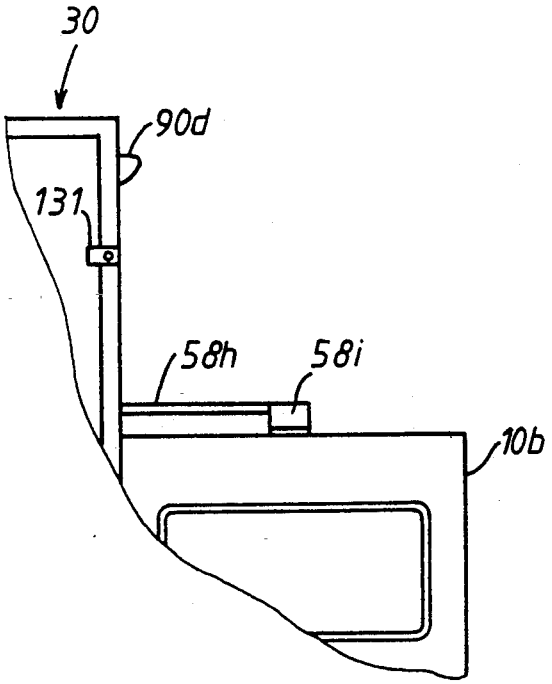
FIG. 25 illustrates a position where a door open switch is attached.

A door opening sensor 90d is in the form of a normally open type switch which is attached to a reverse surface of a flange (not shown) suspended vertically from a center of an upper front frame member of a frame 30. In this case, the door opening sensor 90d has a push plate portion 90da which is protruded outwardly through a slit of the flange as shown in FIG. 25. When the door 10b is opened, the push plate portion 90da is pushed at its top end portion into the slit by the door 10b. This means that the door opening sensor 90d is pushed at the push plate portion 90da into the slit to detect the opening of the door 10b so as to close itself.

An arm lower limit sensor 90e and an arm upper limit sensor 90f are in the form of a normally open type proximity switch respectively and provided on a left end portion of the right side plate 40b of the elevator E as shown in FIG. 24, respectively corresponding to the lower limit position and upper limit position of the arm 58h. When the arm 58c is maintained at the lower limit position, the arm lower limit sensor 9-e detects the movable member 58c to close itself. When the arm 58h is maintained at the upper limit position, the arm upper limit sensor 90f detects the movable member 58c to close itself.

Individual driving circuits 170a, 170b and 170c correspond respectively to the driving circuits 170, 180 and 190 (see FIG. 2) described in the first embodiment. The driving circuit 170b differs from the driving circuit 180 in that under control of the microcomputer 160 through an OR gate 171 or of an RS flip-flop 180a, it releases a braking state of the geared brake motor 57a in accordance with the power supply from the commercially available power source PS to rotate the motor 57a or stops the geared brake motor 57a at braking operation of the motor 57a. The other driving circuits 170a and 170c have the same functions as that of each of the driving circuits 170 and 190.

The RS flip-flop 180a generates a set signal in response to closing of both the door opening sensor 90d and start switch 90d and is reset in response to closing of the pusher end sensor 90c. An RS flip-flop 180b generates a set signal in response to closing of the pusher end sensor 90c and is reset in response to closing of the pusher origin sensor 90b. an RS flip-flop 180c generates a set signal in response to closing of the pusher end sensor 90c and is reset in response to closing of the arm lower limit sensor 90e. an RS flip-flop 180d generates a set signal in response to closing of the arm lower limit sensor 90e and is reset in response to closing of the arm upper limit sensor 90f. in FIG. 22, the reference characters Ra to Re denote pull-up resistors, respectively.

The driving circuit 190a is responsive to the set signal from the RS flip flop 180a to rotate the geared brake motor 23 under release of braking of the motor 23 at a reduced speed in a forward rotation corresponding to rotational movement of the arm 26 rom the origin position to the end position in accordance with the electric power supply from the power source PS. The driving circuit 190a is responsive to the set signal from the RS flip-flop 180b to rotate the geared brake motor 23 under release of braking of the motor 23 in a reverse rotation corresponding to rotational movement of the arm 26 from the end position to the origin position in accordance with the electric power supply from the power source PS.

The driving circuit 190b is responsive to the set signal from the RS flip-flop 180c to rotate the geared brake motor 58g under release of braking of the motor 58g at a reduced speed in a forward rotation corresponding to lowering movement of the arm 58h in accordance with the electric power supply from the power source PS. The driving circuit 190b is responsive to the set signal from the RS flip-flop 180d to rotate the geared brake motor 58g under release of braking of the motor 58g in a reverse rotation corresponding to rising movement of the arm 58h in accordance with the electric power supply from the power source PS. The driving circuit 170b drives the geared brake motor 57a upon receipt of the set signal from the RS flip-flop 180a through the OR gate 171.

The microcomputer 160, which is substantially the same as described in the first embodiment, executes the main control program and interrupt control program in accordance with the flow charts of FIGS. 5 to 10C. During this execution, the microcomputer 160 performs arithmetic operations necessary for controlling an OR gate 171 connected through the driving circuit 170b to the geared brake motor 57a, the driving circuits 170a, 170c connected to the geared brake motor 61 and the indicator lamp L respectively and the RS flip-flops 180a to 180d. The other construction is the same as that of the first embodiment.

In operation, the microcomputer 160 starts execution of the main control program in step 200 in accordance with the flow chart of FIG. 5 to perform initialization in step 210. At this time, the RS flip-flops 180a to 180d are reset by the microcomputer 160. Upon start of the microcomputer 160, the timer is reset to start measuring the aforementioned predetermined time. After the above-mentioned initialization, the microcomputer 160 executes the origin acquiring routine and the origin return routine (see FIGS. 5, 7A, 7B and 8) during which the elevator assembly 50 is stopped and maintained at the position corresponding to the dog member 122, as described in the first embodiment.

It is assumed that at this time the dishwashing machine 10A has completed washing and rinsing of tableware on a rack 10c placed on the top surface 11A of the washing machine assembly 10a and also that the door 10b is opened as shown in FIG. 21 to close the door opening sensor 90d. Under this condition, when the start switch 90a is closed after the rack 20b holding thereon tableware to be washed is placed on the top surface 21a of the work table 20A as shown in FIG. 21, the RS flip-flop 180a generates a set signal with the door opening sensor 90d closed. The driving circuit 190a is responsive to the set signal from the RS flip-flop 180a to rotate the geared brake motor 23 under release of braking of the motor 23 in the forward rotation at the reduced speed in accordance with the electric power from the commercially available power source PS. At the same time, the driving circuit 170b is driven by the OR gate 171 to rotate the geared brake motor 57a under release of braking of the motor 57a at the reduced speed in accordance with the electric power from the commercially available power source PS.

Thus, the pusher mechanism 20a pushes the rack 20b toward the rack 10c by means of the roller 26b of the arm 26, and the timing belts 57i and 57l are driven. Then, the rack 10c is pushed at its front end portion by the rack 20b to be placed on the front end portions of both the timing belts 571 and 571. At this time, the top surfaces of timing belts 57i and 57l are positioned slightly higher than the top surface 21a of the work table 20A, because the elevator assembly 50 is maintained at the position corresponding to the dog member 122, as previously described. This may facilitate placing of the front end portion of the rack 10c onto the timing belts 57i and 57l. Subsequently, the rack 10c is inserted into the elevator assembly 50 by the timing belts 57i and 57l, and the rack 20b is carried onto the top surface 11A of the washing machine assembly 10a.

When feeding of the rack 20b onto the top surface 11A of the washing machine assembly 10a is completed, the pusher end sensor 90c resets the RS flip-flop 180a. In this instance, the above-noted insertion of the rack 10c causes the insertion start sensor 100a to generate an insertion start signal. Thus, the microcomputer 160 determines "YES" in step 240a of FIG. 5 to determine "NO" in step 240b on a basis of the storage count data Cw=1 (see step 221g in FIG. 7A) < the maximum value Cwm. Furthermore, the microcomputer 160 is generating a belt drive signal for the timing belt mechanism 57 in step 240c. Thus, the rack 10c will be pulled enoughly into the elevator assembly 50 by the timing belts 57i and 57l, even if insertion of the rack 10c is insufficient upon reset of the RS flip-flop 180a.

When the pusher end sensor 90c is closed as previously described, the RS flip-flop 180b generates a set signal therefrom, and the driving circuit 190a rotates the geared brake motor 23 under release of braking of the motor 23 in the reverse rotation at the reduce speed. Then, the RS flip-flop 180c generates a set signal therefrom and the driving circuit 190b rotates the geared brake motor 58g under release of braking of the motor 58g in the forward rotation at the reduced speed. As a result, the arm 26 of the pusher mechanism 20a returns to the origin position and the arm 58h of the opening mechanism 58 lowers to close the door 10b against the above-mentioned spring mechanism. When the pusher origin sensor 90b is closed with return of the arm 26 to the origin position, the RS flip-flop 180b is reset to stop the geared brake motor 23 by way of the driving circuit 190a.

When the door 10b is closed according to lowering of the arm 58h and the lower limit sensor 90e is closed, the RS flip-flop 180d generates a set signal upon reset of the RS flip-flop 180c, and the driving circuit 190b effects a reverse rotation of the geared brake motor 58g at the reduced speed to rise the arm 58h. When the arm upper limit sensor 90f is closed, the RS flip-flop 180d is reset to stop the geared brake motor 58g by way of the driving circuit 190b.

As the door 10b is closed as previously described, the dishwashing machine 10A locks the door 10b automatically and performs washing and rinsing of the tableware on the rack 20b. When the insertion end sensor 100b generates an insertion end signal upon completion of insertion of the rack 10c into the elevator assembly 50, the microcomputer 160 determines "YES" in step 250 to vanish the belt drive signal in step 250a in response to which the geared brake motor 57a is stopped under its braking operation to stop both the timing belts 57i and 57l.

Then, the microcomputer 160 executes the level moving routine 260 (see FIGS. 6 and 9) and the interrupt control program (see FIGS. 10A and 10C), as previously described, during which the elevator assembly 50 is stopped with the back end portion of the top surface 56c of the ramp 56 faced to the end portion of the storage shelf 76 of the wagon W. When the arithmetic operation in the level moving routine 260 is completed, the microcomputer 160 generates a belt drive signal in step 260a of FIG. 6, in response to which the geared brake motor 57a cooperates with the driving circuit 170b to drive the timing belts 57i and 57l so as to carry the rack 10c onto the storage shelf 76.

When the decision in step 270 becomes "YES" in accordance with the disappearance of the insertion end signal from the insertion end sensor 100b, the microcomputer 160 returns the main control program to the origin return routine 230, as described in the first embodiment, to execute the origin return routine 230 and interrupt control program, during which the elevator assembly 50 is returned to the position corresponding to the dog member 122 as described in the first embodiment.

If a new rack holding thereon tableware to be washed is placed on the top surface 21a of the work table 20A upon opening of door 10b caused by finishing rinsing of the table ware by the dishwashing machine 10A, the pusher mechanism 20 is responsive to closing of the start switch 90a under closure of the door opening sensor 90d to push the new rack onto the top surface 11A of the washing machine assembly 10a and to push the rack 20b into the elevator assembly 50 so as to return the arm 26 to the origin position, as previously described. The opening/closing mechanism 58 closes the door 10b by means of the arm 58h as described above and thereafter moves the arm 58h upwardly. In addition, the dishwashing machine 10A starts washing upon closure of the door 10b.

When the rack 20b is pushed into the elevator assembly 50, as previously described, the microcomputer 160 performs the arithmetic operations in steps 240a to 250a during which the rack 20b is sufficiently inserted into the elevator assembly 50 in the same as the case of the rack 10c. Then, the microcomputer 160 executes the level moving routine 260 during which the elevator assembly 50 is stopped with the top surface of the ramp 56 faced to the storage shelf 77 of the wagon W, as described in the first embodiment. Subsequently, the microcomputer 160 performs arithmetic operations in steps 260a to 270a of FIG. 6 during which the rack 20b is stored onto the storage shelf 77 substantially in the same manner as is done for the rack 10c. Thereafter the microcomputer 160 executes the origin return routine 230 in which the elevator assembly 50 is returned to the position corresponding to the dog member 122, as described above. At every time when each rack holding thereon tableware which has been washed and rinsed newly in the dishwashing machine 10A is pushed into the elevator assembly 50 in the same as case of rack 10c, each rack pushed into the elevator assembly 50 is stored in each of the remaining storage shelves 78, 79 of the wagon W substantially in the same manner as explained above.

As described above, prior to automatic storage of the individual racks into the wagon W in the seventh embodiment, the individual racks are carried onto the washing machine assembly 10a and then into the elevator assembly 50 through pushing action of the pusher mechanism 20a against the rack on the work table 20A caused by the above-mentioned actuation of the start switch 90a. Thus, it is realized that the disturbing machine 10A performs washing and rinsing operations. As a result, it is possible to achieve automatic washing and rinsing of tableware hold on each rack and to assure the same operation and effect as those in the first embodiment. Furthermore, washing and ringing of tableware on each rack and storage of each rack into the wagon W are wholly and automatically realized after actuation of the start switch 90a. Thus, the working efficiency may be considerably improved even with a single worker. The washing and rinsing operations by the dishwashing machine 10A are performed in parallel with the storing operation into the wagon W by the elevator E. This further enhances the working efficiency.

Figure 15:
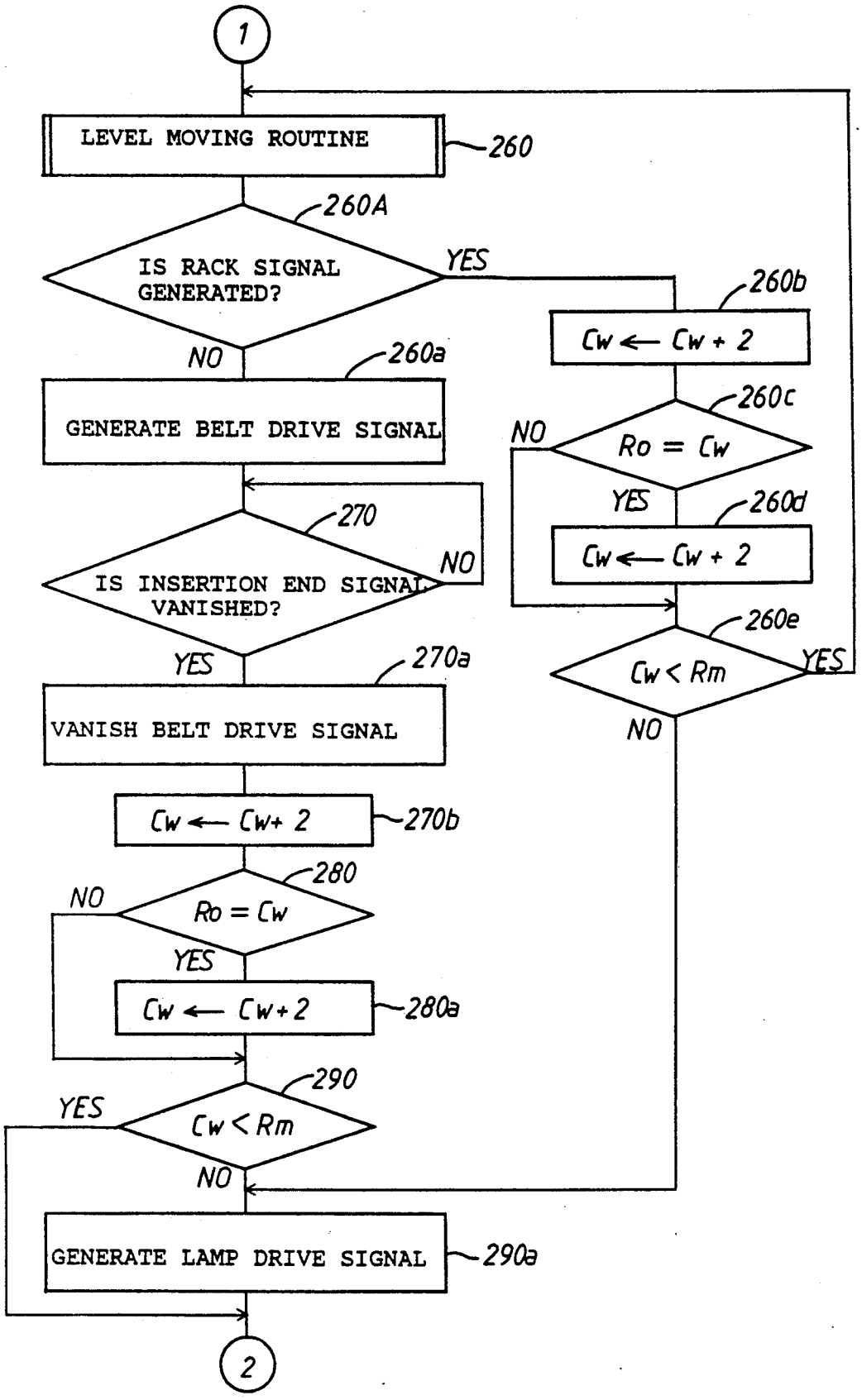
FIG. 15 is a partial flow chart of the third embodiment.

For the actual practice of the present invention, the main control program described in the third embodiment may be modified to change a portion of the flow chart of FIG. 15 (or the level moving routine 260) into the flow chart of FIG. 19. In this case, it is possible to attain the operation and effect described in the sixth embodiment in addition to the operation and effect described in the third embodiment.

For the actual practice of the present invention, it is possible to attain the operation and effect described in the seventh embodiment in addition to the operation and effect described in any one of the second to sixth embodiments, in case that in any one of the second to sixth embodiments, the washing machine 10, work table 20 and driving circuits 170, 180 and 190 (see FIGS. 1 and 2) are replaced with the dishwashing machine 10A, work table 20A and driving circuit 170a, 170b and 170c (see FIGS. 21 and 22) described in the seventh embodiment, respectively, in addition to adopting the pusher mechanism 20a, opening and closing mechanism 58, start switch 90a, pusher origin sensor 90b, pusher end sensor 90c, door opening sensor 90d, arm lower limit sensor 90e, arm upper limit sensor 90f, OR gate 171, RS flip-flops 180a to 180d and driving circuits 190a, 190b (see FIGS. 21 to 25) described in the seventh embodiment.

Figure 26:
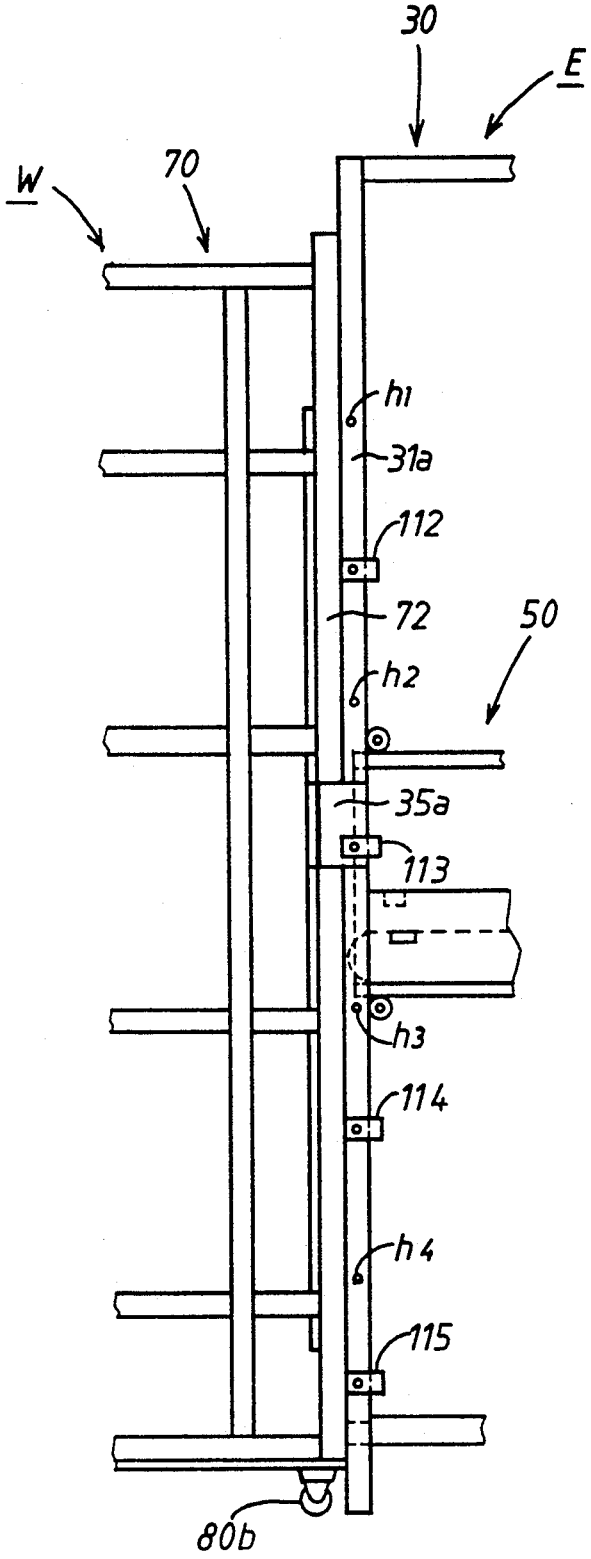
FIG. 26 is a partial side view of an elevator illustrating a modification of the above individual embodiments.

For the actual practice of the present invention, supplemental screw holes h1, h2, h3 and h4 are formed at proper intervals on the support 31a of the frame 30 as shown in FIG. 26. In this case, an increase in the number of the shelves may be coped with by attaching dog members of the level sensor 110 through the supplementary holes h1 to h4 to the support 31a, even if the number of shelves of the wagon W increases.

For the actual practice of the present invention, the insertion start sensor 100a and step 240a (see FIG. 5) may be eliminated.

For the actual practice of the present invention, the present invention may be adapted for automatic storage of objects to be conveyed into the wagon W similarly to the rack, with no limitation to the rack for the dishwashing machine.

For the actual practice of the present invention, the work table 20 shown in FIG. 1 may be eliminated to line up the dishwashing machine 10 closely with the frame 30.

We claim:

1. A dishwashing system comprising:

a dishwashing machine for washing tableware at every time when each rack holding thereon tableware is placed in a washing chamber;

a wagon provided therein with plural stages of horizontal storage shelves in an up-and-down direction;

an elevator disposed between said wagon and said dishwashing machine and provided therein with an elevatable base for placing thereon said each rack holding thereon tableware at every time when said each rack is removed from said washing chamber and with a conveying mechanism mounted on said base for horizontally conveying said each rack placed on said base to store said each rack onto each of said storage shelves;

reference position detecting means for detecting a reference position defined in said elevator when said base reaches said reference position;

placing detection means for detecting placing of said each rack on said base at every time when said each rack is placed on said base maintained at said reference position;

opposing position detecting means for detecting an opposing position of said base to one of said storage shelves when said base reaches said opposing position; and drive control means for moving said base upward of downward in response to detection of said placing detection means, for releasing the upward or downward movement of said base in response to detection of said opposing position detecting means to effect horizontal conveyance of said conveying mechanism, for releasing the horizontal conveyance of said conveying mechanism when said placing detection means becomes a non-detection state upon each completion of storing said each rack onto each of said storage shelves to move said base downward or upward, and for releasing the downward or upward movement of said base in response to detection of said reference position detecting means.

* * * * *